US011724159B2

(12) United States Patent
Nardacci et al.

(10) Patent No.: US 11,724,159 B2
(45) **Date of Patent: *Aug. 15, 2023**

(54) GOLF BALL DIMPLE PLAN SHAPE

(71) Applicant: Acushnet Company, Fairhaven, MA (US)

(72) Inventors: Nicholas M. Nardacci, Barrington, RI (US); Michael R. Madson, Easton, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/539,596

(22) Filed: Dec. 1, 2021

(65) Prior Publication Data

US 2022/0088442 A1 Mar. 24, 2022

Related U.S. Application Data

(63) Continuation of application No. 17/079,889, filed on Oct. 26, 2020, now Pat. No. 11,207,571, which is a continuation-in-part of application No. 16/693,778, filed on Nov. 25, 2019, now Pat. No. 10,814,176, which is a continuation-in-part of application No. 16/234,651, filed on Dec. 28, 2018, now Pat. No. 10,486,028, which is a continuation-in-part of application No. 15/912,467, filed on Mar. 5, 2018, now Pat. No. 10,195,484, which is a continuation-in-part of application No. 14/948,252, filed on Nov. 21, 2015, now Pat. No. 9,908,005, which is a continuation-in-part of application No. 14/941,841, filed on Nov. 16, 2015, now Pat. No. 9,993,690, said application No. 15/912,467 is a continuation-in-part of application No. 14/948,251, filed on Nov. 21, 2015, now Pat. No. 9,908,004, which is a continuation-in-part of application No.

(Continued)

(51) Int. Cl.
*A63B 37/14* (2006.01)
*A63B 37/00* (2006.01)

(52) U.S. Cl.
CPC ..... *A63B 37/0021* (2013.01); *A63B 37/0007* (2013.01); *A63B 37/0012* (2013.01)

(58) Field of Classification Search
CPC ..... A63B 37/0007; A63B 37/0012
USPC ..... 473/378–385
See application file for complete search history.

(56) References Cited

U.S. PATENT DOCUMENTS 4,729,861 A 3/1988 Lynch
4,921,255 A 5/1990 Taylor (Continued)

FOREIGN PATENT DOCUMENTS

CN 103877704 A * 6/2014 ..... A63B 37/0043
JP 11019248 A 1/1999

*Primary Examiner* — Alvin A Hunter

(57) ABSTRACT

The present invention is directed to golf balls having improved aerodynamic performance due, at least in part, to the selection of the plan shapes of the dimples thereon. In particular, the present invention is directed to a golf ball that includes at least a portion of its dimples having a plan shape defined by a low frequency periodic function mapped along a simple closed path. In addition, the present invention provides methods for designing dimples having a plan shape defined by a low frequency periodic function mapped along a simple closed path.

9 Claims, 45 Drawing Sheets

Related U.S. Application Data

14/941,841, filed on Nov. 16, 2015, now Pat. No. 9,993,690.

(56) References Cited

U.S. PATENT DOCUMENTS

| | | | | |
|---|---|---|---|---|
| 4,925,193 | A | 5/1990 | Melvin et al. | |
| 4,991,852 | A | 2/1991 | Pattison | |
| 5,249,804 | A | 10/1993 | Sanchez | |
| 5,562,552 | A | 10/1996 | Thurman | |
| 5,566,943 | A | 10/1996 | Boehm | |
| 5,575,477 | A | 11/1996 | Hwang | |
| 5,957,787 | A | 9/1999 | Hwang | |
| 6,254,496 | B1 | 7/2001 | Maehara | |
| 6,390,740 | B1 | 5/2002 | Nesbitt | |
| 6,409,615 | B1 | 6/2002 | McGuire | |
| 6,435,988 | B2 | 8/2002 | Maehara | |
| 6,503,158 | B2 | 1/2003 | Murphy | |
| 6,527,654 | B2 | 3/2003 | Sajima | |
| 6,632,150 | B1 * | 10/2003 | Ogg | A63B 37/008 473/378 |
| 6,702,696 | B1 | 3/2004 | Nardacci | |
| 6,749,525 | B2 | 6/2004 | Aoyama | |
| 6,796,912 | B2 | 9/2004 | Dalton et al. | |
| 6,802,787 | B2 | 10/2004 | Ogg | |
| 6,884,184 | B2 | 4/2005 | Nardacci | |
| 6,969,327 | B2 | 11/2005 | Aoyama | |
| 6,991,564 | B2 | 1/2006 | Sajima | |
| 7,041,012 | B2 | 5/2006 | Iwami | |
| 7,059,978 | B2 | 6/2006 | Yokota | |
| 7,090,593 | B2 | 8/2006 | Sullivan | |
| 7,112,149 | B2 | 9/2006 | Sajima | |
| 7,278,930 | B2 | 10/2007 | Yokota | |
| 7,303,491 | B2 | 12/2007 | Nardacci | |
| 7,338,393 | B2 | 3/2008 | Veilleux | |
| 7,387,582 | B2 | 6/2008 | Sajima | |
| 7,473,194 | B2 | 1/2009 | Nardacci | |
| 7,513,839 | B2 | 4/2009 | Nardacci | |
| 7,691,010 | B2 | 4/2010 | Ohama | |
| 8,834,302 | B2 | 9/2014 | Nakamura | |
| 8,894,509 | B2 | 11/2014 | Kim | |
| 9,345,931 | B2 | 5/2016 | Kim | |
| 9,403,062 | B2 | 8/2016 | Kim | |
| 9,452,321 | B2 | 9/2016 | Kim | |
| 9,457,236 | B2 * | 10/2016 | Ladd | A63B 37/0043 |
| 9,649,536 | B2 * | 5/2017 | Nardacci | A63B 37/00065 |
| 9,908,004 | B2 * | 3/2018 | Nardacci | A63B 37/0007 |
| 9,908,005 | B2 * | 3/2018 | Nardacci | A63B 37/0007 |
| 9,943,728 | B2 | 4/2018 | Nardacci | |
| 9,950,215 | B2 * | 4/2018 | Nardacci | A63B 37/007 |
| 9,993,690 | B2 | 6/2018 | Nardacci | |
| 10,124,213 | B2 * | 11/2018 | Nardacci | A63B 37/0021 |
| 10,195,484 | B2 | 2/2019 | Nardacci | |
| 10,343,018 | B2 * | 7/2019 | Nardacci | A63B 37/00065 |
| 10,369,418 | B2 | 8/2019 | Madson | |
| 10,486,028 | B2 * | 11/2019 | Nardacci | A63B 37/0077 |
| 10,814,176 | B2 * | 10/2020 | Madson | A63B 37/0007 |
| 11,117,021 | B2 * | 9/2021 | Nardacci | A63B 37/0021 |
| 11,207,571 | B2 * | 12/2021 | Nardacci | A63B 37/0012 |
| 2005/0266934 | A1 | 12/2005 | Morgan | |
| 2012/0165130 | A1 | 6/2012 | Madson et al. | |
| 2013/0172123 | A1 | 7/2013 | Nardacci et al. | |
| 2014/0179462 | A1 * | 6/2014 | Ladd | A63B 37/0076 473/376 |
| 2015/0045150 | A1 | 2/2015 | Hixenbaugh | |
| 2017/0021234 | A1 * | 1/2017 | Ladd | A63B 37/0076 |
| 2017/0136302 | A1 | 5/2017 | Nardacci | |
| 2018/0036597 | A1 | 2/2018 | Nardacci | |
| 2018/0229083 | A1 | 8/2018 | Madson | |

* cited by examiner

GOLF BALL DIMPLE PLAN SHAPE

CROSS-REFERENCE TO RELATED APPLICATIONS

This application is a continuation of U.S. patent application Ser. No. 17/079,889, filed Oct. 26, 2020, which is a continuation-in-part of U.S. patent application Ser. No. 16/693,778, filed Nov. 25, 2019, now U.S. Pat. No. 10,814,176, which is a continuation-in-part of U.S. patent application Ser. No. 16/234,651, filed Dec. 28, 2018, now U.S. Pat. No. 10,486,028, which is a continuation-in-part of U.S. patent application Ser. No. 15/912,467, filed Mar. 5, 2018, now U.S. Pat. No. 10,195,484, the entire disclosures of which are hereby incorporated herein by reference.

U.S. patent application Ser. No. 15/912,467 is a continuation-in-part of U.S. patent application Ser. No. 14/948,252, filed Nov. 21, 2015, now U.S. Pat. No. 9,908,005, which is a continuation-in-part of U.S. patent application Ser. No. 14/941,841, filed Nov. 16, 2015, now U.S. Pat. No. 9,993,690, the entire disclosures of which are hereby incorporated herein by reference.

U.S. patent application Ser. No. 15/912,467 is also a continuation-in-part of U.S. patent application Ser. No. 14/948,251, filed Nov. 21, 2015, now U.S. Pat. No. 9,908,004, which is a continuation-in-part of U.S. patent application Ser. No. 14/941,841, filed Nov. 16, 2015, now U.S. Pat. No. 9,993,690, the entire disclosure of which are hereby incorporated herein by reference.

FIELD OF THE INVENTION

The present invention relates to golf balls having improved aerodynamic characteristics. The improved aerodynamic characteristics are obtained through the use of specific dimple arrangements and dimple plan shapes. In particular, the present invention relates to a golf ball including at least a portion of dimples having a plan shape defined by low frequency periodic functions, and, more particularly, a low frequency periodic cosine function, along a circular closed path.

BACKGROUND OF THE INVENTION

Design variables associated with the external surface geometry of a golf ball, e.g., dimple surface coverage, dimple pattern, and individual dimple geometries, provide golf ball manufacturers the ability to control and optimize ball flight. However, there has been little focus on the plan shape of a dimple, i.e., the perimeter or boundaries of the dimple on the golf ball outer surface, as a key variable in achieving such control and optimization. In particular, since the bifurcation created by the plan shape of a dimple creates a large transition from the external surface geometry, it is considered to play a role in aerodynamic behavior. As such, there remains a need for a dimple plan shape that maximizes surface coverage uniformity and packing efficiency, while maintaining desirable aerodynamic characteristics.

SUMMARY OF THE INVENTION

The present invention is directed to a golf ball having a generally spherical surface and including a plurality of dimples on the spherical surface, wherein at least a portion of the plurality of dimples, for example, about 50 percent or more, or about 80 percent or more, have a non-circular plan shape defined by a low frequency periodic function along a simple closed path. In one embodiment, the periodic function is a smooth sinusoidal periodic function such as a sine function. In another embodiment, the periodic function is a non-smooth function selected from a sawtooth wave, triangle wave, or square wave function. The periodic function may also be a combination of two or more periodic functions including smooth and non-smooth functions. In another embodiment, the periodic function is an arbitrary periodic function. In still another embodiment, the simple closed path is selected from a circle, ellipse, or square. The simple closed path may also be an arbitrary closed curve.

In this aspect, the plan shape is defined according to the following function:

$$Q(x)=F_{path}(l,scl,x)*F_{periodic}(s,a,p,x)$$

where $F_{path}$ is a path function of length l, with scale factor scl, defined along the vertices x; and $F_{periodic}$ is a periodic function with sharpness factor s, amplitude a, and period p defined at the vertices x. In one embodiment, the low frequency periodic function has a period of about 15 or less.

The present invention is also directed to a golf ball having a generally spherical surface and including a plurality of dimples on the surface, wherein at least a portion of the plurality of dimples, for example, about 50 percent or more, or about 80 percent or more, have a plan shape defined by a low frequency periodic function along a simple closed path according to the following function:

$$Q(x)=F_{path}(l,scl,x)*F_{periodic}(s,a,p,x)$$

where $F_{path}$ is a path function of length l, with scale factor scl, defined along the vertices x; and $F_{periodic}$ is a periodic function with sharpness factor s, amplitude a, and period p defined at the vertices x. In one embodiment, the periodic function is selected from a sine, cosine, sawtooth wave, triangle wave, square wave, or arbitrary function. In another embodiment, the path function is any simple closed path that is symmetrical about two orthogonal axes. For example, the path function may be selected from a circle, ellipse, or square. In still another embodiment, the period, p, may be about 15 or less, or about 9 or less. In yet another embodiment, the amplitude, a, is about 1 or less. In this aspect, the plan shape has an amplitude A of less than about 0.500.

The present invention is further directed to a golf ball having a surface with a plurality of recessed dimples thereon, wherein at least one of the dimples has a plan shape defined by a low frequency periodic function along a simple closed path symmetrical about two orthogonal axes according to the following function:

$$Q(x)=F_{path}(l,scl,x)*F_{periodic}(s,a,p,x)$$

where $F_{path}$ is a path function of length l, with scale factor scl, defined along the vertices x; and $F_{periodic}$ is a periodic function with sharpness factor s, amplitude a, and period p defined at the vertices x, wherein the periodic function is selected from a sine, cosine, sawtooth wave, triangle wave, square wave, or arbitrary function. In this aspect, the periodic function may be a sawtooth wave form, a square wave form, a cosine wave form, or a triangle wave form. In another embodiment, the plan shape has an amplitude A of about 0.0005 inches to about 0.100 inches.

The present invention is further directed to a golf ball having a generally spherical surface and comprising a plurality of dimples on the spherical surface, wherein at least a portion of the plurality of dimples have a non-circular plan shape defined by a low frequency periodic square wave function mapped along a circular simple closed path resulting in the following function:

$$Q(x)=F_{path}(l,scl,x)*F_{periodic}(s,a,p,x)$$

where $F_{path}$ is a circular function of length l, with scale factor scl, defined along the vertices x; and $F_{periodic}$ is a periodic square wave function with sharpness factor s, amplitude a, and period p defined at the vertices x.

The present invention is further directed to a golf ball having a generally spherical surface and comprising a plurality of dimples on the spherical surface, wherein at least a portion of the plurality of dimples have a non-circular plan shape defined by a low frequency periodic sawtooth function mapped along a circular simple closed path resulting in the following function:

$$Q(x)=F_{path}(l,scl,x)*F_{periodic}(s,a,p,x)$$

where $F_{path}$ is a circular function of length l, with scale factor scl, defined along the vertices x; and $F_{periodic}$ is a periodic sawtooth function with sharpness factor s, amplitude a, and period p defined at the vertices x. In a particular aspect of this embodiment, the periodic sawtooth function is defined by the equation:

$$f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$$

where s is the sharpness factor of the periodic sawtooth function and is defined by a constant value of from 10 to 60; a is the amplitude of the periodic sawtooth function; and p is the period of the periodic sawtooth function and is from 3 to 6, or p is equal to 3. In a particular aspect of this embodiment, the non-circular plan shape dimples include dimples having at least three different plan shape areas.

The present invention is further directed to a golf ball having a generally spherical surface with from 250 to 400 recessed dimples thereon, wherein at least 80% of the dimples are non-circular plan shape dimples having a plan shape defined by a periodic function mapped along a simple closed path according to the following function:

$$Q(x)=F_{path}(l,scl,x)*F_{periodic}(s,a,p,x)$$

where $F_{path}$ is a circle, ellipse, or square of length l, with scale factor scl, defined along the vertices x, and $F_{periodic}$ is a low frequency periodic function with sharpness factor s, amplitude a, and period p defined at the vertices x, and period p is about 15 or less. The periodic function is selected from sine, cosine, sawtooth wave, triangle wave, and square wave functions. The non-circular plan shape dimples include dimples having at least three different plan shape areas.

The present invention is further directed to a golf ball having a generally spherical surface and comprising a plurality of dimples on the spherical surface, wherein at least a portion of the plurality of dimples have a non-circular plan shape defined by a periodic sawtooth function mapped along a circular simple closed path, wherein the periodic sawtooth function is defined by the equation:

$$f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$$

where s is the sharpness factor of the periodic sawtooth function and is defined by a constant value of from 10 to 60; a is the amplitude of the periodic sawtooth function and is a value from 0.1 to 1; and p is the period of the periodic sawtooth function and is from 3 to 6. The non-circular plan shape dimples include dimples having at least three different plan shape areas.

The present invention is further directed to a golf ball having a generally spherical surface with from 250 to 400 recessed dimples thereon, wherein at least 80% of the dimples are non-circular plan shape dimples having a plan shape defined by a periodic function mapped along a simple closed path according to the following function:

$$Q(x)=F_{path}(l,scl,x)*F_{periodic}(s,a,p,x)$$

where $F_{path}$ is a circle of length l, with scale factor scl, defined along the vertices x, and $F_{periodic}$ is a periodic cosine function with sharpness factor s, amplitude a, and period p defined at the vertices x, and period p is 4.

In a particular aspect of the above embodiments, each one of the dimples having a non-circular plan shape defined by a periodic function mapped along a simple closed path comprises a first dimple profile and a second dimple profile, the first dimple profile having a first edge angle ($\Phi_{EDGE1}$) and a second edge angle ($\Phi_{EDGE2}$) and the second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values.

In another particular aspect of the above embodiments, the surface of one or more of the dimples having a non-circular plan shape defined by a periodic function mapped along a simple closed path includes a protruding center portion. In a further particular aspect, the protruding center portion lies below the nominal chord plane of the dimple. In another further particular aspect, the protruding center portion intersects with the nominal chord plane of the dimple.

BRIEF DESCRIPTION OF THE DRAWINGS

Further features and advantages of the invention can be ascertained from the following detailed description that is provided in connection with the drawings described below.

DETAILED DESCRIPTION

Figure 1:
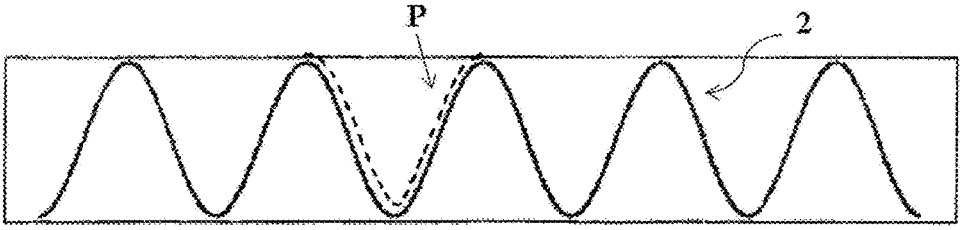
FIG. 1 illustrates the waveform of a cosine periodic function for use in a dimple plan shape according to the present invention.

The present invention is directed to golf balls having improved aerodynamic performance due, at least in part, to the use of non-circular dimple plan shapes. In particular, the present invention is directed to a golf ball that includes at least a portion of its dimples having a plan shape defined by low frequency periodic functions along a simple closed path.

Advantageously, the dimple plan shapes in accordance with the present invention allow for greater control and flexibility in defining the dimple geometry. For example, when dimple shapes or boundaries of the golf ball are circular, the packing efficiency and number of the dimples is limited. In fact, dimple patterns that provide a high percentage of surface coverage as disclosed, for example, in U.S. Pat. Nos. 5,562,552, 5,575,477, 5,957,787, 5,249,804, and 4,925,193 disclose geometric patterns for positioning dimples on a golf ball that are based on circular dimples. Since a number of dimple shapes are possible using the present invention, the present invention, in turn, provides for improved dimple packing efficiency and uniformity of surface coverage. As a result, the present invention provides a golf ball manufacturer the ability to fine tune golf ball aerodynamic characteristics by controlling the external surface geometry of the dimple.

Additionally, the plan shapes of dimples according to the present invention are unique in appearance. For example, in one embodiment, the low frequency periodic functions defining the plan shapes of the present invention provide perimeters having a distinct appearance. In turn, the plan shapes of the present invention provide for golf ball surface textures having distinct visual appearances as well as golf balls having improved aerodynamic characteristics.

Further, advantageously, dimples having plan shapes according to the invention and the golf balls incorporating such dimples provide a means to fine tune golf ball aerodynamic characteristics by specifically controlling the perimeter or boundary of each dimple. This allows the dimples to create the turbulence in the boundary layer. "Micro" adjusting the dimple plan shapes in accordance with the present invention allows for further agitation and/or tuning of the turbulent flow over the dimples. This, in turn, reduces the tendency for separation of the turbulent boundary layer around the golf ball in flight, and thus improves the aerodynamic performance of the golf ball. Further, plan shapes of the present invention allow for improved regularity of the undimpled golf ball surface. This allows the golf ball to remain resistant to premature wear and tear.

Dimple Plan Shapes

The present invention contemplates dimples having a non-circular plan shape defined by low frequency, low amplitude periodic functions or linear combinations thereof along a simple closed path. In particular, golf balls formed according to the present invention include at least one dimple having a plan shape defined by low frequency, low amplitude periodic functions or linear combinations thereof along a simple closed path. By the term, "plan shape," it is meant the shape of the perimeter of the dimple, or the demarcation between the dimple and the outer surface of the golf ball or fret surface.

According to the present invention, at least one dimple is formed using a simple closed path, i.e., a path that starts and ends at the same point without traversing any defining point or edge along the path more than once. For example, the present invention contemplates dimples formed using any simple cycle known in graph theory including circles and polygons. In one embodiment, the simple closed path is any path that is symmetrical about two orthogonal axes. In another embodiment, the simple closed path is a circle, ellipse, square, or polygon. In still another embodiment, the simple closed path is an arbitrary path. In this aspect, a suitable dimple shape according to the present invention may be based on any path that starts and ends at the same point without intersecting any defining point or edge.

The present invention contemplates the use of periodic functions to form the dimple shape including any function that repeats its values at regular intervals or periods. For the purposes of the present invention, a function $f$ is periodic if $$f(x)=f(x+p) \tag{1}$$

for all values of x where p is the period. In particular, the present invention contemplates any periodic function that is non-constant, non-zero.

In one embodiment, the periodic function used to form the dimple shape includes a trigonometric function. Examples of trigonometric functions suitable for use in accordance with the present invention include, but are not limited to, sine and cosine. FIG. 1 illustrates the waveform of a cosine periodic function that may be used to form a dimple shape in accordance with the invention. As shown in FIG. 1, the cosine wave 2 suitable for use in accordance with the present invention has a shape identical to that of a sine wave, except that each point on the cosine wave occurs exactly ¼ cycle earlier than the corresponding point on the sine wave.

In another embodiment, the periodic function suitable for use in forming a dimple shape in accordance with the present invention includes a non-smooth periodic function. Non-limiting examples of non-smooth periodic functions suitable for use with the present invention include, but are not limited to, sawtooth wave, triangle wave, square wave, and cycloid. In one embodiment, a sawtooth wave is suitable for use in forming a dimple shape in accordance with the present invention. In particular, a dimple in accordance with the present invention may have a shape based on a non-sinusoidal waveform that ramps upward and then sharply drops.

In another embodiment, a triangle wave is suitable for use in forming a dimple shape in accordance with the present invention. The triangle wave suitable for use in forming a dimple shape in accordance with the present invention is a non-sinusoidal waveform that is a periodic, piecewise linear, continuous real function.

In yet another embodiment, a square wave is suitable for use in forming a dimple shape in accordance with the present invention. For example, the square wave suitable for use in forming a dimple shape in accordance with the present invention is a non-sinusoidal periodic waveform in which the amplitude alternates at a steady frequency between fixed minimum and maximum values, with the same duration at minimum and maximum.

In this aspect of the invention, any of the above-mentioned periodic functions may be constructed as an infinite series of sines and cosines using Fourier series expansion for use in forming a dimple shape in accordance with the present invention. In particular, the Fourier series of a function, which is given by equations (2)-(5), is contemplated for use in forming the dimple shape according to the present invention:

$$f(x) = \frac{1}{2}a_0 \sum_{n=1}^{\infty} a_n \cos(nx) \sum_{n=1}^{\infty} b_n \sin(nx), \tag{2}$$

where:

$$a_0 = \frac{1}{\pi}\int_{-\pi}^{\pi} f(x)dx \tag{3}$$

$$a_n = \frac{1}{\pi}\int_{-\pi}^{\pi} f(x)\cos(nx)dx \tag{4}$$

$$b_n = \frac{1}{\pi}\int_{-\pi}^{\pi} f(x)sin(nx)dx \tag{5}$$

and n=1, 2, 3 . . . .

In addition, the following Fourier series are contemplated for use in forming the dimple shape in accordance with the present invention.

TABLE 1

FOURIER SERIES OF NON-SMOOTH PERIODIC FUNCTIONS

| Periodic Function | Fourier Series |
|---|---|
| Sawtooth wave | $\frac{1}{2} - \frac{1}{\pi}\sum_{n=1}^{\infty}\frac{1}{n}\sin\left(\frac{n\pi x}{L}\right)$ |
| Triangle wave | $\frac{8}{\pi^2}\sum_{n=1,3,5\ldots}^{\infty}\frac{(-1)^{\frac{(n-1)}{2}}}{n^2}\sin\left(\frac{n\pi x}{L}\right)$ |
| Square wave | $\frac{4}{\pi}\sum_{n=1,3,5\ldots}^{\infty}\frac{1}{n}\sin\left(\frac{n\pi x}{L}\right)$ |

Figure 2:
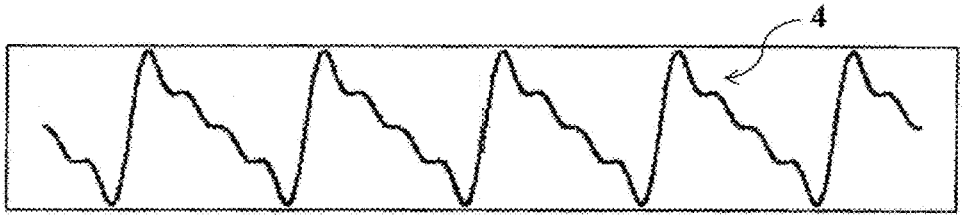
FIG. 2 illustrates the waveform of a sawtooth wave periodic function approximated by a Fourier series for use in a dimple plan shape according to the present invention.

For example, FIG. 2 illustrates the waveform of a sawtooth wave approximated by a Fourier series. In particular, FIG. 2 illustrates a sawtooth wave 4 approximated by a four-term Fourier series expansion for use in forming a dimple shape in accordance with the present invention. The four-term sawtooth expansion can be described by:

$$f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right).$$

Figure 3:
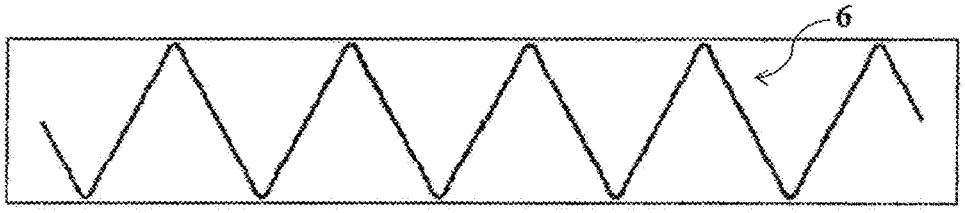
FIG. 3 illustrates the waveform of a triangle wave periodic function approximated by a Fourier series for use in a dimple plan shape according to the present invention.
Figure 4:
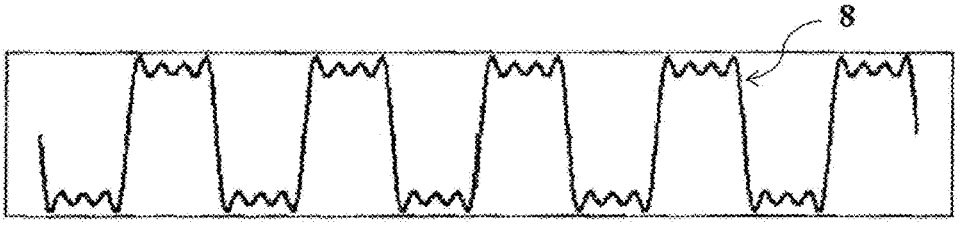
FIG. 4 illustrates the waveform of a square wave periodic function approximated by a Fourier series for use in a dimple plan shape according to the present invention.

In addition, FIG. 3 illustrates the waveform of a triangle wave approximated by a Fourier series. FIG. 3 illustrates a triangle wave 6 approximated by a four-term Fourier series expansion for use in forming a dimple shape in accordance with the present invention. Further, FIG. 4 illustrates the waveform of a square wave approximated by a Fourier series. For example, FIG. 4 illustrates a square wave 8 approximated by a four-term Fourier series expansion for use in forming a dimple shape in accordance with the present invention. The four-term square wave expansion can be described by:

$$f(x) = s - \frac{a}{\pi}\left(\sin(\pi px) + \frac{1}{3}\sin(3\pi px) + \frac{1}{5}\sin(5\pi px) + \frac{1}{7}\sin(7\pi px)\right).$$

While the above examples demonstrate four-term Fourier series expansions, it will be understood by those of ordinary skill in the art that more than or less than four terms may be used to approximate the non-sinusoidal waveforms. In addition, any method of approximation known to one of ordinary skill in the art may be used in this aspect of the invention.

Figure 5:
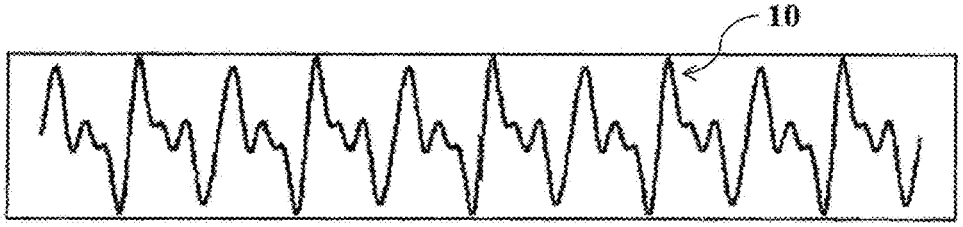
FIG. 5 illustrates the waveform of an arbitrary periodic function for use in a dimple plan shape according to the present invention.

In yet another embodiment, the present invention contemplates arbitrary periodic functions, or linear combinations of periodic functions for use in forming a dimple shape in accordance with the present invention. Accordingly, in one embodiment of the present invention, an arbitrary periodic function may be created using a linear combination of sines and cosines to form a dimple shape in accordance with the present invention. In this aspect, FIG. 5 illustrates the waveform of an arbitrary periodic function contemplated by the present invention. As shown in FIG. 5, the arbitrary wave 10 represents a linear combination of sines and cosines.

According to the present invention, the plan shape of the dimple may be produced by projecting or mapping any of the above-referenced periodic functions onto the simple closed path. In general, the mathematical formula representing the projection or mapping of the periodic function onto the simple closed path is expressed as equation (6):

$$Q(x)=F_{path}(l,scl,x)*F_{periodic}(s,a,p,x) \tag{6}$$

where $F_{path}$ represents the simple closed path on which the periodic function is mapped or projected with length l, scale factor scl, defined along the vertices x; and $F_{periodic}$ is any suitable periodic function with sharpness factor s, amplitude a, and period p defined at the vertices x.

In one embodiment, the projection may be described in terms of how the path function is altered by the periodic function. For example, the resulting vector Q(x) represents the altered coordinates of the path. Indeed, the "path function" contemplated by the present invention includes any of the simple paths discussed above.

In this aspect of the invention, the resulting vector, Q(x), may also be a suitable path for a dimple plan shape according to the present invention. That is, the resulting vector, Q(x), could itself become a path to which another periodic function is mapped. Indeed, any of the periodic functions disclosed above may be mapped to the resulting vector, Q(x), to form a dimple plan shape in accordance with the present invention.

The "length," l, and "scale factor," scl, may vary depending on the desired size of the dimple. However, in one embodiment, the length is about 0.150 inches to about 1.400 inches. In another embodiment, the length is about 0.250 inches to about 1.200 inches. In still another embodiment, the length is about 0.500 inches to about 0.800 inches.

The variable, $F_{periodic}$, of equation (6) will vary based on the desired periodic function. The term, "sharpness factor," is a scalar value and defines the mean of the periodic function. Generally, small values of s produce periodic functions that greatly alter the plan shape, while larger values of s produce periodic functions having a diminished influence on the plan shape. Indeed, as will be apparent to one of ordinary skill in the art, once an amplitude value is chosen, the sharpness factor, s, may be varied depending on the desired amount of alteration to the plan shape. In one embodiment, the sharpness factor ranges from about 10 to about 60. In another embodiment, the sharpness factor ranges from about 15 to about 55. In still another embodiment, the sharpness factor ranges from about 20 to about 50.

The amplitude of the plan shape, A, is defined as the absolute value of the maximum distance from the path during one period of the periodic function. The amplitude of the periodic function, a, affects the dimple plan shape in the opposite sense as sharpness factor, s. In this aspect, the "sharpness factor," s, and "amplitude," a, parameters are both used to control the mapped periodic function used to define Q(x). For example, the sharpness factor, s, and amplitude, a, parameters control the severity of the perimeter of the final plan shape.

In one embodiment, the amplitude, a, of the periodic function ranges from about 0.1 to about 1. In another embodiment, the amplitude, a, ranges from about 0.2 to about 0.8. In still another embodiment, the amplitude, a, ranges from about 0.3 to about 0.7. In yet another embodiment, the amplitude, a, ranges from about 0.4 to about 0.6. For example, the amplitude, a, may be about 0.5.

Figure 19:
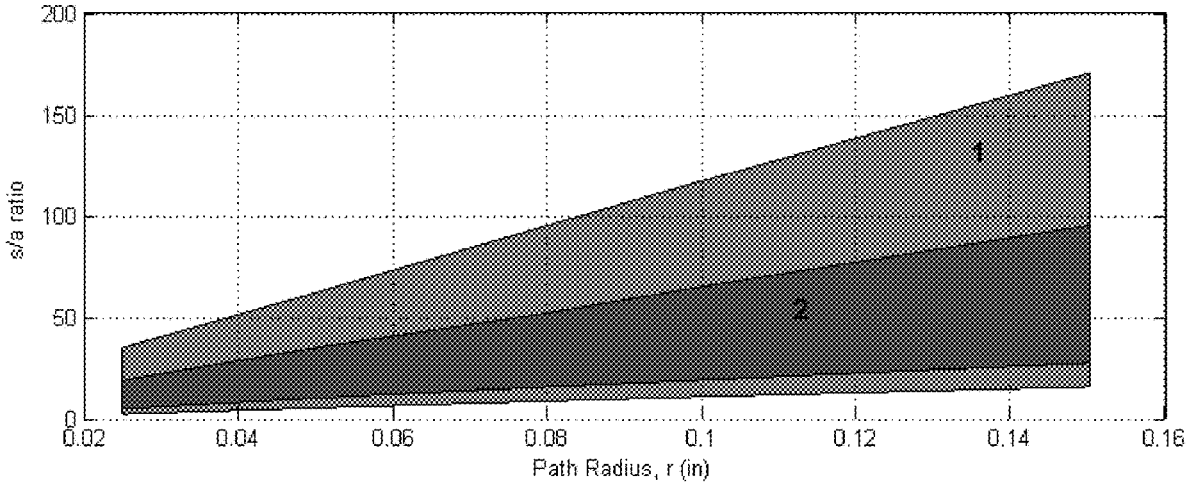
FIG. 19 is a graphical representation illustrating the range of the ratio of sharpness factor to amplitude for a periodic function for a given radius of a circular path in accordance with the present invention.

In one embodiment, the ratio of the sharpness factor, s, to the amplitude, a, defined as s divided by a, is within a range shown as region 1 or region 2 in FIG. 19 for a periodic function mapped along a circular path having a radius, r.

In another embodiment, the amplitude of the plan shape, A, i.e., the amplitude of function Q(x), is related to the period, p, and the dimple diameter, $D_d$, by equation (7):

$$A=\pi D_d/2p \tag{7}$$

Figure 17:
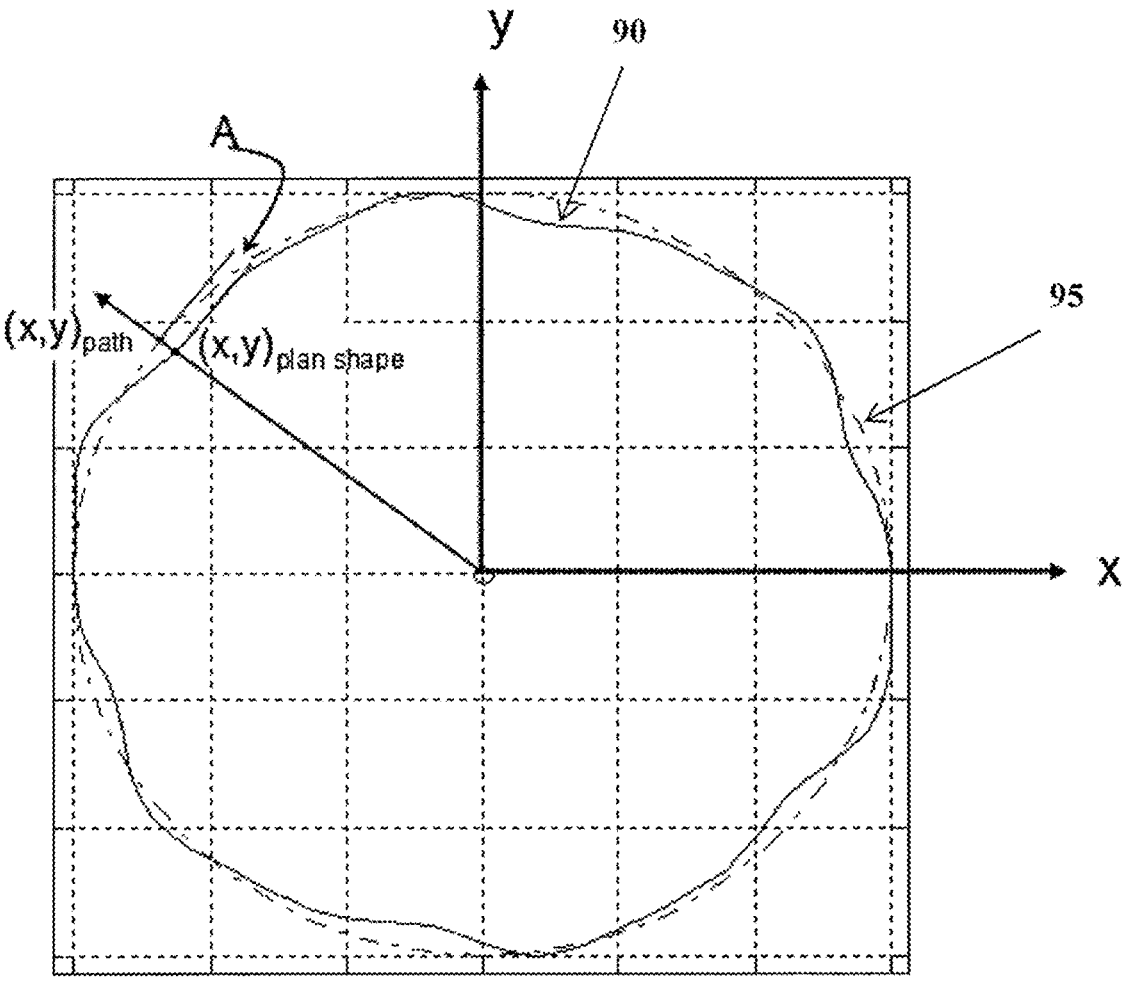
FIG. 17 illustrates a golf ball dimple plan shape produced in accordance with the present invention.

For example, FIG. 17 illustrates a plan shape constructed in accordance with the present invention having amplitude, A. As shown in FIG. 17, the amplitude A defines the maximum variation between the plan shape 90 from the path 95 (represented by the dashed line) during one period of the periodic function.

Low amplitude periodic functions are contemplated for use in forming a dimple shape in accordance with the present invention. In one embodiment, the amplitude A is less than about 0.500. In another embodiment, the amplitude A is about $1\times10^{-7}$ to about 0.100. In still another embodiment, the amplitude A is about $1\times10^{-6}$ to about 0.070. In yet another embodiment, the amplitude A is about $1\times10^{-5}$ to about 0.040. In still another embodiment, the amplitude A is about 0.0001 to about 0.002. For example, the amplitude A is about 0.078.

The amplitude of the plan shape, A, can be expressed as the maximum distance of any point on the plan shape from the path. In one embodiment, the maximum distance ranges from about 0.0001 inches to about 0.035 inches. In another embodiment, the maximum distance ranges from about 0.001 inches to about 0.020 inches. In another embodiment, the maximum distance ranges from about 0.001 inches to about 0.015 inches. In another embodiment, the maximum distance ranges from about 0.002 inches to about 0.010 inches. In another embodiment, the maximum distance ranges from about 0.002 inches to about 0.008 inches. In another embodiment, the maximum distance ranges from about 0.003 inches to about 0.008 inches. In another embodiment, the maximum distance ranges from about 0.003 inches to about 0.007 inches.

Figure 18:
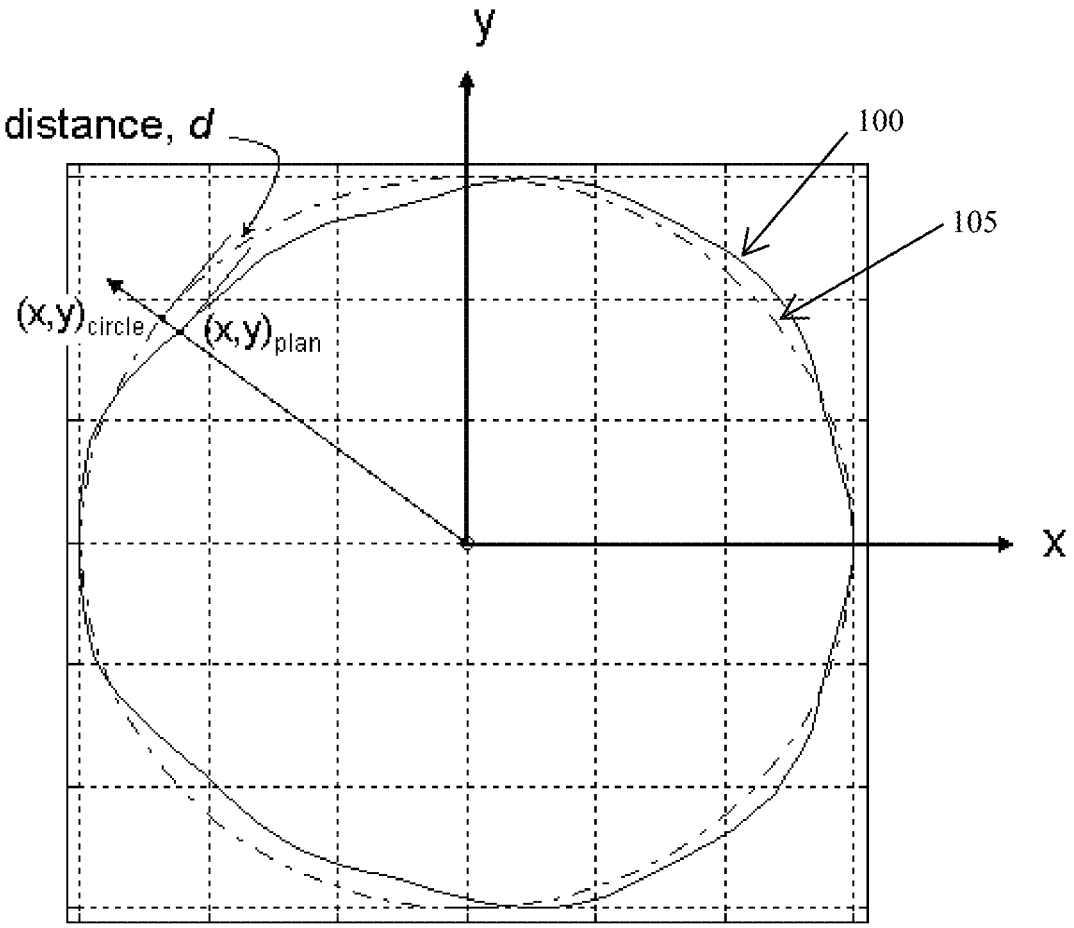
FIG. 18 illustrates a golf ball dimple plan shape produced in accordance with the present invention.

FIG. 18 illustrates a plan shape constructed in accordance with the present invention, wherein a periodic function is mapped along a circular path. The absolute distance, d, of any point on the plan shape 100 from the circular path 105 (represented by the dashed line) is defined by the following equation:

$$d=\sqrt{(x_{\text{circle}}-x_{\text{plan}})^2+(y_{\text{circle}}-y_{\text{plan}})^2}$$

where d is a directed distance calculated along a line from the plan shape centroid through corresponding points on the plan shape and circular path. The amplitude of the plan shape, A, is expressed as the maximum value, $d_{max}$, for all calculated distances, d. In a particular embodiment of the present invention, a periodic function is mapped along a circular path having a radius of from about 0.025 inches to about 0.150 inches, and the maximum value, $d_{max}$, for all calculated distances, d, of any point on the plan shape from the circular path is from about 0.001 inches to about 0.015 inches.

In this aspect, the amplitude of the plan shape, A, can also be expressed as a ratio of amplitude of the plan shape, A, to effective dimple diameter. For example, the ratio of amplitude of the plan shape, A, to effective dimple diameter is about 10:1 or less. In another embodiment, the ratio of amplitude of the plan shape, A, to effective dimple diameter is about 7.5:1 or less. In yet another embodiment, the ratio of amplitude of the plan shape, A, to effective dimple diameter is about 5:1 or less.

The "period," p, refers to the horizontal distance required for the periodic function to complete one cycle. For example, as shown in FIG. 1, one period p of the waveform is depicted by the dotted line. As will be apparent to one of ordinary skill in the art, the period may vary based on the periodic function. However, in one embodiment, the present invention contemplates periodic functions having a period of about 15 or less. In another embodiment, the present invention contemplates periodic functions having a period of less than about 15. In another embodiment, the present invention contemplates periodic functions having a period of less than about 12. In another embodiment, the present invention contemplates periodic functions having a period of about 10 or less. In another embodiment, the present invention contemplates periodic functions having a period of less than about 9. In another embodiment, the present invention contemplates periodic functions having a period of about 8 or less. In another embodiment, the present invention contemplates periodic functions having a period of less than about 6. In another embodiment, the present invention contemplates periodic functions having a period of about 5 or less. In another embodiment, the present invention contemplates periodic functions having a period of less than about 5. In another embodiment, the present invention contemplates periodic function having a period of about 4.

The period of the wave function is inversely proportional to the function frequency. Indeed, the frequency refers to the number of periods completed over the path function. For example, the frequency of a periodic function having a period p is represented by 1/p. In one embodiment, the present invention contemplates low frequency periodic functions. That is, the present invention contemplates periodic functions having a frequency of about 1/15 or more. In one embodiment, the periodic function has a frequency of about 1/12 or more. In another embodiment, the periodic function has a frequency of about 1/9 or more. In still another embodiment, the periodic function has a frequency of about 1/6 or more. In yet another embodiment, the periodic function has a frequency of about 1/5 or more.

Accordingly, by manipulating the variables of equation (6), the present invention provides for golf ball dimples having various plan shapes defined by low frequency periodic functions along simple closed paths. By using the low frequency, low amplitude periodic functions and simple closed paths disclosed herein, the present invention allows for numerous dimple plan shapes.

Figure 6:
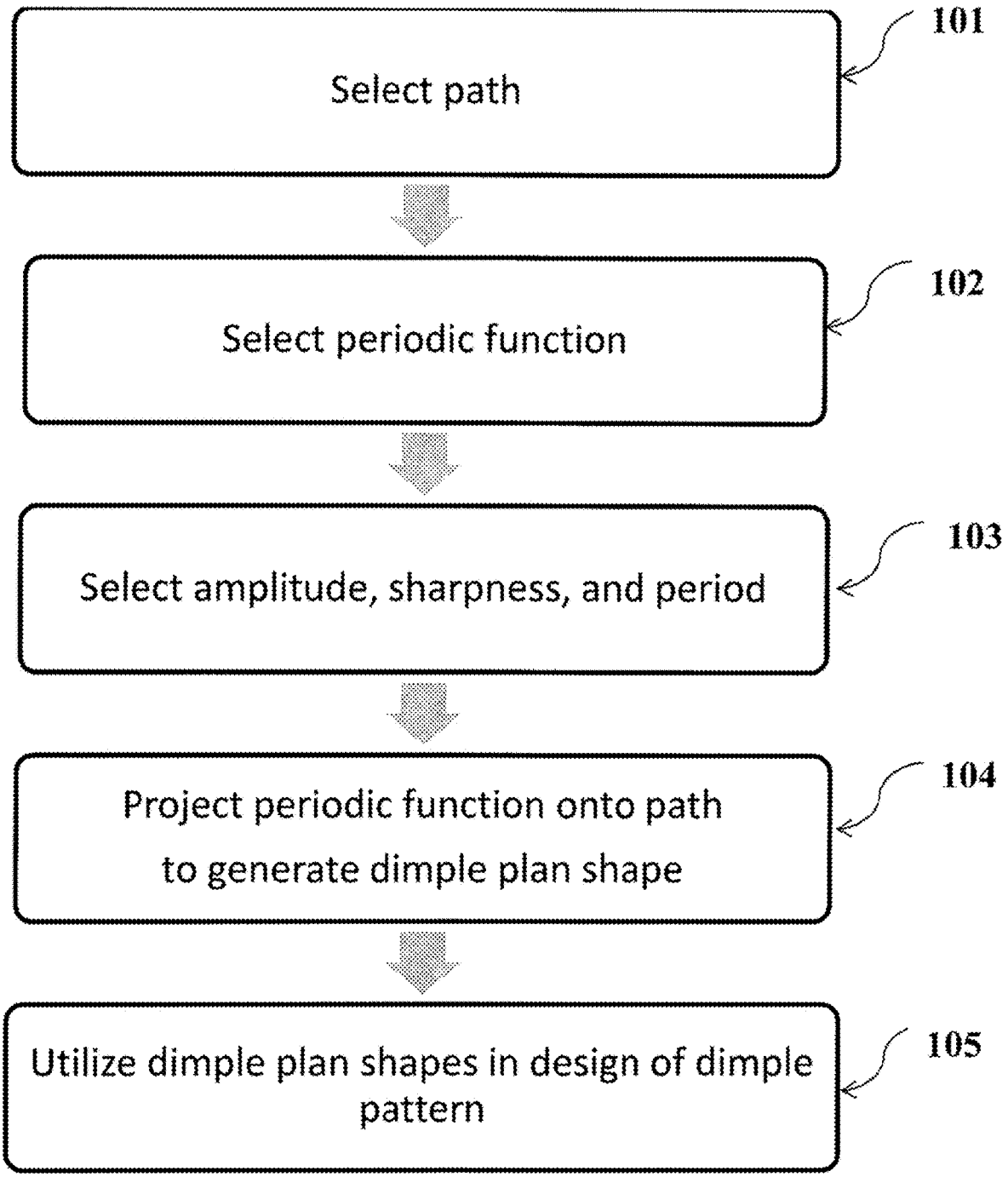
FIG. 6 is a flow chart illustrating the steps according to a method of the present invention.

FIG. 6 illustrates one embodiment of a method of forming a dimple plan shape in accordance with the present invention. For example, step 101 includes selecting the simple closed path on which the periodic function is to be projected. In this aspect, the present invention contemplates the use of any of the simple closed paths discussed above. Step 102 includes selecting the desired periodic function. Indeed, any of the periodic functions disclosed above are contemplated in this aspect of the invention.

At step 103, the amplitude, sharpness, period, or frequency of the periodic function is selected based on the desired periodic function and path. In one embodiment, the present invention contemplates dimple plan shapes defined by a low frequency, low amplitude periodic function. Accordingly, the amplitude, sharpness, period, or frequency should be selected such that the values are in accordance with the parameters defined above.

At step 104, the variables selected above, including the path, periodic function, amplitude, sharpness, and period, are inserted into equation (6), reproduced below:

$$Q(x)=F_{path}(l,scl,x)*F_{periodic}(s,a,p,x) \quad (6)$$

The resultant function is then used to project the periodic function onto the simple closed path in order to generate the dimple plan shape. The resultant function will vary based on the desired path and periodic function. For example, if the desired periodic function is a cosine function, $F_{periodic}$ may be represented by equation (8), depicted below:

$$f(x)=s+a*\cos(p*\pi*x) \quad (8)$$

As discussed above, the resultant dimple plan shape (e.g., the resulting vector Q(x)) may also be used as the path to which another periodic function is mapped. For example, a periodic function having a different period or a different periodic function may be projected onto the resultant dimple plan shape to form a new dimple plan shape in accordance with the present invention.

After the dimple plan shape has been generated, at step 105, the plan shape can be used in designing geometries for dimple patterns of a golf ball. For example, the plan shape paths generated by the methods of the present invention can be imported into a CAD program and used to define dimple geometries and tool paths for fabricating tooling for golf ball manufacture. The various dimple geometries produced in accordance with the present invention can then be used in constructing a dimple pattern that maximizes surface coverage uniformity and dimple packing efficiency.

Golf ball dimple patterns using plan shapes produced in accordance with the present invention can be modified in a number of ways to alter ball flight path and the associated lift and drag characteristics. The plan shapes can be scaled and weighted according to proximity to neighboring dimples. For example, the plan shapes of the present invention may be enlarged or reduced based on the neighboring dimples in order to allow for greater dimple packing efficiency. Likewise, the profile can be 'micro' altered to tailor desired dimple volume, edge angle, or dimple depth to optimize flight performance.

Dimple Patterns & Packing

The present invention allows for improved dimple packing over previous patterns so that a greater percentage of the surface of the golf ball is covered by dimples. In particular, each dimple having a plan shape in accordance with the present invention is part of a dimple pattern that maximizes surface coverage uniformity and packing efficiency.

In one embodiment, the dimple pattern provides greater than about 80 percent surface coverage. In another embodiment, the dimple pattern provides greater than about 85 percent surface coverage. In yet another embodiment, the dimple pattern provides greater than about 90 percent surface coverage. In still another embodiment, the dimple pattern provides greater than about 92 percent surface coverage.

In this aspect, the golf ball dimple plan shapes of the present invention can be tailored to maximize surface coverage uniformity and packing efficiency by selecting a period for the periodic function that is a scalar multiple of the number of neighboring dimples. For example, if the number of neighboring dimples is 4, the present invention contemplates a dimple plan shape having a period of 8 or 12. In another embodiment, the period is equal to the number of neighboring dimples. For example, if the dimple plan shape is constructed using a period of 5, the present invention contemplates that the dimple will be surrounded by 5 neighboring dimples.

Figure 15:
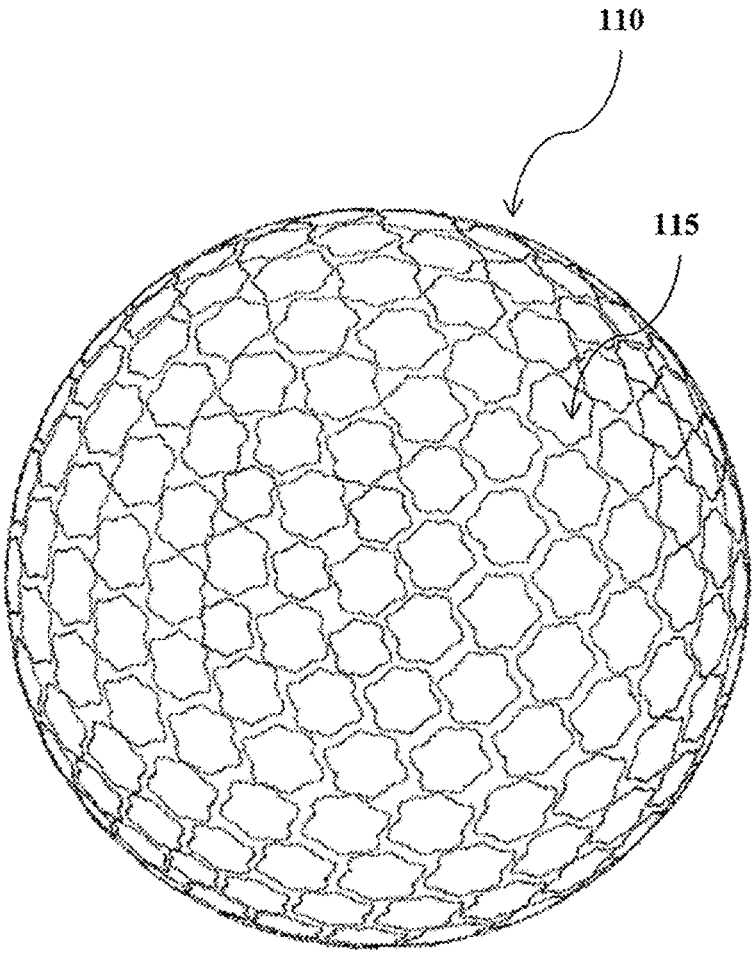
FIG. 15 illustrates a golf ball dimple pattern constructed from a plurality of dimple plan shapes according to the present invention.

FIG. 15 illustrates an example of a dimple pattern created in accordance with the present invention. In particular, FIG. 15 illustrates a golf ball dimple pattern 110 made up of non-circular dimple plan shapes (represented by 115) defined by low frequency periodic functions and produced in accordance with the present invention. As demonstrated in FIG. 15, the present invention provides for the possibility of interdigitation amongst neighboring dimples, a characteristic not possible with conventional circular dimples. This creates the opportunity for additional dimple packing arrangements and dimple distribution on the golf ball surface.

While the plan shapes of the present invention may be used for at least a portion of the dimples on a golf ball, it is not necessary that the plan shapes be used on every dimple of a golf ball. In general, it is preferred that a sufficient number of dimples on the ball have plan shapes according to the present invention so that the aerodynamic characteristics of the ball may be altered and the packing efficiency benefits realized. For example, at least about 30 percent of the dimples on a golf ball include plan shapes according to the present invention. In another embodiment, at least about 50 percent of the dimples on a golf ball include plan shapes according to the present invention. In still another embodiment, at least about 70 percent of the dimples on a golf ball include plan shapes according to the present invention. In yet another embodiment, at least about 90 percent of the dimples on a golf ball include the plan shapes of the present invention. In still another embodiment, all of the dimples (100 percent) on a golf ball may include the plan shapes of the present invention.

While the present invention is not limited by any particular dimple pattern, dimples having plan shapes according to the present invention are arranged preferably along parting lines or equatorial lines, in proximity to the poles, or along the outlines of a geodesic or polyhedron pattern. Conventional dimples, or those dimples that do not include the plan shapes of the present invention, may occupy the remaining spaces. The reverse arrangement is also suitable. Suitable dimple patterns include, but are not limited to, polyhedron-based patterns (e.g., icosahedron, octahedron, dodecahedron, icosidodecahedron, cuboctahedron, and triangular dipyramid), phyllotaxis-based patterns, spherical tiling patterns, and random arrangements.

Dimple Dimensions

The dimples on the golf balls of the present invention may include any width, depth, depth profile, edge angle, or edge radius and the patterns may include multitudes of dimples having different widths, depths, depth profiles, edge angles, or edge radii.

Since the plan shape perimeters of the present invention are noncircular, the plan shapes are defined by an effective dimple diameter which is twice the average radial dimension of the set of points defining the plan shape from the plan shape centroid. In one embodiment, dimples according to the present invention have an effective dimple diameter within a range of about 0.005 inches to about 0.300 inches. In another embodiment, the dimples have an effective dimple diameter of about 0.020 inches to about 0.250 inches. In still another embodiment, the dimples have an effective dimple diameter of about 0.100 inches to about 0.225 inches. In yet another embodiment, the dimples have an effective dimple diameter of about 0.125 inches to about 0.200 inches.

The surface depth for dimples of the present invention is within a range of about 0.003 inches to about 0.025 inches. In one embodiment, the surface depth is about 0.005 inches to about 0.020 inches. In another embodiment, the surface depth is about 0.006 inches to about 0.017 inches.

The dimples of the present invention also have a plan shape area. By the term, "plan shape area," it is meant the area based on a planar view of the dimple plan shape, such that the viewing plane is normal to an axis connecting the center of the golf ball to the point of the calculated surface depth. In one embodiment, dimples of the present invention have a plan shape area ranging from about 0.0025 $in^2$ to about 0.045 $in^2$. In another embodiment, dimples of the present invention have a plan shape area ranging from about 0.005 $in^2$ to about 0.035 $in^2$. In still another embodiment, dimples of the present invention have a plan shape area ranging from about 0.010 $in^2$ to about 0.030 $in^2$.

In a particular embodiment, the present invention provides a dimple pattern wherein the non-circular plan shape dimples include dimples having at least three, or at least four, or at least five, different plan shape areas.

Figure 16A:
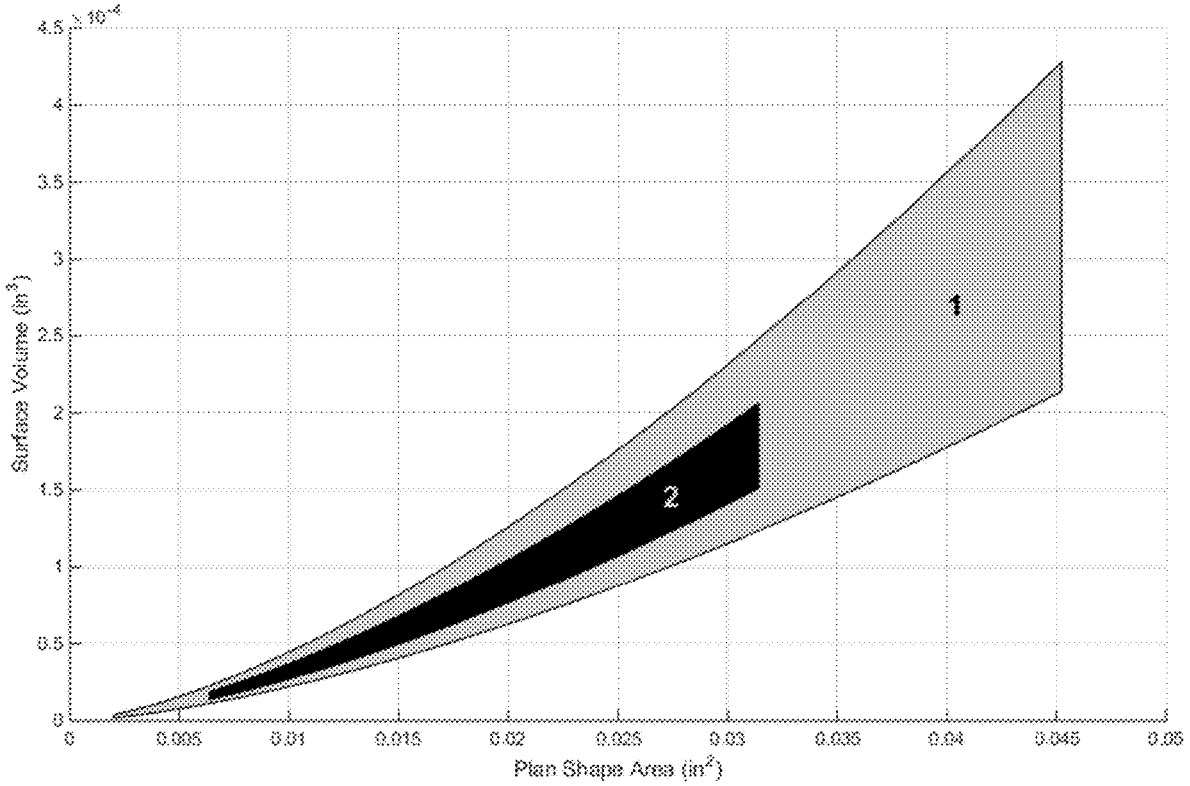
FIG. 16A is a graphical representation illustrating dimple surface volumes for golf balls produced in accordance with the present invention.
Figure 16B:
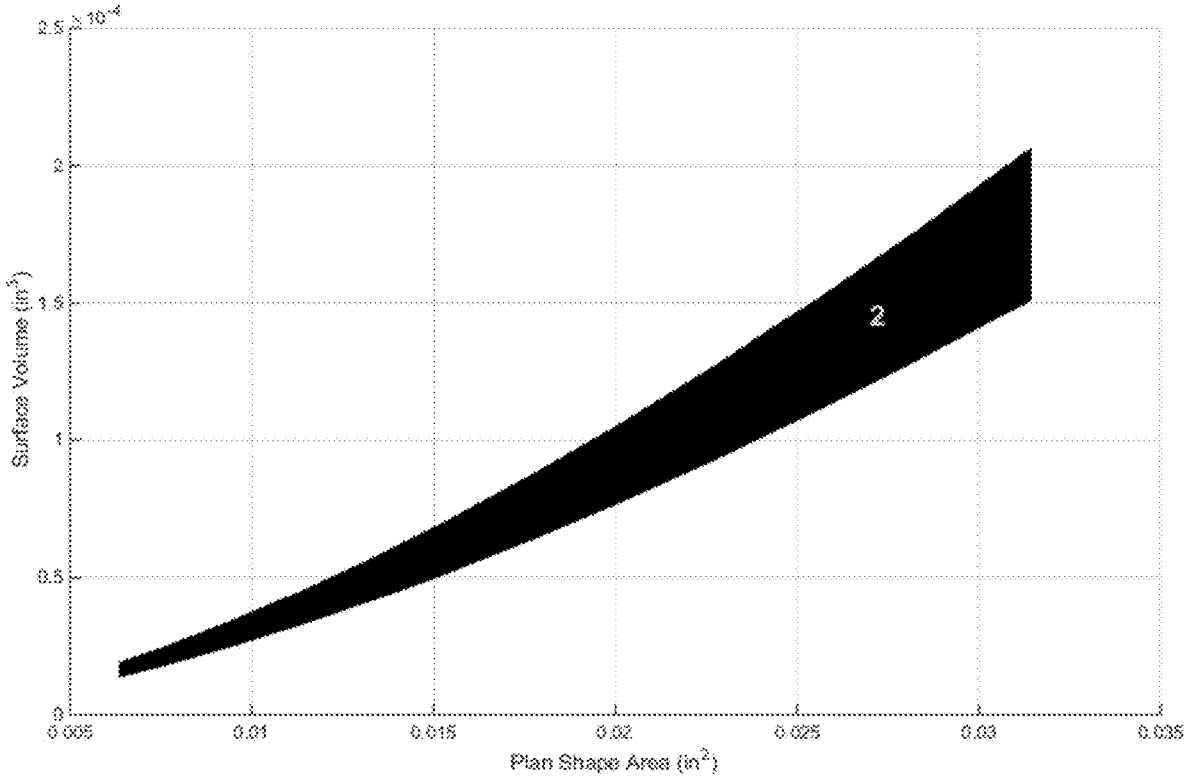
FIG. 16B is a graphical representation illustrating preferred dimple surface volumes for golf balls produced in accordance with the present invention.

Further, dimples of the present invention have a dimple surface volume. By the term, "dimple surface volume," it is meant the total volume encompassed by the dimple shape and the surface of the golf ball. FIGS. 16A and 16B illustrate graphical representations of dimple surface volumes contemplated for dimples produced in accordance with the present invention. For example, FIGS. 16A and 16B demonstrate contemplated dimple surface volumes over a range of plan shape areas. In one embodiment, dimples produced in accordance with the present invention have a plan shape area and dimple surface volume falling within the ranges shown in FIG. 16A. For example, a dimple having a plan shape area of about 0.01 $in^2$ may have a surface volume of about $0.20\times10^{-4}$ $in^3$ to about $0.50\times10^{-4}$ $in^3$. In another embodiment, a dimple having a plan shape area of about 0.025 $in^2$ may have a surface volume of about $0.80\times10^{-4}$ $in^3$ to about $1.75\times10^{-4}$ $in^3$. In another embodiment, a dimple having a plan shape area of about 0.030 $in^2$ may have a surface volume of about $1.20\times10^{-4}$ $in^3$ to about $2.40\times10^{-4}$ $in^3$. In another embodiment, a dimple having a plan shape area of about 0.045 $in^2$ may have a surface volume of about $2.10\times10^{-4}$ $in^3$ to about $4.25\times10^{-4}$ $in^3$. In another embodiment, dimples produced in accordance with the present invention have a plan shape area and dimple surface volume falling within the ranges shown in FIG. 16B. For example, a dimple having a plan shape area of about 0.01 $in^2$ may have a surface volume of about $0.25\times10^{-4}$ $in^3$ to about $0.35\times10^{-4}$ $in^3$. In another embodiment, a dimple having a plan shape area of about 0.025 $in^2$ may have a surface volume of about $1.10\times10^{-4}$ $in^3$ to about $1.45\times10^{-4}$ $in^3$. In another embodiment, a dimple having a plan shape area of about 0.030 $in^2$ may have a surface volume of about $1.40\times10^{-4}$ $in^3$ to about $1.90\times10^{-4}$ $in^3$.

Since, as discussed above, the dimple patterns useful in accordance with the present invention do not necessarily include only dimples having plan shapes as described above, other conventional dimples included in the dimple patterns may have similar dimensions.

Dimple Profile

In addition to varying the size of the dimples, the cross-sectional profile of the dimples may be varied. The cross-sectional profile of the dimples according to the present invention may be based on any known dimple profile shape. In one embodiment, the profile of the dimples corresponds to a curve. For example, the dimples of the present invention may be defined by the revolution of a catenary curve about an axis, such as that disclosed in U.S. Pat. Nos. 6,796,912 and 6,729,976, the entire disclosures of which are incorporated by reference herein. In another embodiment, the dimple profiles correspond to polynomial curves, ellipses, spherical curves, saucer-shapes, truncated cones, trigonometric, exponential, or logarithmic curves, and flattened trapezoids.

The profile of the dimple may also aid in the design of the aerodynamics of the golf ball. For example, shallow dimple depths, such as those in U.S. Pat. No. 5,566,943, the entire disclosure of which is incorporated by reference herein, may be used to obtain a golf ball with high lift and low drag coefficients. Conversely, a relatively deep dimple depth may aid in obtaining a golf ball with low lift and low drag coefficients.

The dimple profile may also be defined by combining a spherical curve and a different curve, such as a cosine curve, a frequency curve or a catenary curve, as disclosed in U.S. Patent Publication No. 2012/0165130, which is incorporated in its entirety by reference herein. Similarly, the dimple profile may be defined by a combination of two or more curves. For example, in one embodiment, the dimple profile is defined by combining a spherical curve and a different curve. In another embodiment, the dimple profile is defined by combining a cosine curve and a different curve. In still another embodiment, the dimple profile is defined by combining a frequency curve and a different curve. In yet another embodiment, the dimple profile is defined by combining a catenary curve and different curve. In still another embodiment, the dimple profile may be defined by combining three or more different curves. In yet another embodiment, one or more of the curves may be a functionally weighted curve, as disclosed in U.S. Patent Publication No. 2013/0172123, which is incorporated in its entirety by reference herein.

Dimple cross-sectional profiles have two edge angles ($\Phi_{EDGE}$), one at each of the two ends of the profile where the profile meets the dimple perimeter. As a result of having a plan shape defined by mapping a periodic function along a simple closed path, a dimple of the present invention has at least two cross-sectional profiles wherein at least one edge angle of one profile is different from at least one edge angle of another profile. Further, depending on the period p, a single cross-sectional profile of a dimple of the present invention may have an edge angle on one side of the cross-sectional profile that is different from the edge angle on the other side of the same cross-sectional profile. Thus, each dimple of the present invention comprises at least a first dimple profile having a first edge angle ($\Phi_{EDGE1}$) and a second edge angle ($\Phi_{EDGE2}$) and a second dimple profile having a third edge angle ($\Phi_{EDGE3}$) and a fourth edge angle ($\Phi_{EDGE4}$), wherein at least two of $\Phi_{EDGE1}$, $\Phi_{EDGE2}$, $\Phi_{EDGE3}$ and $\Phi_{EDGE4}$ have different values. Preferably, at least two of $\Phi_{EDGE1}$, $\Phi_{EDGE2}$, $\Phi_{EDGE3}$ and $\Phi_{EDGE4}$ have values that differ by 0.5° to 3.0°. In a particular embodiment, one of the following is true:

$\Phi_{EDGE1}=\Phi_{EDGE2}$, $\Phi_{EDGE3}=\Phi_{EDGE4}$, and $\Phi_{EDGE1}\neq\Phi_{EDGE3}$; a)

$\Phi_{EDGE1}\neq\Phi_{EDGE2}$, $\Phi_{EDGE3}=\Phi_{EDGE4}$, and $\Phi_{EDGE1}=\Phi_{EDGE3}$; b)

$\Phi_{EDGE1}\neq\Phi_{EDGE2}$, $\Phi_{EDGE3}=\Phi_{EDGE4}$, and $\Phi_{EDGE1}\neq\Phi_{EDGE3}$; c)

$\Phi_{EDGE1}\neq\Phi_{EDGE2}$, $\Phi_{EDGE3}\neq\Phi_{EDGE4}$, $\Phi_{EDGE1}=\Phi_{EDGE3}$, and $\Phi_{EDGE2}\neq\Phi_{EDGE4}$; or d)

$\Phi_{EDGE1}\neq\Phi_{EDGE2}$, $\Phi_{EDGE3}\neq\Phi_{EDGE4}$, $\Phi_{EDGE1}\neq\Phi_{EDGE3}$, and $\Phi_{EDGE2}\neq\Phi_{EDGE4}$. e)

Depending on the frequency and amplitude of the periodic function defining the dimple plan shape, a dimple of the present invention may include an infinite number of different edge angle values. For purposes of the present invention, edge angles are generally considered to be the same if they differ by less than 0.25°. It should be understood that manufacturing variances are to be taken into account when determining whether two differently located edge angles have the same value. The location of the edge angle along the dimple perimeter shape should also be taken into account. Preferably, the edge angles of a dimple of the present invention that do not have the same value differ by 0.5° to 3.0°, or differ by 0.3° to 3.0°.

In a particular embodiment, the average of the edge angles of all of the dimple profiles of a single dimple of the present invention is from 11° to 16°, or from 11° to 18°.

In another particular embodiment, the difference between the maximum edge angle and the average of the edge angles of all of the dimple profiles of a single dimple of the present invention is 1.50° or less.

In another particular embodiment, the difference between the minimum edge angle and the average of the edge angles of all of the dimple profiles of a single dimple of the present invention is 1.50° or less.

Figure 40:
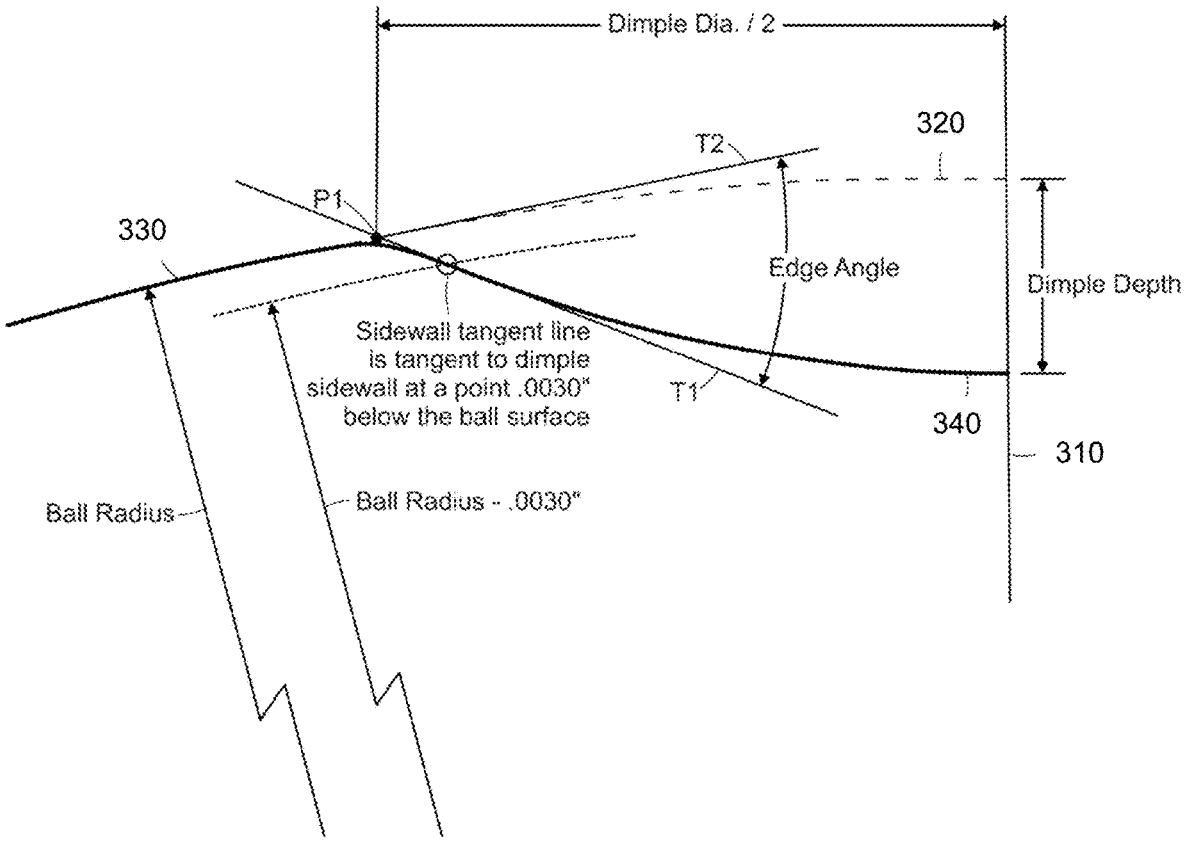
FIG. 40 is a schematic diagram illustrating a method for measuring the edge angle of a dimple

For purposes of the present disclosure, edge angle measurements are determined on finished golf balls. Generally, it may be difficult to measure an edge angle due to the indistinct nature of the boundary dividing the dimple from the ball's undisturbed land surface. Due to the effect of coatings on the golf ball surface and/or the dimple design itself, the junction between the land surface and the dimple is typically not a sharp corner and is therefore indistinct. This can make the measurement of properties such as edge angle ($\Phi_{EDGE}$) and dimple diameter, somewhat ambiguous. To resolve this problem, edge angle ($\Phi_{EDGE}$) on a finished golf ball is measured as follows, in reference to FIG. 40. FIG. 40 shows a dimple half-profile extending from the dimple centerline 310 to the ball's undisturbed land surface 330. A ball phantom surface 320 is constructed above the dimple as a continuation of the land surface 330. A first tangent line T1 is then constructed at a point on the dimple sidewall that is spaced 0.003 inches radially inward from the phantom surface 320. T1 intersects phantom surface 320 at a point P1, which defines a nominal dimple edge position. A second tangent line T2 is then constructed, tangent to the phantom surface 320, at P1. The edge angle ($\Phi_{EDGE}$) is the angle between T1 and T2. The dimple diameter is the distance between P1 and its equivalent point at the opposite end of the dimple profile. The dimple depth is the distance measured along a ball radius from the phantom surface of the ball to the deepest point on the dimple. The dimple surface volume is the space enclosed between the phantom surface 320 and the dimple surface 340 (extended along T1 until it intersects the phantom surface).

Golf Ball Construction

The dimples of the present invention may be used with practically any type of ball construction. For instance, the golf ball may have a two-piece design, a double cover, or veneer cover construction depending on the type of performance desired of the ball. Other suitable golf ball constructions include solid, wound, liquid-filled, and/or dual cores, and multiple intermediate layers.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

EXAMPLES

The following non-limiting examples demonstrate plan shapes of golf ball dimples made in accordance with the present invention. The examples are merely illustrative of the preferred embodiments of the present invention, and are not to be construed as limiting the invention, the scope of which is defined by the appended claims.

Example 1

The following example illustrates golf ball dimple plan shapes defined by a low frequency cosine periodic function mapped to a circular path. Table 2, depicted below, describes the mathematical parameters used to project the periodic function onto the simple closed path.

TABLE 2

| PLAN SHAPE PARAMETERS OF EXAMPLE 1 | |
|---|---|
| Path | Circular |
| Periodic Function | Cosine |

TABLE 2-continued

| PLAN SHAPE PARAMETERS OF EXAMPLE 1 | |
|---|---|
| Function (f(x)) | $f(x) = s + a * \cos(\pi px)$ |
| Sharpness Factor, s | about 15 |
| Amplitude, a | about 1 |

Figure 7A:
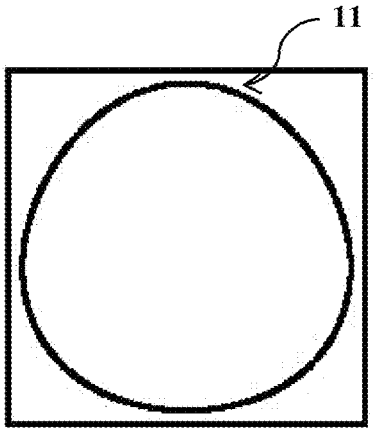
FIGS. 7A-7F illustrate various embodiments of a golf ball dimple plan shape defined by a cosine periodic function along a circular path.
Figure 7B:
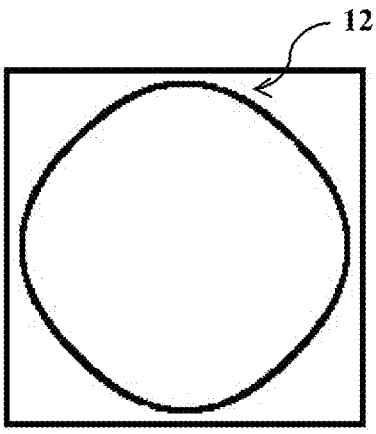
Figure 7C:
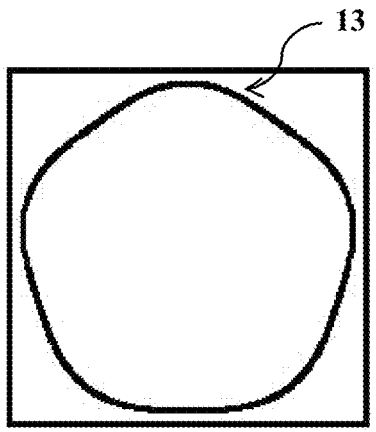
Figure 7D:
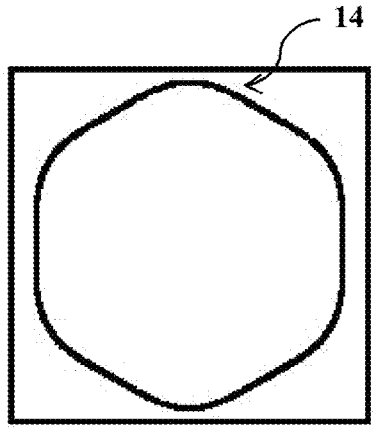
Figure 7E:
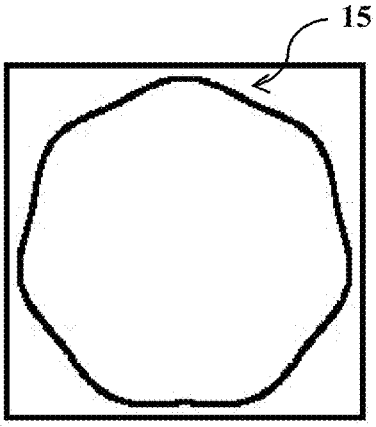
Figure 7F:
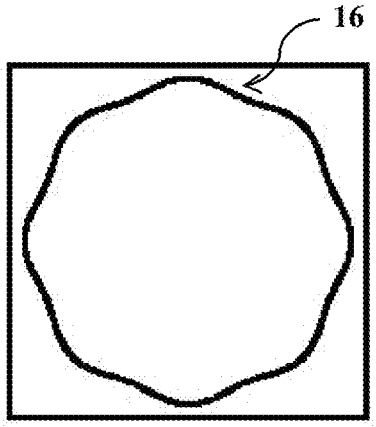

FIGS. 7A-7F demonstrate the golf ball dimple plan shapes produced in accordance with the parameters of Table 2. In particular, FIG. 7A shows a dimple plan shape 11 defined by a cosine periodic function having period, p=3, mapped to a circular path. FIG. 7B shows a dimple plan shape 12 defined by a cosine periodic function having period, p=4, mapped to a circular path. FIG. 7C shows a dimple plan shape 13 defined by a cosine periodic function having period, p=5, mapped to a circular path. FIG. 7D shows a dimple plan shape 14 defined by a cosine periodic function having period, p=6, mapped to a circular path. FIG. 7E shows a dimple plan shape 15 defined by a cosine periodic function having period, p=7, mapped to a circular path. FIG. 7F shows a dimple plan shape 16 defined by a cosine periodic function having period, p=8, mapped to a circular path.

Example 2

The following example illustrates golf ball dimple plan shapes defined by a low frequency sawtooth wave periodic function mapped to a circular path. The non-uniform sawtooth wave function is approximated by a four-term Fourier series. Table 3, depicted below, describes the mathematical parameters used to project the periodic function onto the simple closed path.

TABLE 3

| PLAN SHAPE PARAMETERS OF EXAMPLE 2 | |
|---|---|
| Path | Circular |
| Periodic Function | Sawtooth Wave (4-term Fourier expansion) |
| Function (f(x)) | $f(x) = s + a/\pi * (\sin(\pi px) + \sin(2\pi px)/2 + \sin(3\pi px)/3 + \sin(4\pi px)/4)$ |
| Sharpness Factor, s | about 15 |
| Amplitude, a | about 0.5 |

Figure 8A:
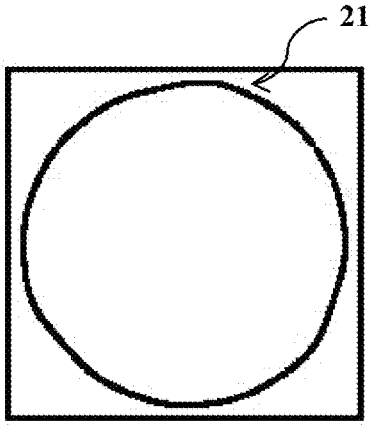
FIGS. 8A-8F illustrate various embodiments of a golf ball dimple plan shape defined by a sawtooth wave periodic function along a circular path.
Figure 8B:
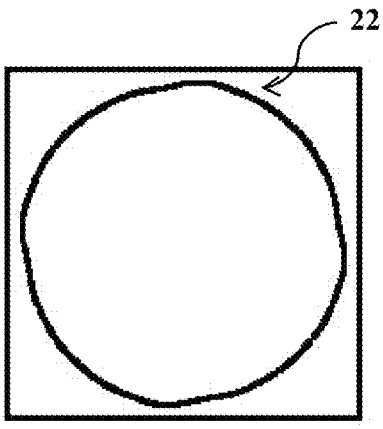
Figure 8C:
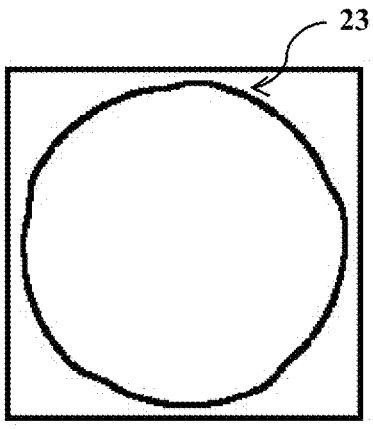
Figure 8D:
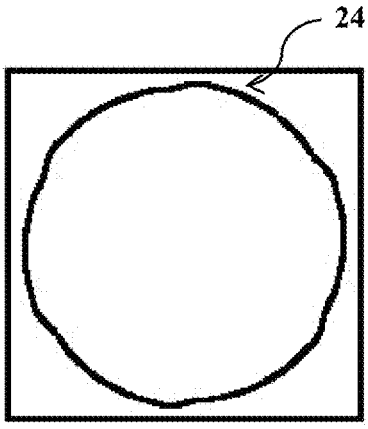
Figure 8E:
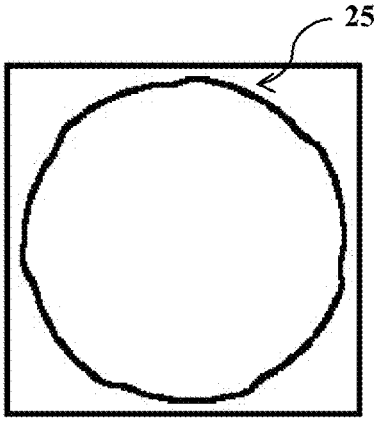
Figure 8F:
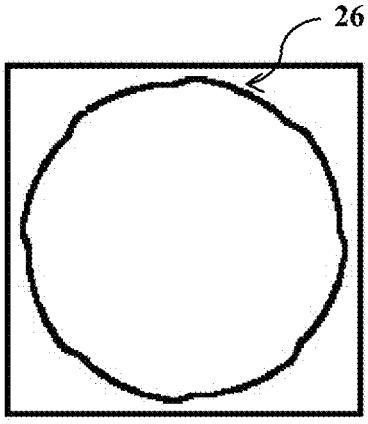

FIGS. 8A-8F demonstrate the golf ball dimple plan shapes produced in accordance with the parameters of Table 3. In particular, FIG. 8A shows a dimple plan shape 21 defined by a sawtooth wave function approximated by a four-term Fourier series having period, p=3, mapped to a circular path. FIG. 8B shows a dimple plan shape 22 defined by a sawtooth wave function approximated by a four-term Fourier series having period, p=4, mapped to a circular path. FIG. 8C shows a dimple plan shape 23 defined by a sawtooth wave function approximated by a four-term Fourier series having period, p=5, mapped to a circular path. FIG. 8D shows a dimple plan shape 24 defined by a sawtooth wave function approximated by a four-term Fourier series having period, p=6, mapped to a circular path. FIG. 8E shows a dimple plan shape 25 defined by a sawtooth wave function approximated by a four-term Fourier series having period, p=7, mapped to a circular path. FIG. 8F shows a dimple plan shape 26 defined by a sawtooth wave function approximated by a four-term Fourier series having period, p=8, mapped to a circular path.

Example 3

The following example illustrates golf ball dimple plan shapes defined by a low frequency triangle wave periodic function mapped to a circular path. The non-uniform triangle wave function is approximated by a four-term Fourier series. Table 4, depicted below, describes the mathematical parameters used to project the periodic function onto the simple closed path.

TABLE 4

| PLAN SHAPE PARAMETERS OF EXAMPLE 3 | |
|---|---|
| Path | Circular |
| Periodic Function | Triangle Wave (4-term Fourier expansion) |
| Function (f(x)) | $f(x) = s + 8a/\pi^2 * (\sin(\pi px) - \sin(3\pi px)/9 + \sin(5\pi px)/25 - \sin(7\pi px)/49)$ |
| Sharpness Factor, s | about 15 |
| Amplitude, a | about 0.4 |

Figure 9A:
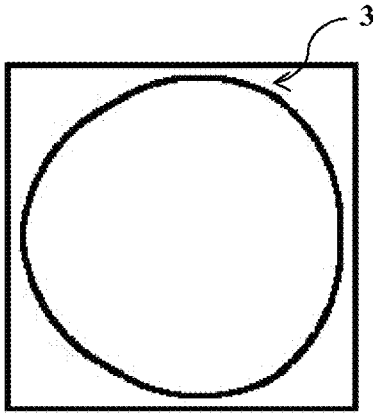
FIGS. 9A-9F illustrate various embodiments of a golf ball dimple plan shape defined by a triangle wave periodic function along a circular path.
Figure 9B:
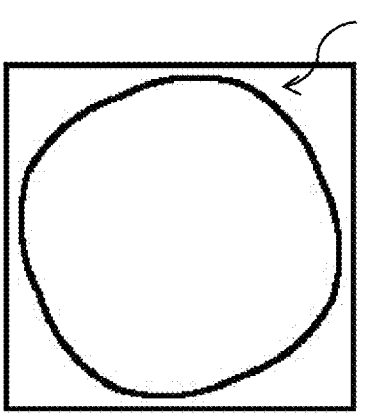
Figure 9C:
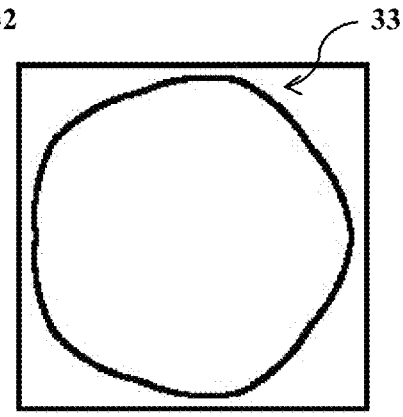
Figure 9D:
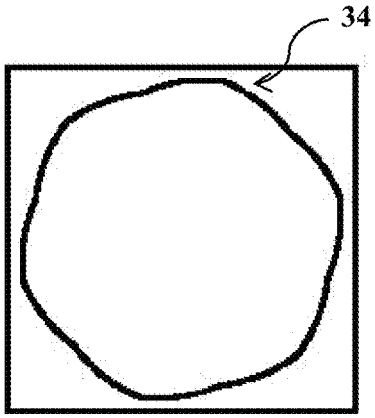
Figure 9E:
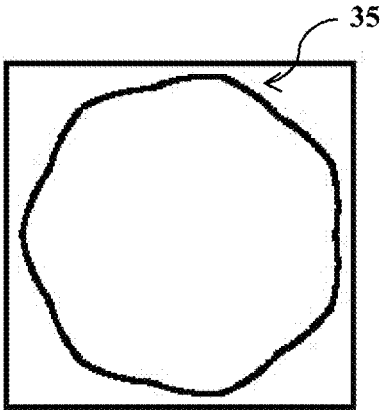
Figure 9F:
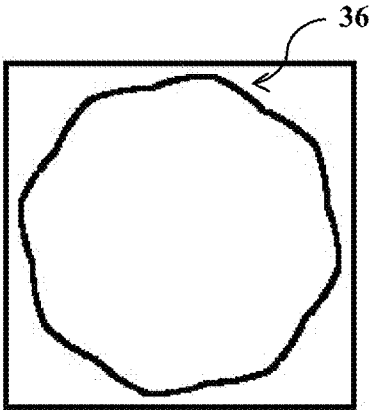

FIGS. 9A-9F demonstrate the golf ball dimple plan shapes produced in accordance with the parameters of Table 4. In particular, FIG. 9A shows a dimple plan shape 31 defined by a triangle wave function approximated by a four-term Fourier series having period, p=3, mapped to a circular path. FIG. 9B shows a dimple plan shape 32 defined by a triangle wave function approximated by a four-term Fourier series having period, p=4, mapped to a circular path. FIG. 9C shows a dimple plan shape 33 defined by a triangle wave function approximated by a four-term Fourier series having period, p=5, mapped to a circular path. FIG. 9D shows a dimple plan shape 34 defined by a triangle wave function approximated by a four-term Fourier series having period, p=6, mapped to a circular path. FIG. 9E shows a dimple plan shape 35 defined by a triangle wave function approximated by a four-term Fourier series having period, p=7, mapped to a circular path. FIG. 9F shows a dimple plan shape 36 defined by a triangle wave function approximated by a four-term Fourier series having period, p=8, mapped to a circular path.

Example 4

The following example illustrates golf ball dimple plan shapes defined by a low frequency square wave periodic function mapped to a circular path. The non-uniform square wave function is approximated by a four-term Fourier series. Table 5, depicted below, describes the mathematical parameters used to project the periodic function onto the simple closed path.

TABLE 5

| PLAN SHAPE PARAMETERS OF EXAMPLE 4 | |
|---|---|
| Path | Circular |
| Periodic Function | Square Wave (4-term Fourier expansion) |
| Function (f(x)) | $f(x) = s + 4a/\pi * (\sin(\pi px) + \sin(3\pi px)/3 + \sin(5\pi px)/5 + \sin(7\pi px)/7)$ |
| Sharpness Factor, s | about 15 |
| Amplitude, a | about 0.2 |

Figure 10A:
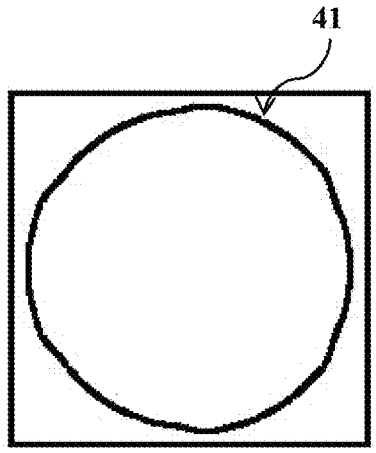
FIGS. 10A-10F illustrate various embodiments of a golf ball dimple plan shape defined by a square wave periodic function along a circular path.
Figure 10B:
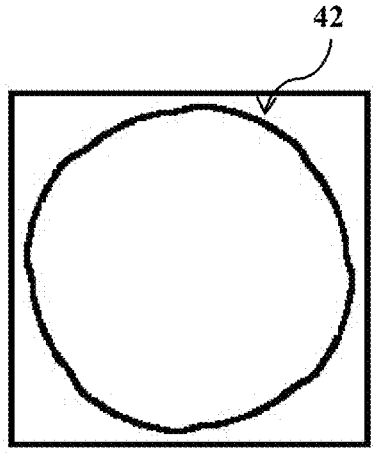
Figure 10C:
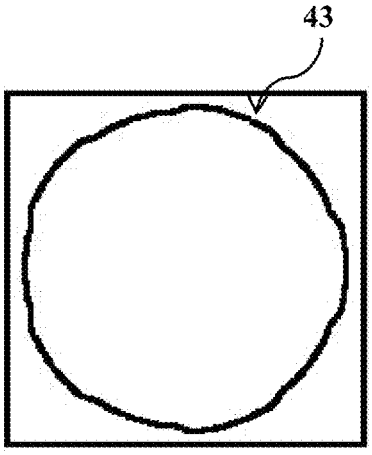
Figure 10D:
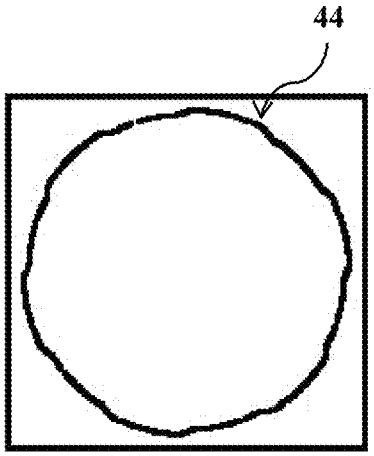
Figure 10E:
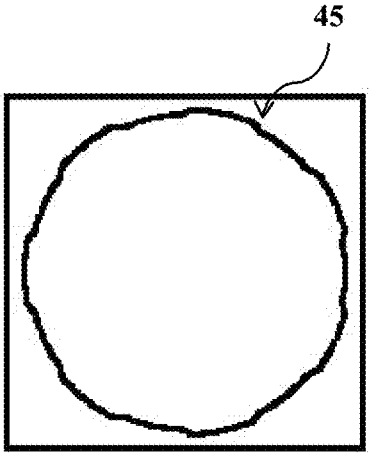
Figure 10F:
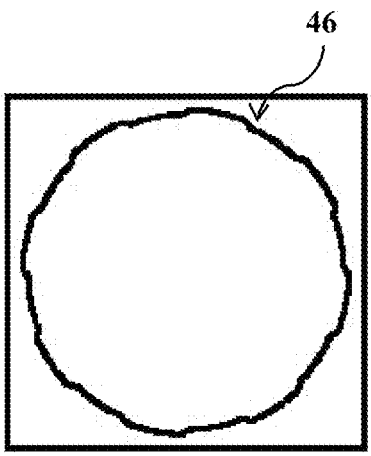

FIGS. 10A-10F demonstrate the golf ball dimple plan shapes produced in accordance with the parameters of Table 5. In particular, FIG. 10A shows a dimple plan shape 41 defined by a square wave function approximated by a four-term Fourier series having period, p=3, mapped to a circular path. FIG. 10B shows a dimple plan shape 42 defined by a square wave function approximated by a four-term Fourier series having period, p=4, mapped to a circular path. FIG. 10C shows a dimple plan shape 43 defined by a square wave function approximated by a four-term Fourier series having period, p=5, mapped to a circular path. FIG. 10D shows a dimple plan shape 44 defined by a square wave function approximated by a four-term Fourier series having period, p=6, mapped to a circular path. FIG. 10E shows a dimple plan shape 45 defined by a square wave function approximated by a four-term Fourier series having period, p=7, mapped to a circular path. FIG. 10F shows a dimple plan shape 46 defined by a square wave function approximated by a four-term Fourier series having period, p=8, mapped to a circular path.

Example 5

The following example illustrates golf ball dimple plan shapes defined by a low frequency square wave periodic function mapped to an elliptical path. The non-uniform square wave function is approximated by a four-term Fourier series. Table 6, depicted below, describes the mathematical parameters used to project the periodic function onto the simple closed path.

TABLE 6

PLAN SHAPE PARAMETERS OF EXAMPLE 5

| | |
|---|---|
| Path | Elliptical |
| Periodic Function | Square Wave (4-term Fourier expansion) |
| Function (f(x)) | $f(x) = s + 4a/\pi * (\sin(\pi px) + \sin(3\pi px)/3 + \sin(5\pi px)/5 + \sin(7\pi px)/7)$ |
| Sharpness Factor, s | about 15 |
| Amplitude, a | about 0.2 |

Figure 11A:
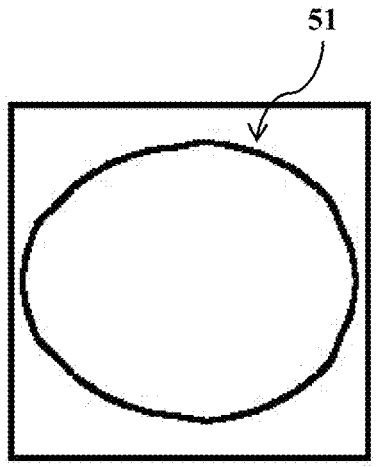
FIGS. 11A-11F illustrate various embodiments of a golf ball dimple plan shape defined by a square wave periodic function along an elliptical path.
Figure 11B:
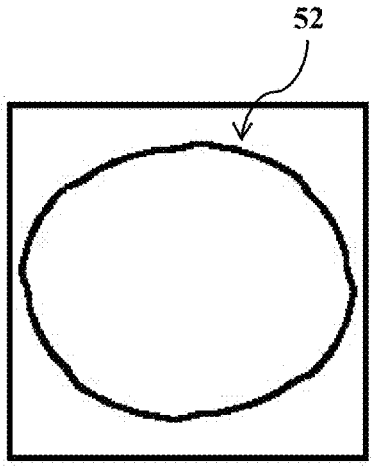
Figure 11C:
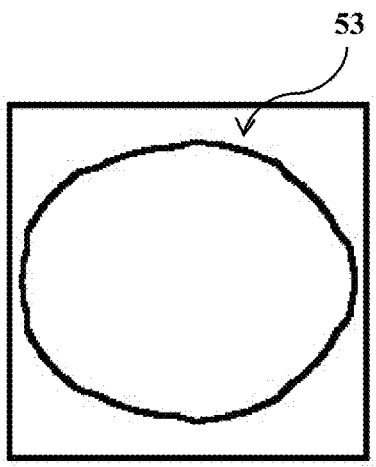
Figure 11D:
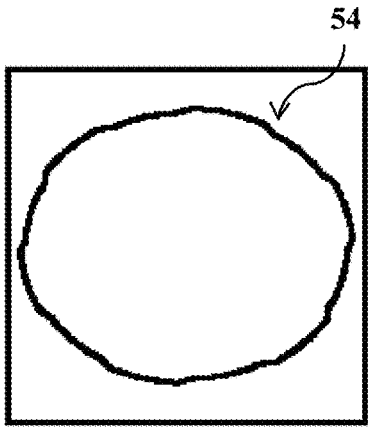
Figure 11E:
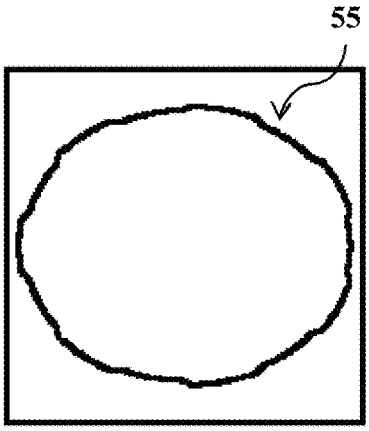
Figure 11F:
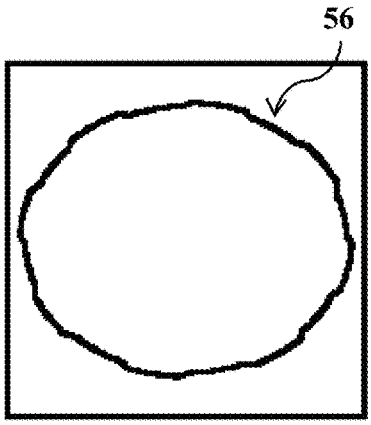

FIGS. 11A-11F demonstrate the golf ball dimple plan shapes produced in accordance with the parameters of Table 6. In particular, FIG. 11A shows a dimple plan shape 51 defined by a square wave function approximated by a four-term Fourier series having period, p=3, mapped to an elliptical path. FIG. 11B shows a dimple plan shape 52 defined by a square wave function approximated by a four-term Fourier series having period, p=4, mapped to an elliptical path. FIG. 11C shows a dimple plan shape 53 defined by a square wave function approximated by a four-term Fourier series having period, p=5, mapped to an elliptical path. FIG. 11D shows a dimple plan shape 54 defined by a square wave function approximated by a four-term Fourier series having period, p=6, mapped to an elliptical path. FIG. 11E shows a dimple plan shape 55 defined by a square wave function approximated by a four-term Fourier series having period, p=7, mapped to an elliptical path. FIG. 11F shows a dimple plan shape 56 defined by a square wave function approximated by a four-term Fourier series having period, p=8, mapped to an elliptical path.

Example 6

The following example illustrates golf ball dimple plan shapes defined by a low frequency square wave periodic function mapped to a square path. The non-uniform square wave function is approximated by a four-term Fourier series. Table 7, depicted below, describes the mathematical parameters used to project the periodic function onto the simple closed path.

TABLE 7

PLAN SHAPE PARAMETERS OF EXAMPLE 6

| | |
|---|---|
| Path | Square |
| Periodic Function | Square Wave (4-term Fourier expansion) |
| Function (f(x)) | $f(x) = s + 4a/\pi * (\sin(\pi px) + \sin(3\pi px)/3 + \sin(5\pi px)/5 + \sin(7\pi px)/7)$ |
| Sharpness Factor, s | about 55 |
| Amplitude, a | about 1 |

Figure 12A:
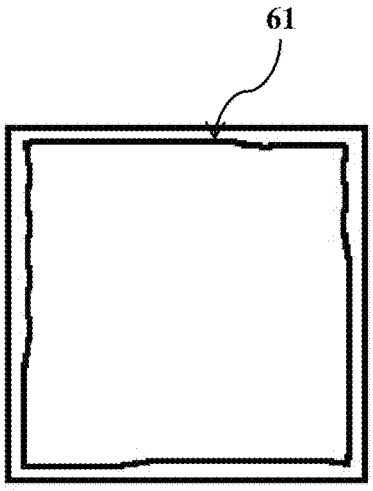
FIGS. 12A-12F illustrate various embodiments of a golf ball dimple plan shape defined by a square wave periodic function along a square path.
Figure 12B:
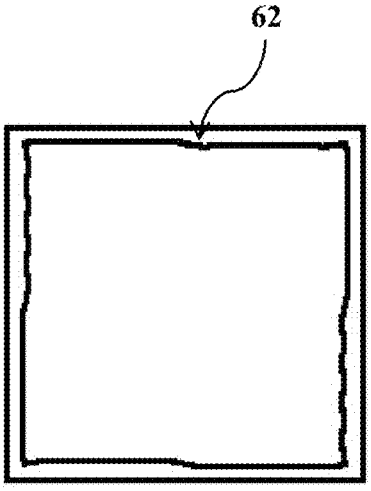
Figure 12C:
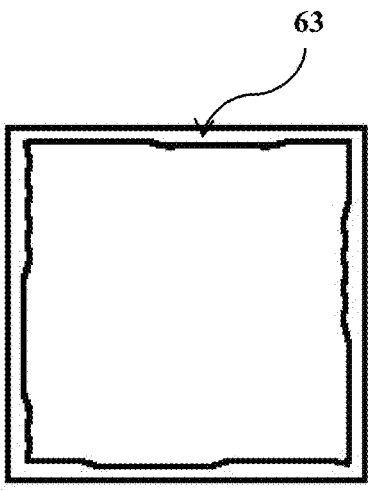
Figure 12D:
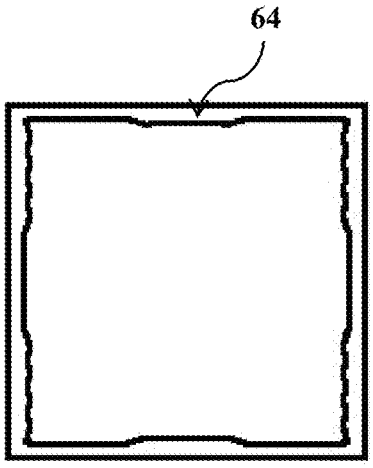
Figure 12E:
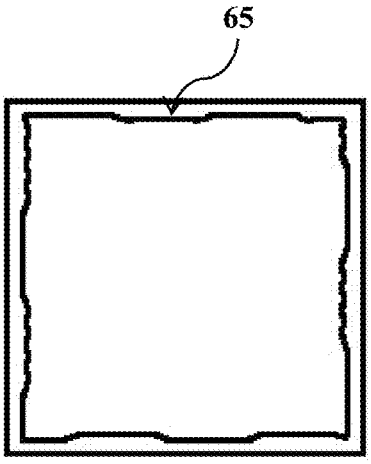
Figure 12F:
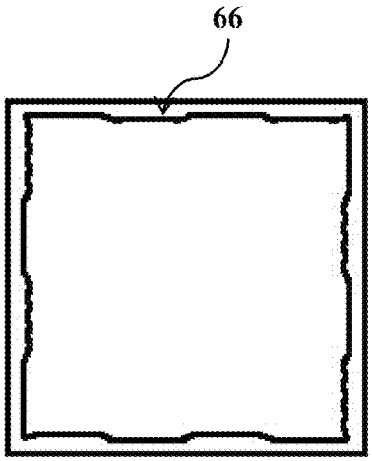

FIGS. 12A-12F demonstrate the golf ball dimple plan shapes produced in accordance with the parameters of Table 7. In particular, FIG. 12A shows a dimple plan shape 61 defined by a square wave function approximated by a four-term Fourier series having period, p=3, mapped to a square path. FIG. 12B shows a dimple plan shape 62 defined by a square wave function approximated by a four-term Fourier series having period, p=4, mapped to a square path. FIG. 12C shows a dimple plan shape 63 defined by a square wave function approximated by a four-term Fourier series having period, p=5, mapped to a square path. FIG. 12D shows a dimple plan shape 64 defined by a square wave function approximated by a four-term Fourier series having period, p=6, mapped to a square path. FIG. 12E shows a dimple plan shape 65 defined by a square wave function approximated by a four-term Fourier series having period, p=7, mapped to a square path. FIG. 12F shows a dimple plan shape 66 defined by a square wave function approximated by a four-term Fourier series having period, p=8, mapped to a square path.

Example 7

The following example illustrates golf ball dimple plan shapes defined by a low frequency arbitrary periodic function mapped to a circular path. The arbitrary periodic function is created using a linear combination of sines and cosines. Table 8, depicted below, describes the mathematical parameters used to project the periodic function onto the simple closed path.

TABLE 8

PLAN SHAPE PARAMETERS OF EXAMPLE 7

| | |
|---|---|
| Path | Circular |
| Periodic Function | Arbitrary |
| Function (f(x)) | $f(x) = s + a * (\cos(\pi px)^3 * \sin(3\pi px) + \sin(7\pi px)/7)$ |
| Sharpness Factor, s | about 20 |
| Amplitude, a | about 0.8 |

Figure 13A:
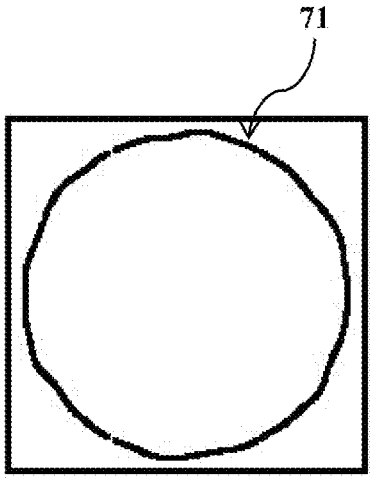
FIGS. 13A-13F illustrate various embodiments of a golf ball dimple plan shape defined by an arbitrary periodic function along a circular path.
Figure 13B:
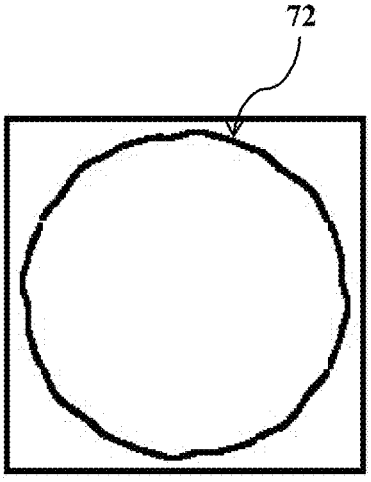
Figure 13C:
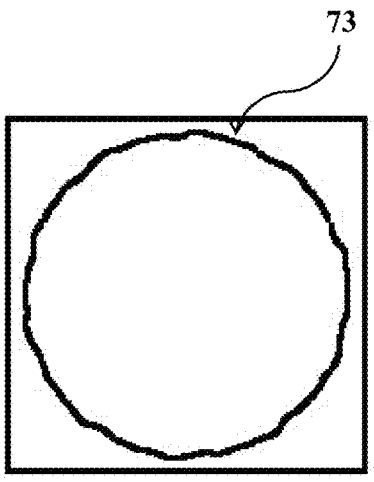
Figure 13D:
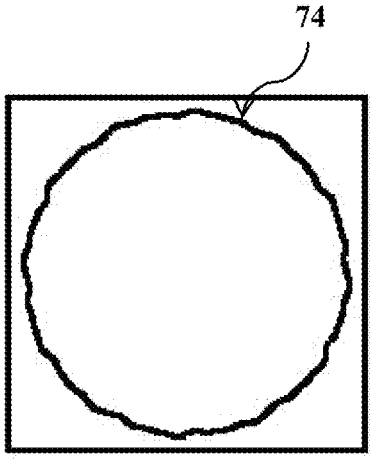
Figure 13E:
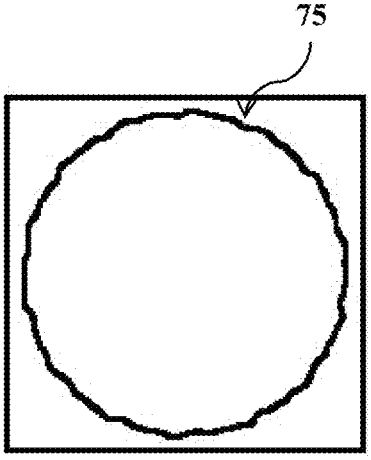
Figure 13F:
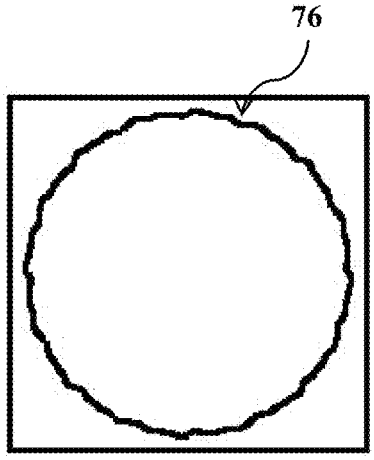

FIGS. 13A-13F demonstrate the golf ball dimple plan shapes produced in accordance with the parameters of Table 8. In particular, FIG. 13A shows a dimple plan shape 71 defined by an arbitrary periodic function having period, p=3, mapped to a circular path. FIG. 13B shows a dimple plan shape 72 defined by an arbitrary periodic function having period, p=4, mapped to a circular path. FIG. 13C shows a dimple plan shape 73 defined by an arbitrary periodic function having period, p=5, mapped to a circular path. FIG. 13D shows a dimple plan shape 74 defined by an arbitrary periodic function having period, p=6, mapped to a circular path. FIG. 13E shows a dimple plan shape 75 defined by an arbitrary periodic function having period, p=7, mapped to a circular path. FIG. 13F shows a dimple plan shape 76 defined by an arbitrary periodic function having period, p=8, mapped to a circular path.

Example 8

The following example illustrates golf ball dimple plan shapes defined by a low frequency arbitrary periodic function mapped to an arbitrary path. The arbitrary periodic function is created using a linear combination of sines and cosines. Table 9, depicted below, describes the mathematical parameters used to project the periodic function onto the simple closed path.

TABLE 9

| PLAN SHAPE PARAMETERS OF EXAMPLE 8 | |
|---|---|
| Path | Arbitrary |
| Periodic Function | Arbitrary |
| Function (f(x)) | $f(x) = s + a * (\cos(\pi px)^3 * \sin(3\pi px) + \sin(7\pi px)/7)$ |
| Sharpness Factor, s | about 20 |
| Amplitude, a | about 0.8 |

Figure 14A:
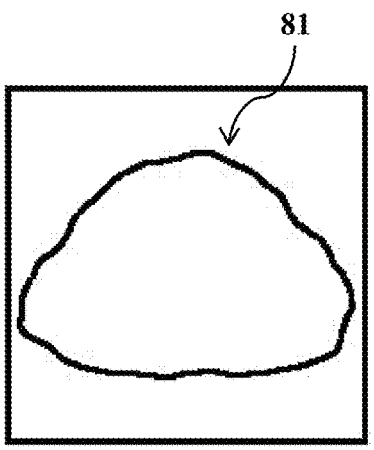
FIGS. 14A-14F illustrate various embodiments of a golf ball dimple plan shape defined by an arbitrary periodic function along an arbitrary path.
Figure 14B:
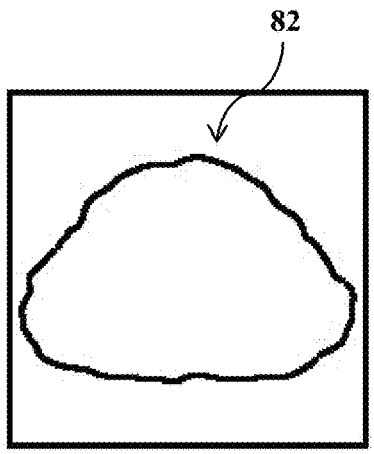
Figure 14C:
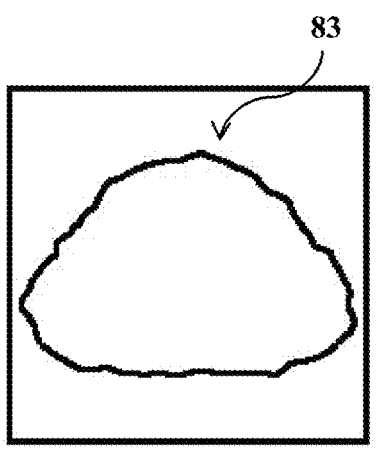
Figure 14D:
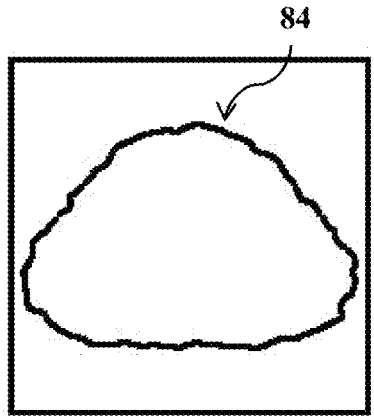
Figure 14E:
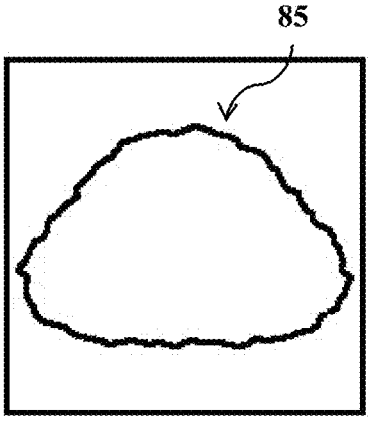
Figure 14F:
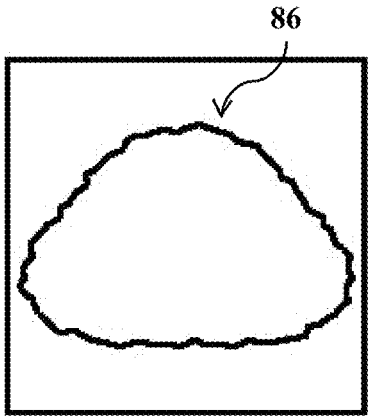

FIGS. 14A-14F demonstrate the golf ball dimple plan shapes produced in accordance with the parameters of Table 9. In particular, FIG. 14A shows a dimple plan shape 81 defined by an arbitrary periodic function having period, p=3, mapped to an arbitrary path. FIG. 14B shows a dimple plan shape 82 defined by an arbitrary periodic function having period, p=4, mapped to an arbitrary path. FIG. 14C shows a dimple plan shape 83 defined by an arbitrary periodic function having period, p=5, mapped to an arbitrary path. FIG. 14D shows a dimple plan shape 84 defined by an arbitrary periodic function having period, p=6, mapped to an arbitrary path. FIG. 14E shows a dimple plan shape 85 defined by an arbitrary periodic function having period, p=7, mapped to an arbitrary path. FIG. 14F shows a dimple plan shape 86 defined by an arbitrary periodic function having period, p=8, mapped to an arbitrary path.

Example 9

The following example illustrates golf ball dimple plan shapes defined by a low frequency periodic square wave function mapped to a circular path. The square wave function is approximated by a two-term Fourier series. Table 10 below describes the mathematical parameters used to project the periodic square wave function onto the simple closed path.

TABLE 10

| PLAN SHAPE PARAMETERS OF EXAMPLE 9 | |
|---|---|
| Path | Circular |
| Periodic Function | Square Wave (2-term Fourier expansion) |
| Function (f(x)) | $f(x) = s + a/\pi * (\sin(\pi px) + \sin(3\pi px)/3)$ |
| Sharpness Factor, s | 25 |
| Amplitude, a | 1 |
| Period | 2 |

Figure 20:
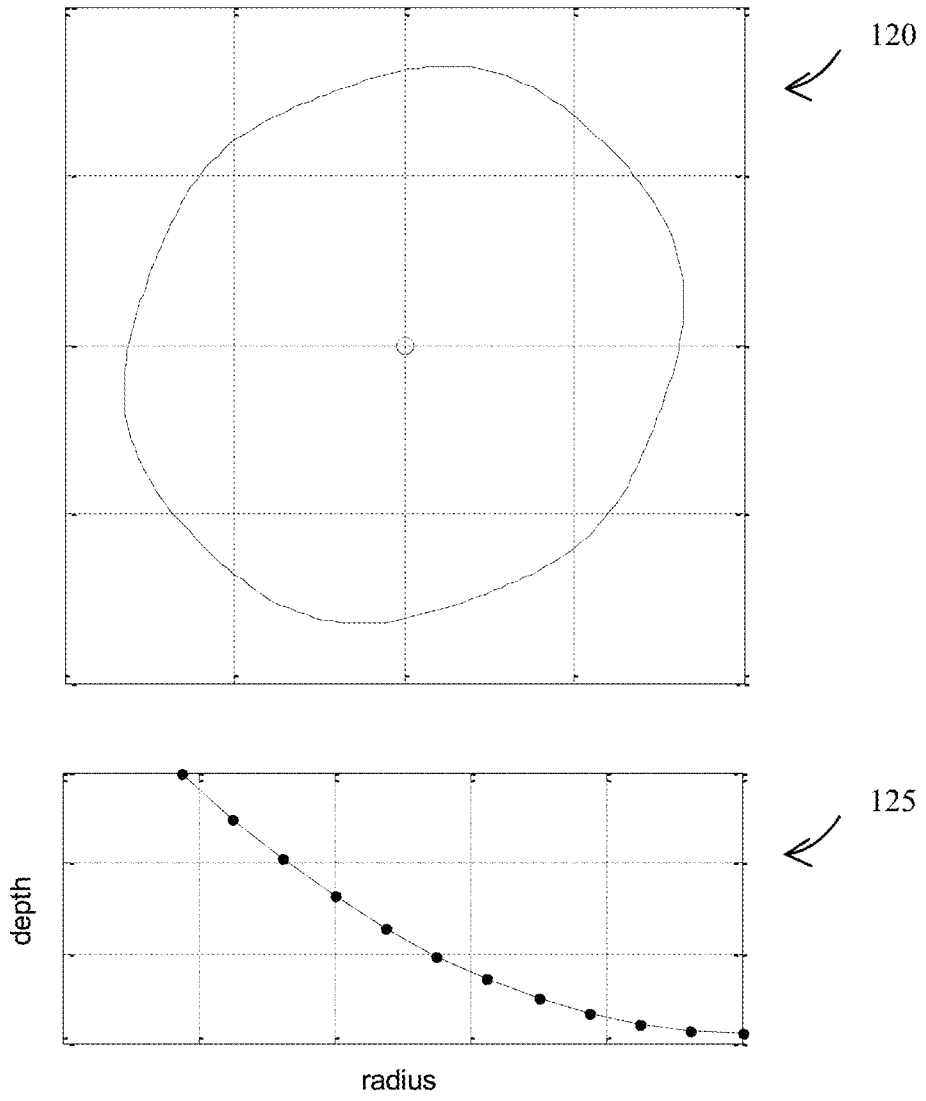
FIG. 20 illustrates a golf ball dimple plan shape defined by a periodic square wave function mapped along a circular path in accordance with an embodiment of the present invention and a golf ball dimple profile shape defined by a parabolic function.
Figure 21:
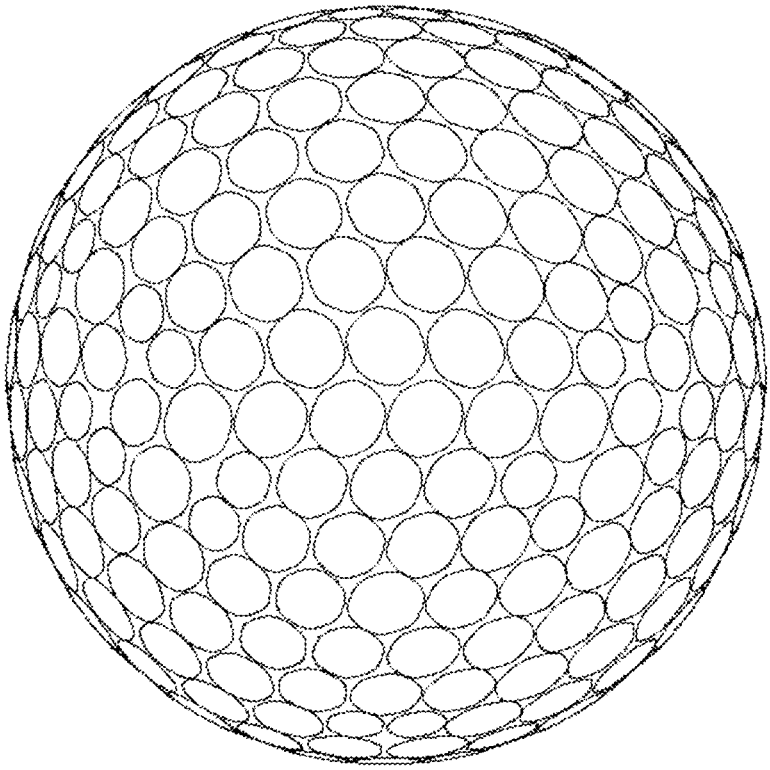
FIG. 21 illustrates a golf ball pattern having a plurality of dimple plan shapes produced in accordance with an embodiment of the present invention.

FIG. 20 illustrates a golf ball dimple plan shape 120 produced in accordance with the parameters of Table 10. FIG. 20 also illustrates a dimple profile shape 125 defined by the parabolic function $f(x)=x^2$. FIG. 21 illustrates a golf ball pattern utilizing the dimple plan shape and profile shape of FIG. 20.

Example 10

The following example illustrates golf ball dimple plan shapes defined by a low frequency periodic square wave function mapped to a circular path. The square wave function is approximated by a two-term Fourier series. Table 11 below describes the mathematical parameters used to project the periodic square wave function onto the simple closed path.

TABLE 11

| PLAN SHAPE PARAMETERS OF EXAMPLE 10 | |
|---|---|
| Path | Circular |
| Periodic Function | Square Wave (2-term Fourier expansion) |

TABLE 11-continued

| PLAN SHAPE PARAMETERS OF EXAMPLE 10 | |
|---|---|
| Function (f(x)) | $f(x) = s + a/\pi * (\sin(\pi px) + \sin(3\pi px)/3)$ |
| Sharpness Factor, s | 40 |
| Amplitude, a | 1 |
| Period | 4 |

Figure 22:
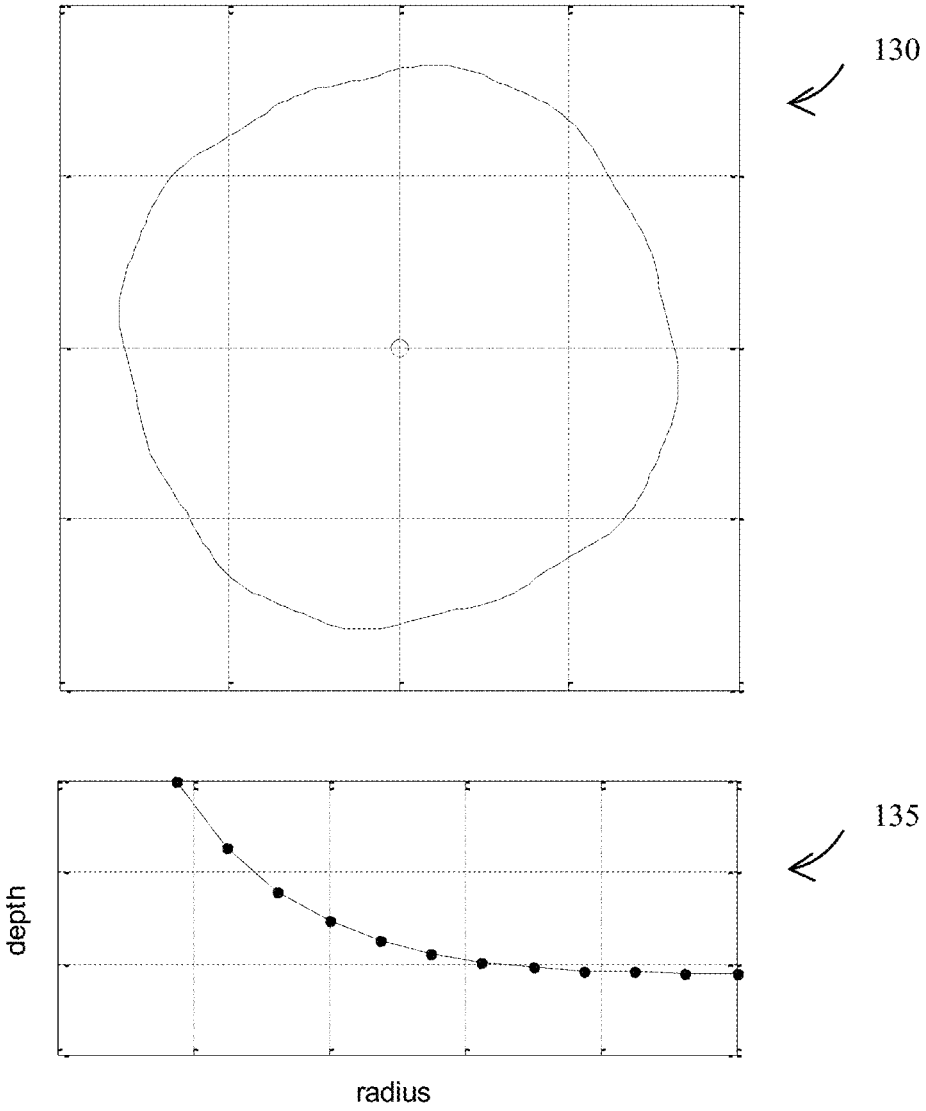
FIG. 22 illustrates a golf ball dimple plan shape defined by a periodic square wave function mapped along a circular path in accordance with an embodiment of the present invention and a golf ball dimple profile shape defined by an exponential function.
Figure 23:
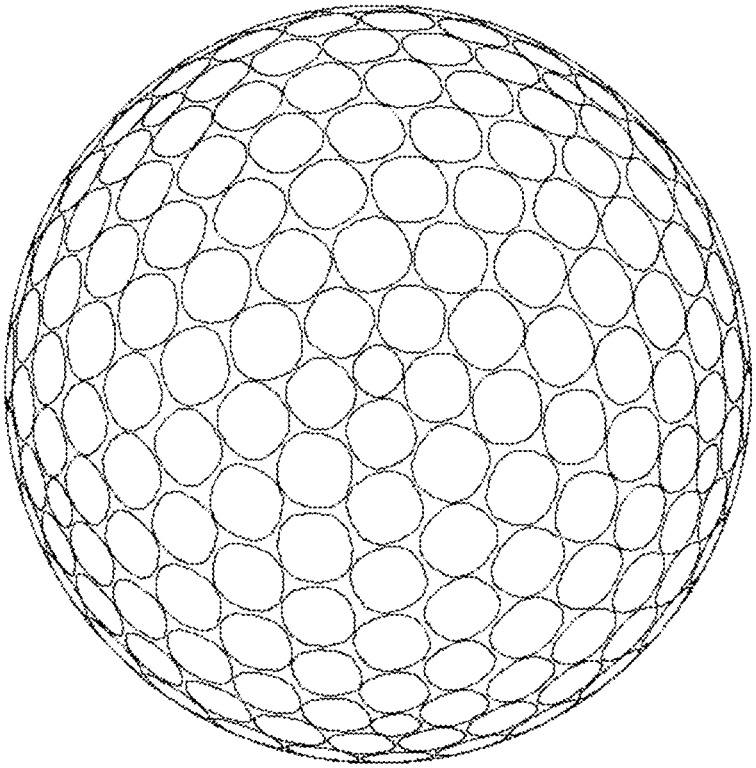
FIG. 23 illustrates a golf ball pattern having a plurality of dimple plan shapes produced in accordance with an embodiment of the present invention.

FIG. 22 illustrates a golf ball dimple plan shape 130 produced in accordance with the parameters of Table 11. FIG. 22 also illustrates a dimple profile shape 135 defined by the exponential function $f(x)=\exp(x^3)$. FIG. 23 illustrates a golf ball pattern utilizing the dimple plan shape and profile shape of FIG. 22.

Example 11

The following example illustrates golf ball dimple plan shapes defined by a low frequency periodic square wave function mapped to a circular path. The square wave function is approximated by a two-term Fourier series. Table 12 below describes the mathematical parameters used to project the periodic square wave function onto the simple closed path.

TABLE 12

| PLAN SHAPE PARAMETERS OF EXAMPLE 11 | |
|---|---|
| Path | Circular |
| Periodic Function | Square Wave (2-term Fourier expansion) |
| Function (f(x)) | $f(x) = s + a/\pi * (\sin(\pi px) + \sin(3\pi px)/3)$ |
| Sharpness Factor, s | 45 |
| Amplitude, a | 0.9 |
| Period | 5 |

Figure 24:
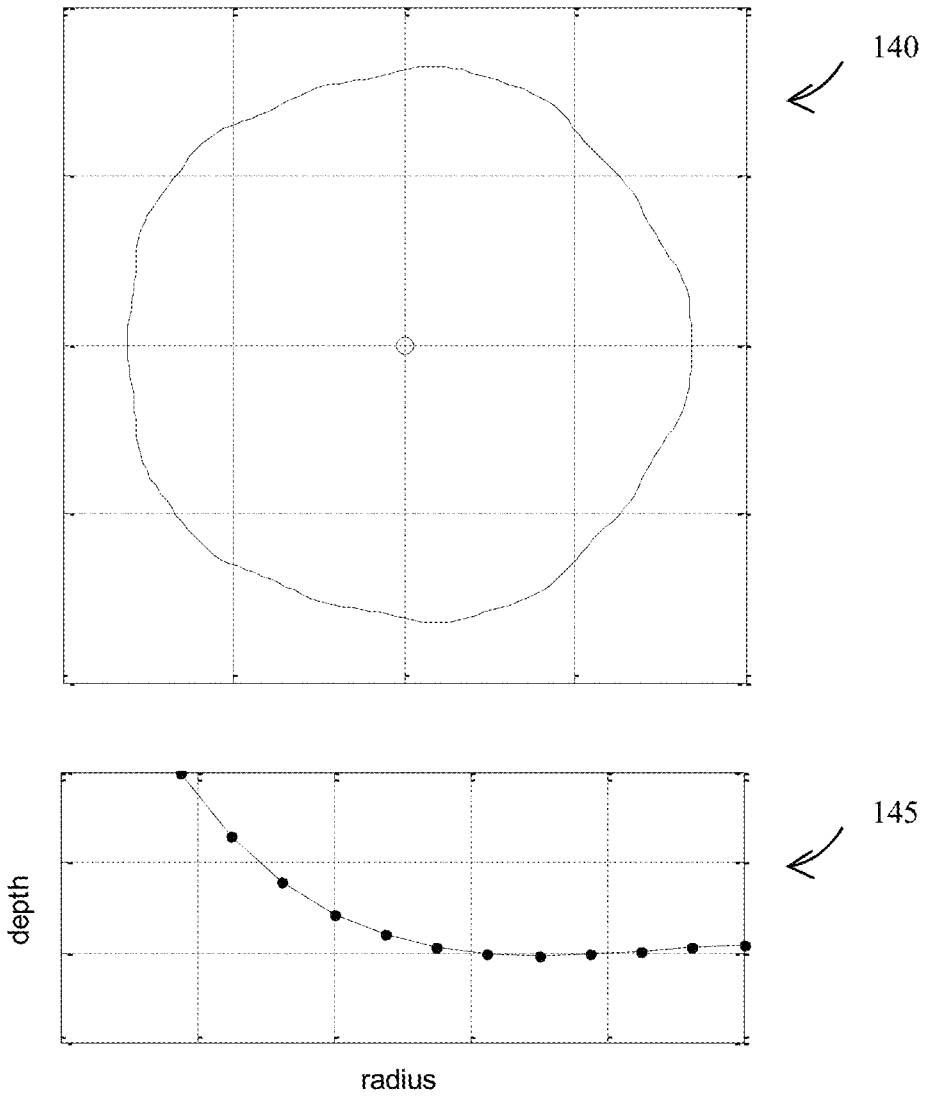
FIG. 24 illustrates a golf ball dimple plan shape defined by a periodic square wave function mapped along a circular path in accordance with an embodiment of the present invention and a golf ball dimple profile shape defined by a mixed function containing trigonometric, exponential, and polynomial terms.
Figure 25:
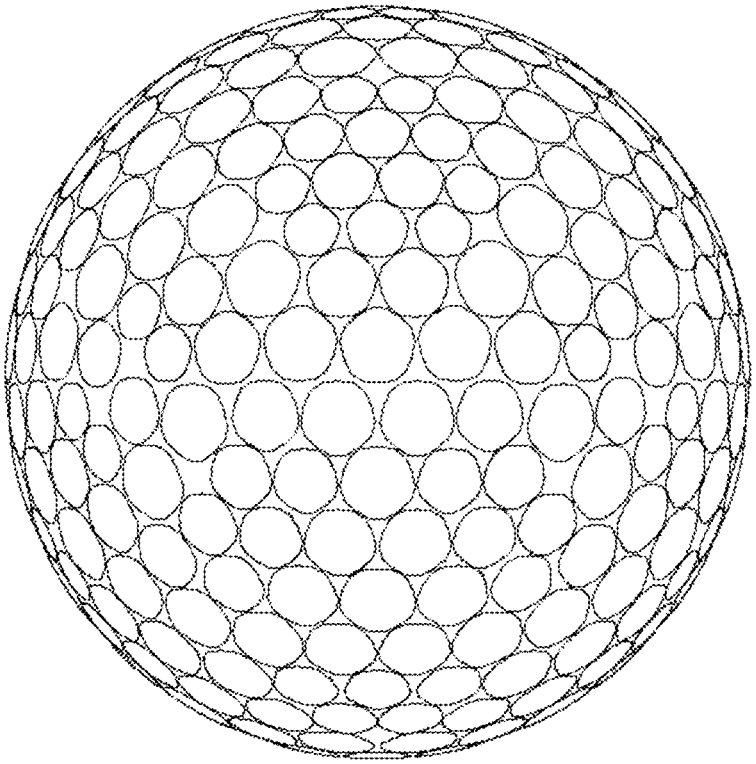
FIG. 25 illustrates a golf ball pattern having a plurality of dimple plan shapes produced in accordance with an embodiment of the present invention.

FIG. 24 illustrates a golf ball dimple plan shape 140 produced in accordance with the parameters of Table 12. FIG. 24 also illustrates a dimple profile shape 145 defined by the following mixed function containing trigonometric, exponential, and polynomial terms $f(x)=\sin h(3x)-\exp(x^2)-4x$. FIG. 25 illustrates a golf ball pattern utilizing the dimple plan shape and profile shape of FIG. 24.

Example 12

The following example illustrates golf ball dimple plan shapes defined by a low frequency periodic square wave function mapped to a circular path. The square wave function is approximated by a two-term Fourier series. Table 13 below describes the mathematical parameters used to project the periodic square wave function onto the simple closed path.

TABLE 13

| PLAN SHAPE PARAMETERS OF EXAMPLE 12 | |
|---|---|
| Path | Circular |
| Periodic Function | Square Wave (2-term Fourier expansion) |
| Function (f(x)) | $f(x) = s + a/\pi * (\sin(\pi px) + \sin(3\pi px)/3)$ |
| Sharpness Factor, s | 20 |
| Amplitude, a | 0.6 |
| Period | 7 |

Figure 26:
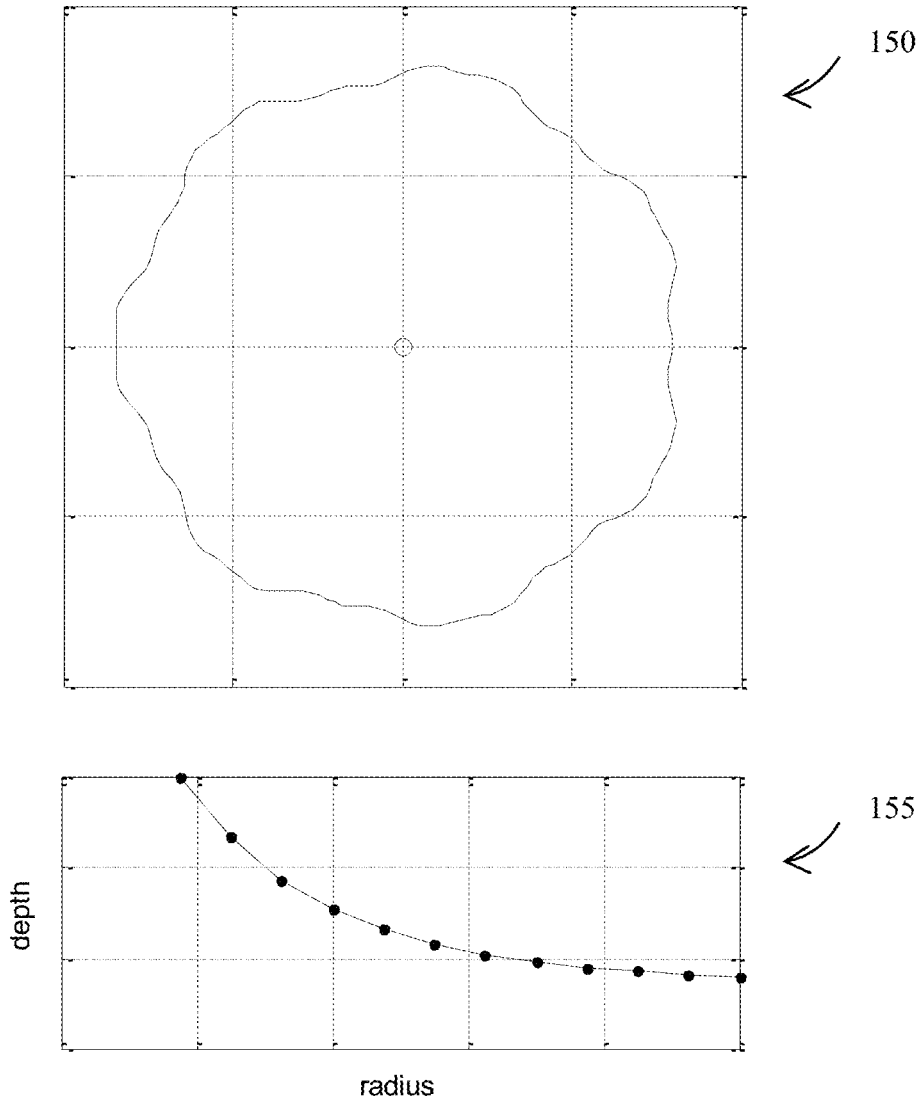
FIG. 26 illustrates a golf ball dimple plan shape defined by a periodic square wave function mapped along a circular path in accordance with an embodiment of the present invention and a golf ball dimple profile shape defined by a mixed function containing trigonometric and polynomial terms.
Figure 27:
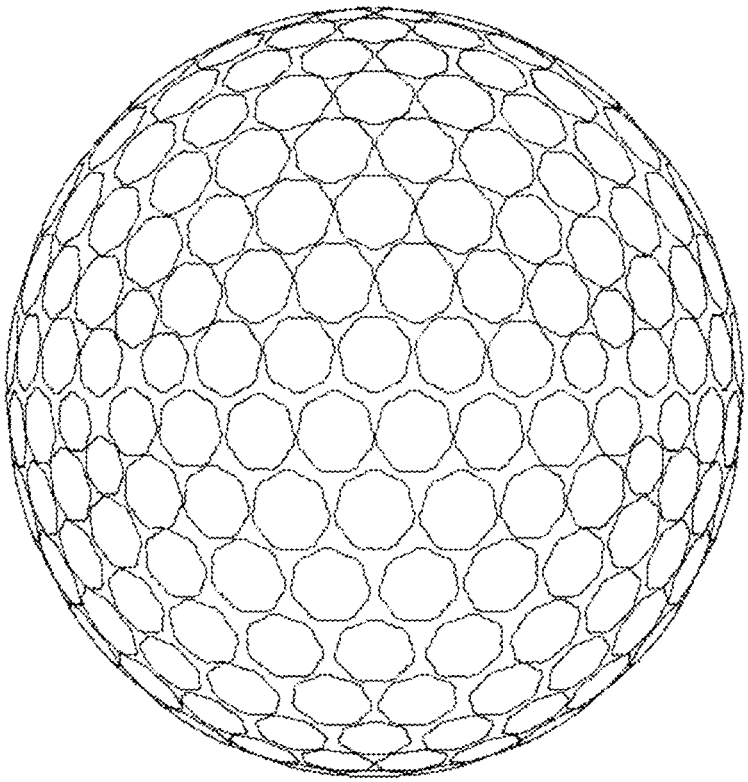
FIG. 27 illustrates a golf ball pattern having a plurality of dimple plan shapes produced in accordance with an embodiment of the present invention.

FIG. 26 illustrates a golf ball dimple plan shape 150 produced in accordance with the parameters of Table 13. FIG. 26 also illustrates a dimple profile shape 155 defined by the following mixed function containing trigonometric and polynomial terms $f(x)=\sin h(4x)+x^2$. FIG. 27 illustrates a golf ball pattern utilizing the dimple plan shape and profile shape of FIG. 26.

Example 13

The following example illustrates golf ball dimple plan shapes defined by a low frequency periodic square wave function mapped to a circular path. The square wave function is approximated by a two-term Fourier series. Table 14 below describes the mathematical parameters used to project the periodic square wave function onto the simple closed path.

TABLE 14

| PLAN SHAPE PARAMETERS OF EXAMPLE 13 | |
|---|---|
| Path | Circular |
| Periodic Function | Square Wave (2-term Fourier expansion) |
| Function (f(x)) | f (x) = s + a/π * (sin(πpx) + sin(3πpx)/3) |
| Sharpness Factor, s | 21.2 |
| Amplitude, a | 0.95 |
| Period | 9 |

Figure 28:
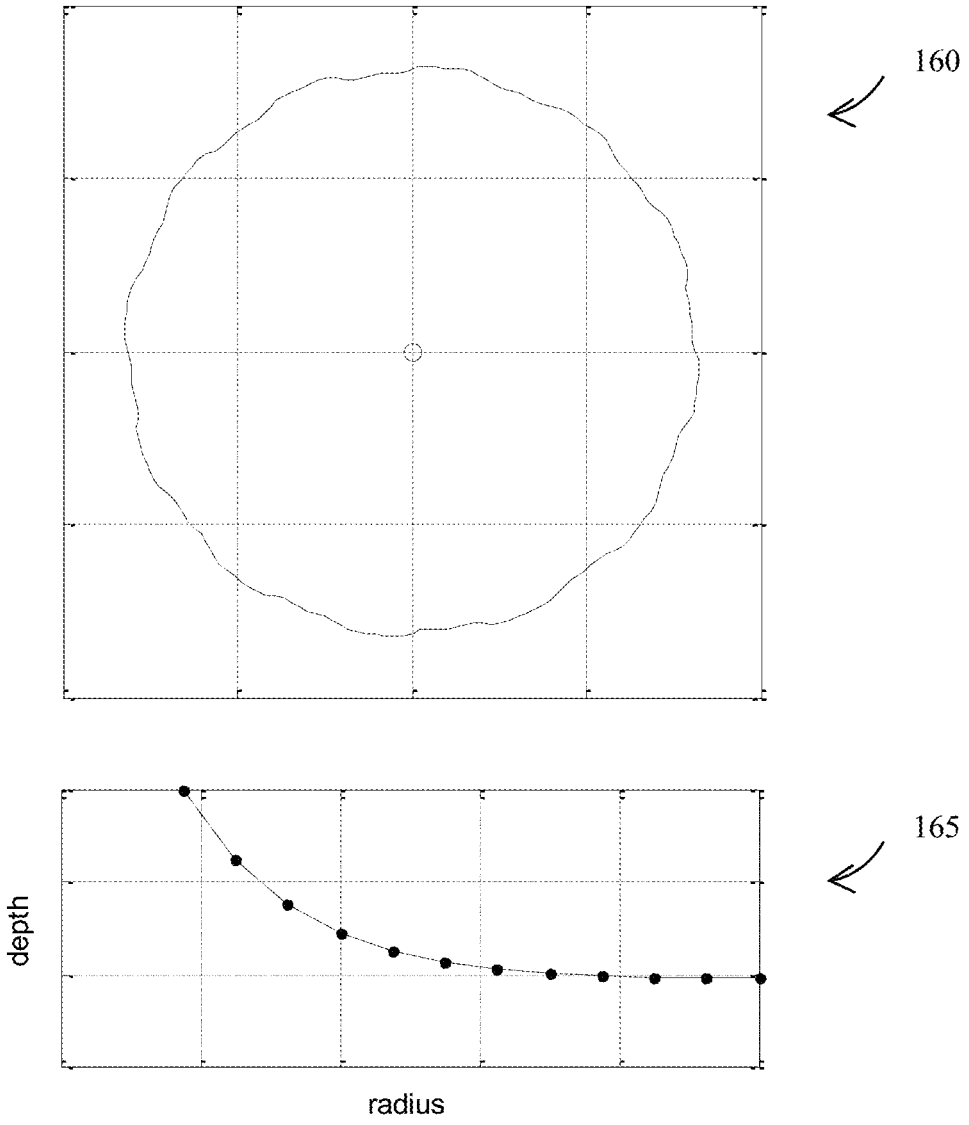
FIG. 28 illustrates a golf ball dimple plan shape defined by a periodic square wave function mapped along a circular path in accordance with an embodiment of the present invention and a golf ball dimple profile shape defined by a mixed function containing exponential and polynomial terms.
Figure 29:
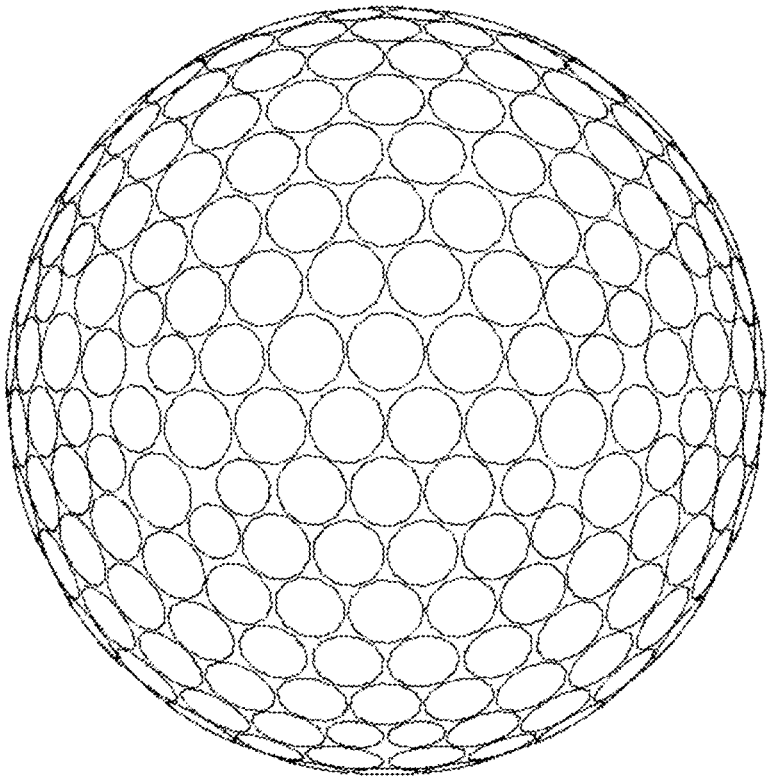
FIG. 29 illustrates a golf ball pattern having a plurality of dimple plan shapes produced in accordance with an embodiment of the present invention.

FIG. 28 illustrates a golf ball dimple plan shape 160 produced in accordance with the parameters of Table 14. FIG. 28 also illustrates a dimple profile shape 165 defined by the following mixed function containing exponential and polynomial terms $f(x)=\cos h(5x)$. FIG. 29 illustrates a golf ball pattern utilizing the dimple plan shape and profile shape of FIG. 28.

Example 14

The following example illustrates golf ball dimple plan shapes defined by a low frequency periodic sawtooth function mapped to a circular path. The sawtooth function is approximated by a four-term Fourier series. Table 15 below describes the mathematical parameters used to project the periodic sawtooth function onto the simple closed path.

TABLE 15

| PLAN SHAPE PARAMETERS OF EXAMPLE 14 | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 10 |
| Amplitude, a | 1 |
| Period | 3 |

Figure 30:
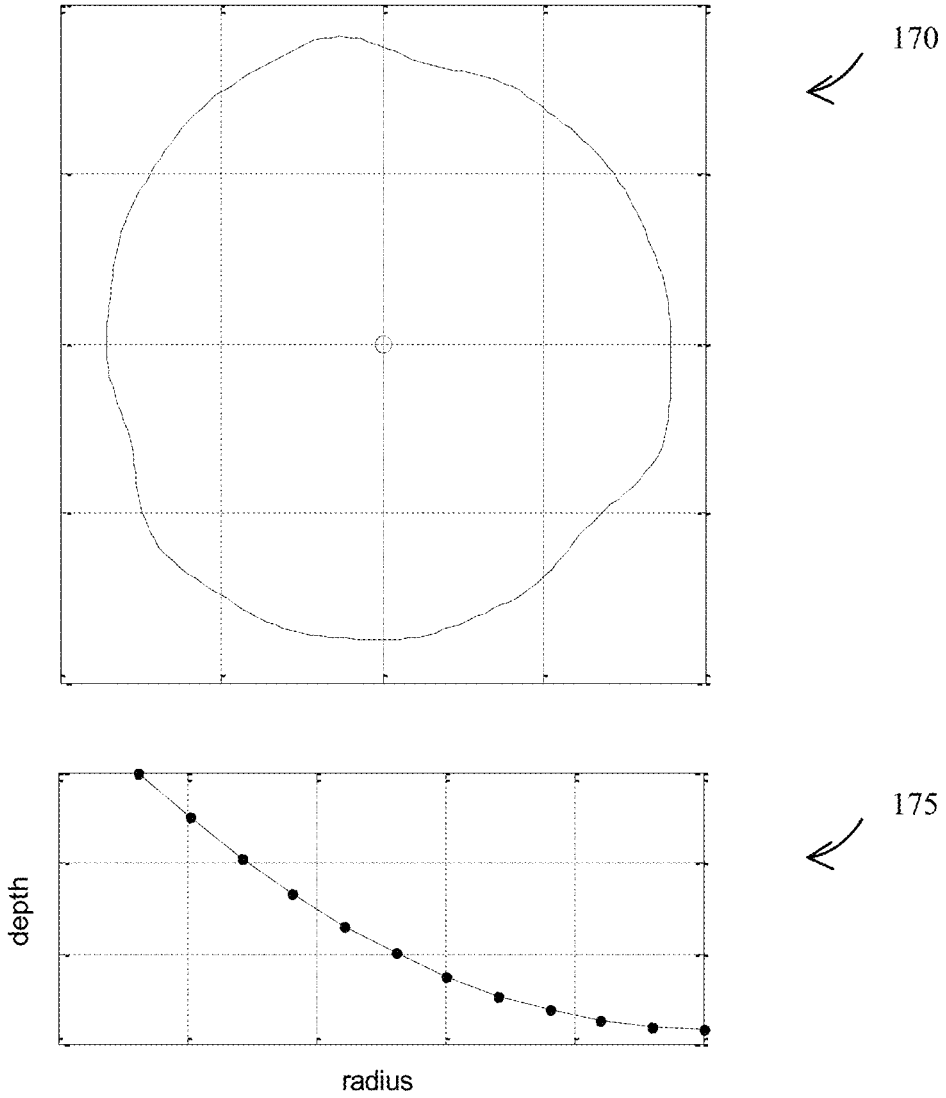
FIG. 30 illustrates a golf ball dimple plan shape defined by a periodic sawtooth function mapped along a circular path in accordance with an embodiment of the present invention and a golf ball dimple profile shape defined by a parabolic function.
Figure 31:
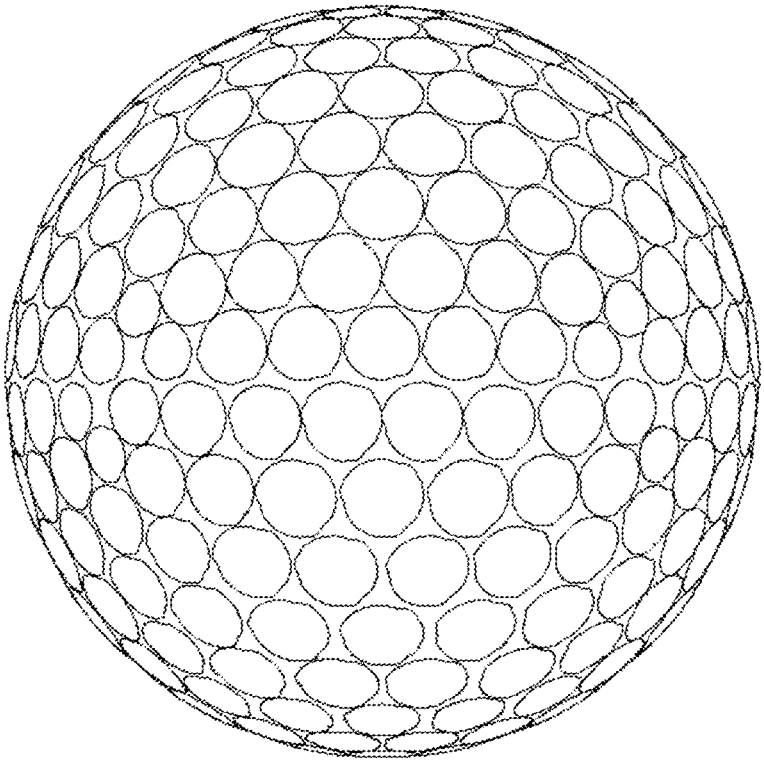
FIG. 31 illustrates a golf ball pattern having a plurality of dimple plan shapes produced in accordance with an embodiment of the present invention.

FIG. 30 illustrates a golf ball dimple plan shape 170 produced in accordance with the parameters of Table 15. FIG. 30 also illustrates a dimple profile shape 175 defined by the parabolic function $f(x)=x^2$. FIG. 31 illustrates a golf ball pattern utilizing the dimple plan shape and profile shape of FIG. 30.

Example 15

The following example illustrates golf ball dimple plan shapes defined by a low frequency periodic sawtooth function mapped to a circular path. The sawtooth function is approximated by a four-term Fourier series. Table 16 below describes the mathematical parameters used to project the periodic sawtooth function onto the simple closed path.

TABLE 16

| PLAN SHAPE PARAMETERS OF EXAMPLE 15 | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 8 |
| Amplitude, a | 1 |
| Period | 4 |

Figure 32:
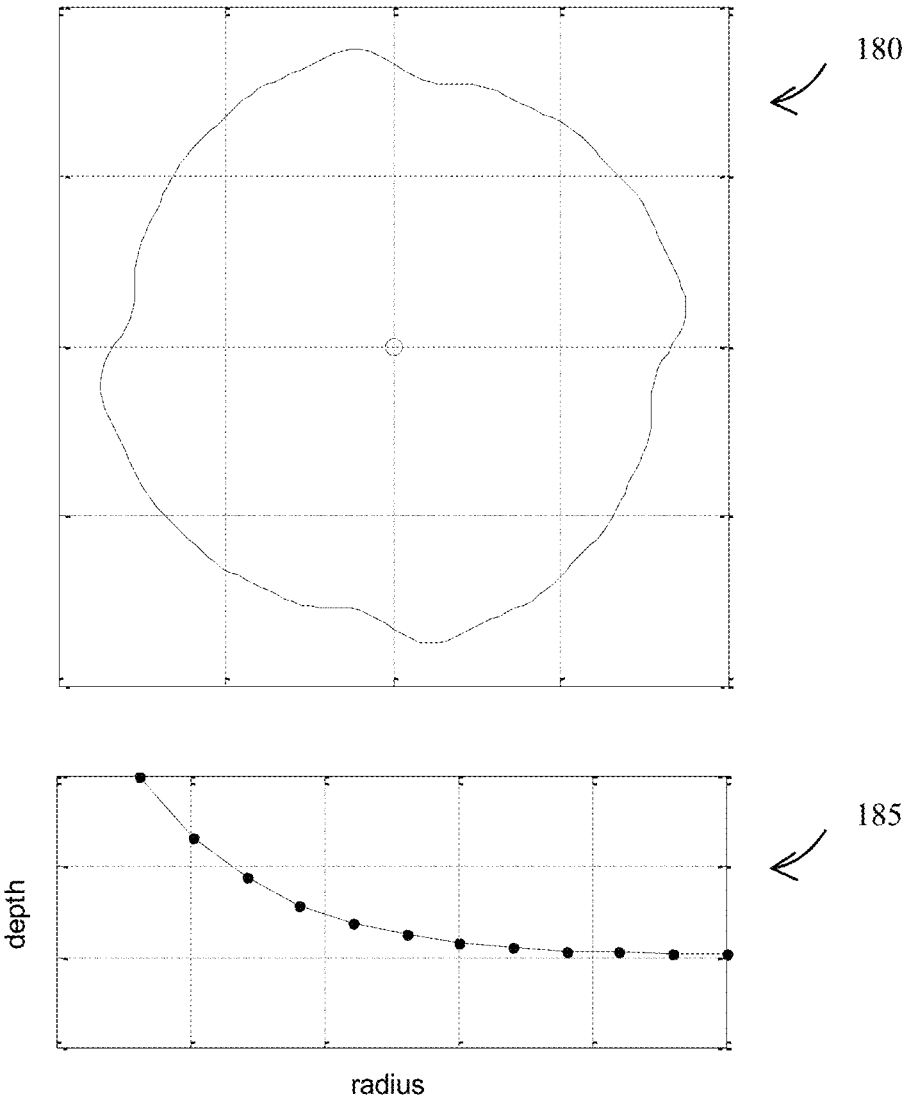
FIG. 32 illustrates a golf ball dimple plan shape defined by a periodic sawtooth function mapped along a circular path in accordance with an embodiment of the present invention and a golf ball dimple profile shape defined by an exponential function.
Figure 33:
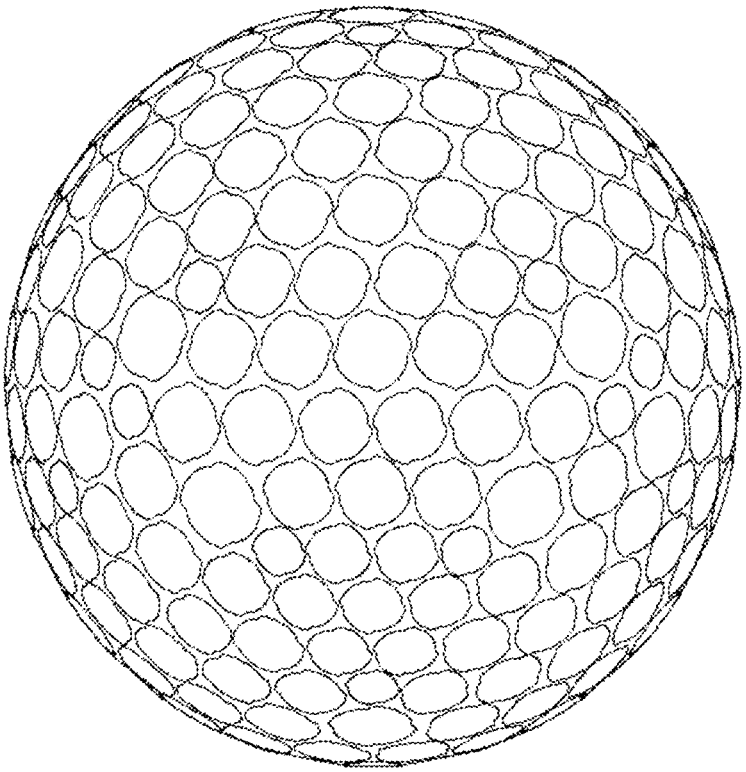
FIG. 33 illustrates a golf ball pattern having a plurality of dimple plan shapes produced in accordance with an embodiment of the present invention.

FIG. 32 illustrates a golf ball dimple plan shape 180 produced in accordance with the parameters of Table 16. FIG. 32 also illustrates a dimple profile shape 185 defined by the exponential function $f(x)=\exp(x^3)$. FIG. 33 illustrates a golf ball pattern utilizing the dimple plan shape and profile shape of FIG. 32.

Example 16

The following example illustrates golf ball dimple plan shapes defined by a low frequency periodic sawtooth function mapped to a circular path. The sawtooth function is approximated by a four-term Fourier series. Table 17 below describes the mathematical parameters used to project the periodic sawtooth function onto the simple closed path.

TABLE 17

| PLAN SHAPE PARAMETERS OF EXAMPLE 16 | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 13 |
| Amplitude, a | 0.8 |
| Period | 7 |

Figure 34:
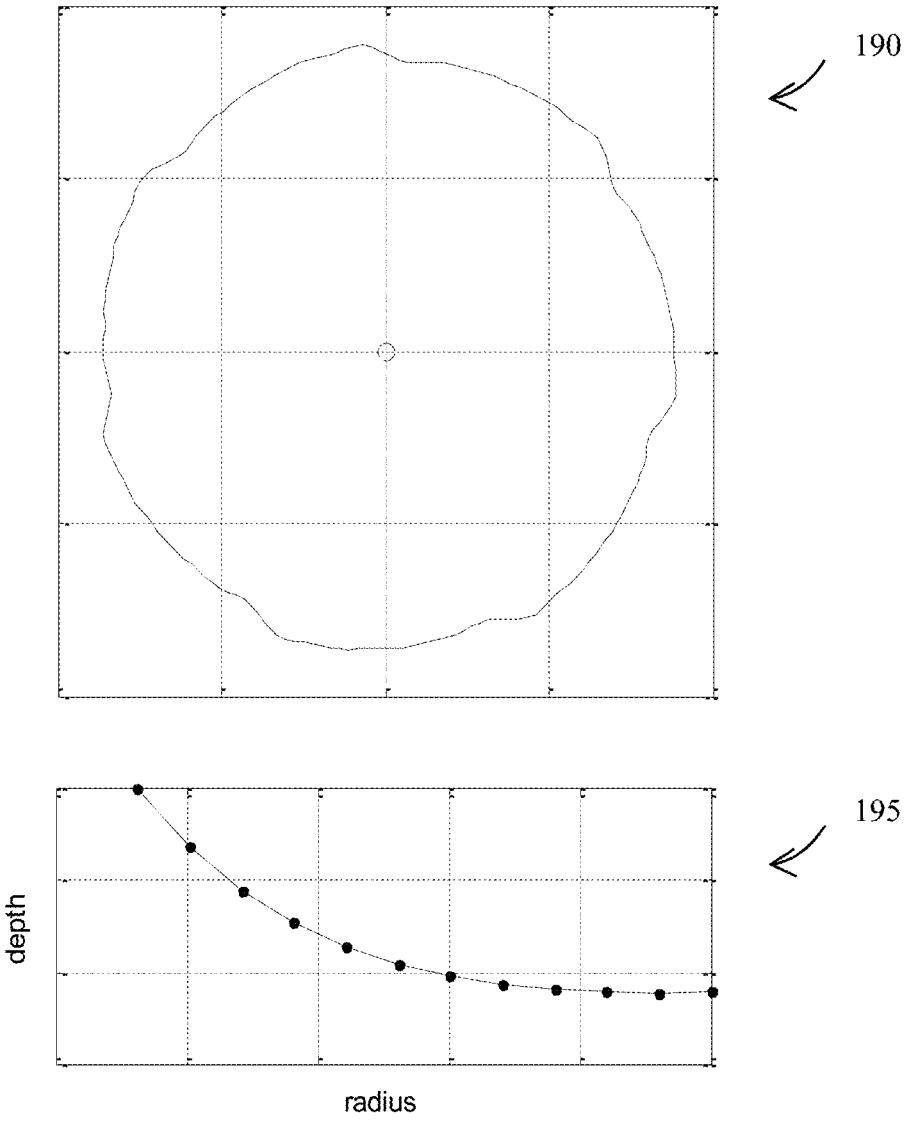
FIG. 34 illustrates a golf ball dimple plan shape defined by a periodic sawtooth function mapped along a circular path in accordance with an embodiment of the present invention and a golf ball dimple profile shape defined by a trigonometric function.
Figure 35:
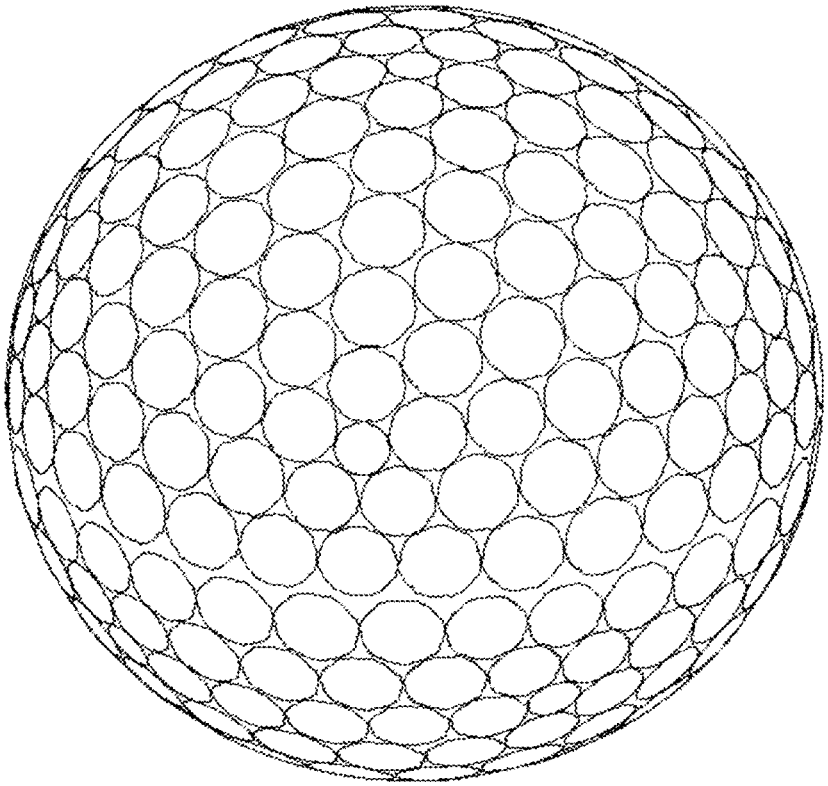
FIG. 35 illustrates a golf ball pattern having a plurality of dimple plan shapes produced in accordance with an embodiment of the present invention.

FIG. 34 illustrates a golf ball dimple plan shape 190 produced in accordance with the parameters of Table 17. FIG. 34 also illustrates a dimple profile shape 195 defined by the trigonometric function $f(x)=\cos h(3x)-\sin h(x)$. FIG. 35 illustrates a golf ball pattern utilizing the dimple plan shape and profile shape of FIG. 34.

Example 17

The following example illustrates golf ball dimple plan shapes defined by a low frequency periodic sawtooth function mapped to a circular path. The sawtooth function is approximated by a four-term Fourier series. Table 18 below describes the mathematical parameters used to project the periodic sawtooth function onto the simple closed path.

TABLE 18

| PLAN SHAPE PARAMETERS OF EXAMPLE 17 | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 12.5 |
| Amplitude, a | 1.2 |
| Period | 6 |

Figure 36:
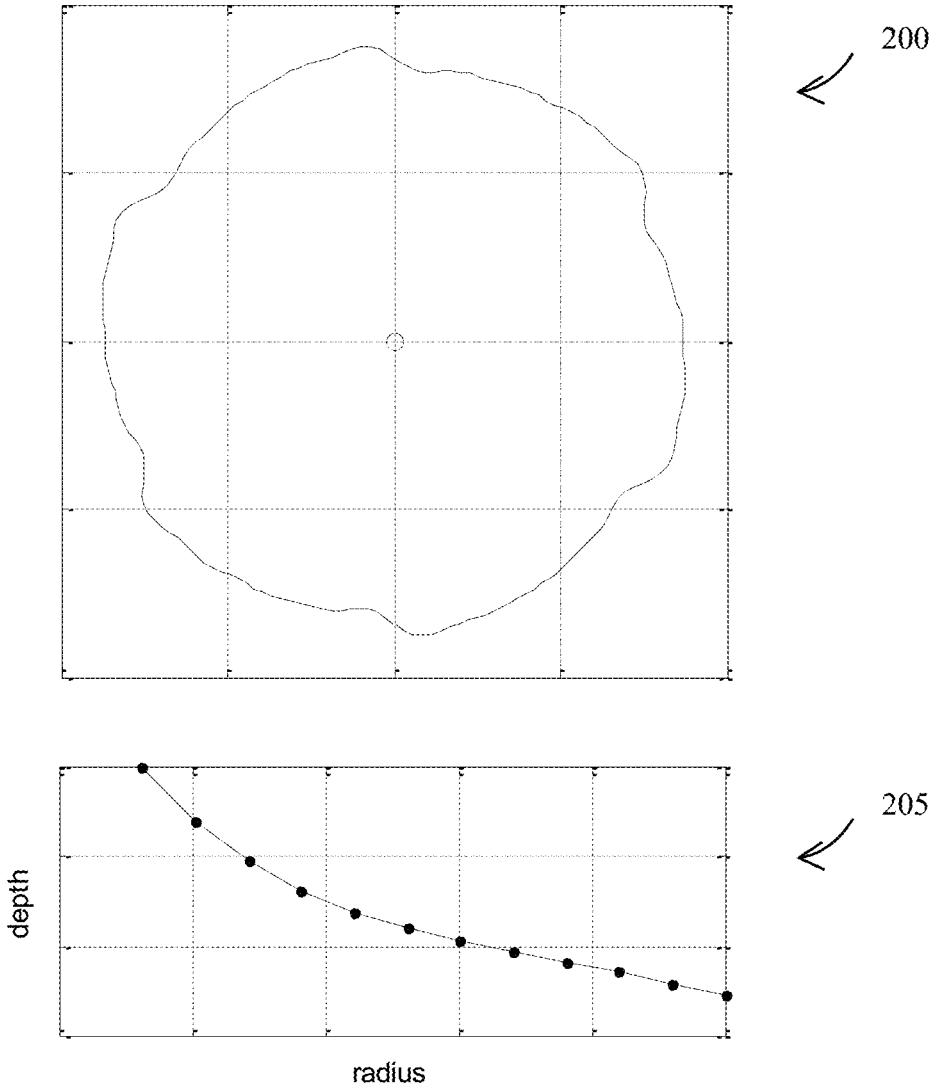
FIG. 36 illustrates a golf ball dimple plan shape defined by a periodic sawtooth function mapped along a circular path in accordance with an embodiment of the present invention and a golf ball dimple profile shape defined by a polynomial function.
Figure 37:
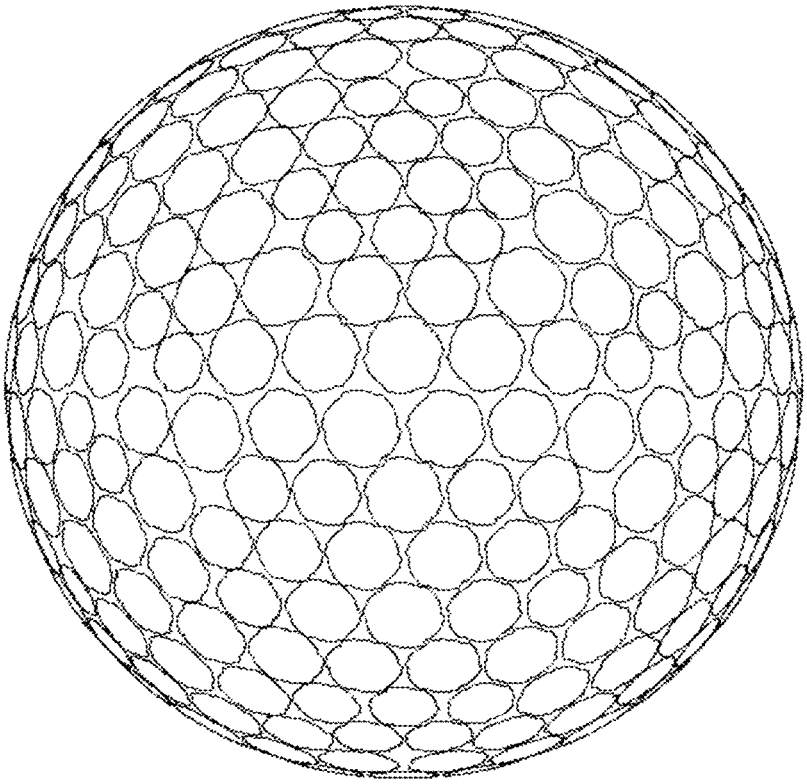
FIG. 37 illustrates a golf ball pattern having a plurality of dimple plan shapes produced in accordance with an embodiment of the present invention.

FIG. 36 illustrates a golf ball dimple plan shape 200 produced in accordance with the parameters of Table 18. FIG. 36 also illustrates a dimple profile shape 205 defined by the polynomial function $f(x)=x^4-\frac{3}{5}x^3+\frac{1}{2}x$. FIG. 37 illustrates a golf ball pattern utilizing the dimple plan shape and profile shape of FIG. 36.

Example 18

The following example illustrates golf ball dimple plan shapes defined by a low frequency periodic sawtooth function mapped to a circular path. The sawtooth function is approximated by a four-term Fourier series. Table 19 below describes the mathematical parameters used to project the periodic sawtooth function onto the simple closed path.

TABLE 19

| PLAN SHAPE PARAMETERS OF EXAMPLE 18 | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 21.2 |
| Amplitude, a | 0.95 |
| Period | 9 |

Figure 38:
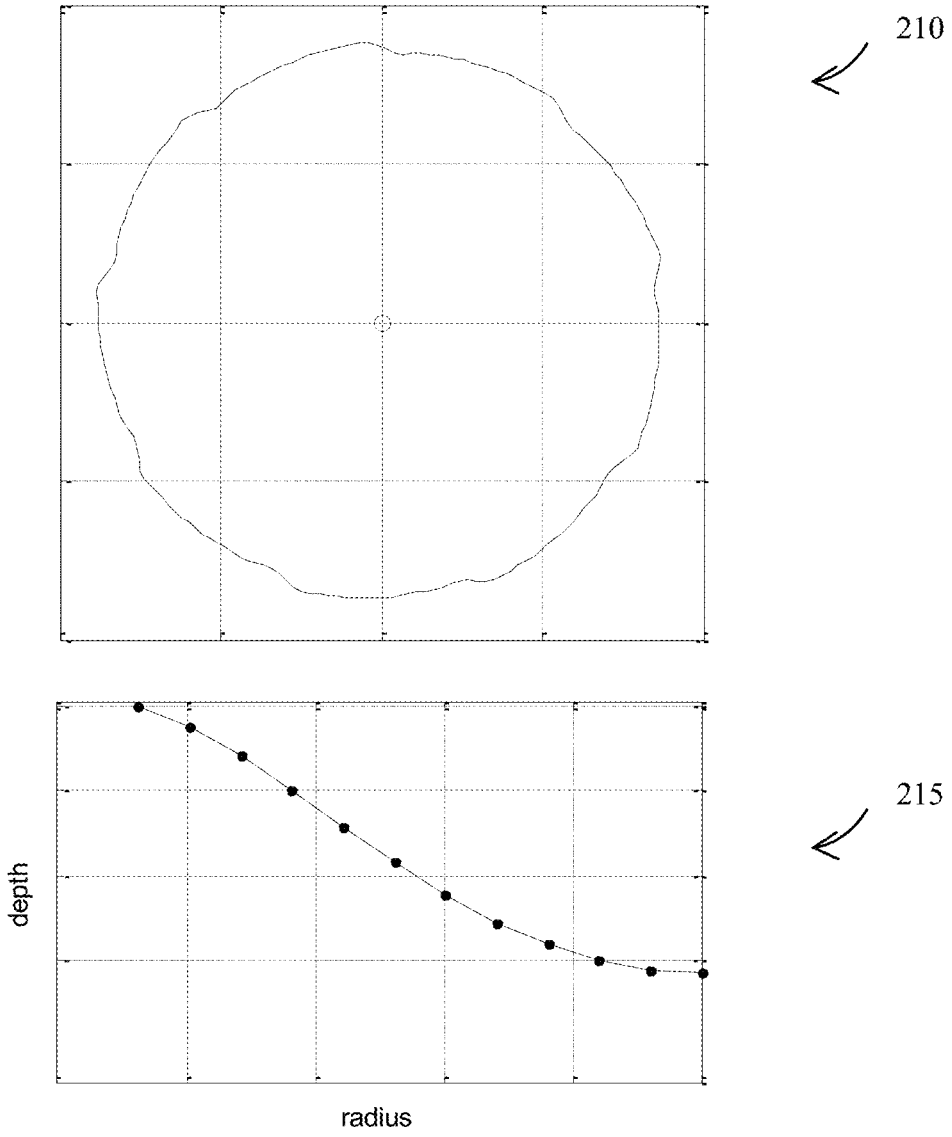
FIG. 38 illustrates a golf ball dimple plan shape defined by a periodic sawtooth function mapped along a circular path in accordance with an embodiment of the present invention and a golf ball dimple profile shape defined by a mixed function containing exponential and polynomial terms.
Figure 39:
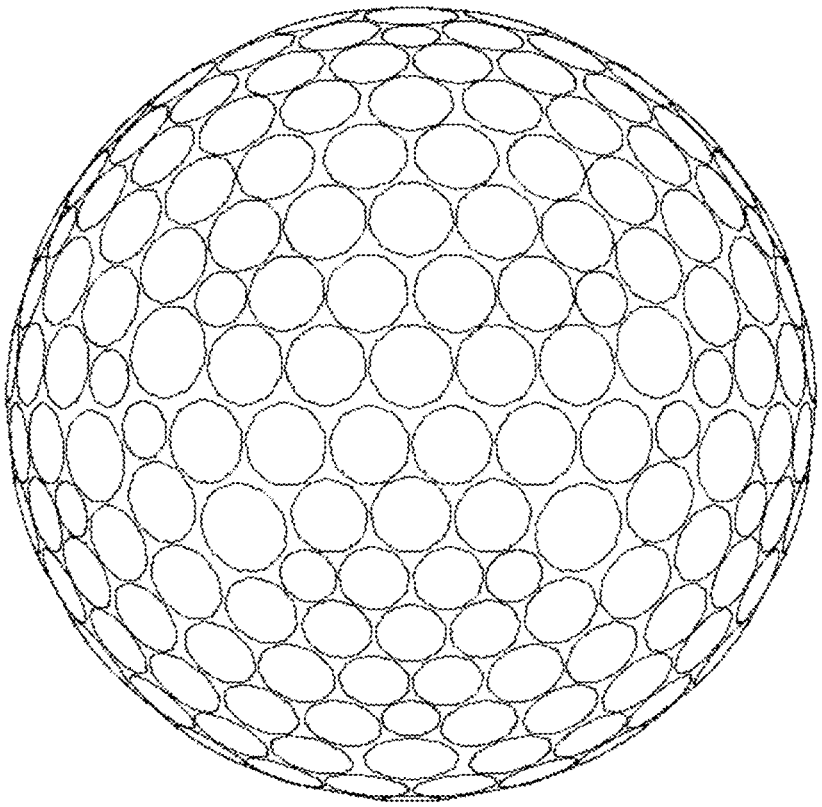
FIG. 39 illustrates a golf ball pattern having a plurality of dimple plan shapes produced in accordance with an embodiment of the present invention.

FIG. 38 illustrates a golf ball dimple plan shape 210 produced in accordance with the parameters of Table 18. FIG. 38 also illustrates a dimple profile shape 215 defined by the following mixed function containing exponential and polynomial terms $f(x)=\exp(x^2)-x^5$. FIG. 39 illustrates a golf ball pattern utilizing the dimple plan shape and profile shape of FIG. 38.

Example 19

The following example illustrates golf ball dimple plan shapes defined by a low frequency periodic square wave function mapped to a circular path. The square wave function is approximated by a two-term Fourier series. Table 20 below describes the mathematical parameters used to project the periodic square wave function onto the simple closed path.

TABLE 20

| PLAN SHAPE PARAMETERS OF EXAMPLE 19 | |
|---|---|
| Path | Circular |
| Periodic Function | Square Wave (2-term Fourier expansion) |
| Function (f(x)) | f (x) = s + a/π * (sin(πpx) + sin(3πpx)/3) |
| Sharpness Factor, s | 25 |
| Amplitude, a | 0.5 |
| Period, p | 4 |

Figure 41A:
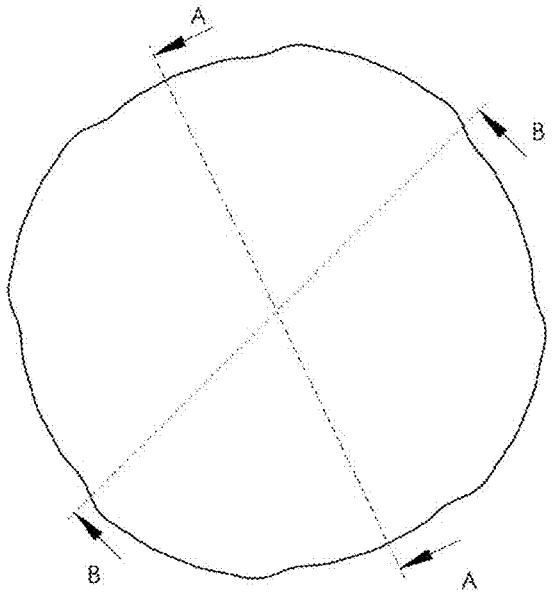
FIG. 41A illustrates a golf ball dimple plan shape defined by a periodic square wave function mapped along a circular path in accordance with an embodiment of the present invention.
Figure 41B:
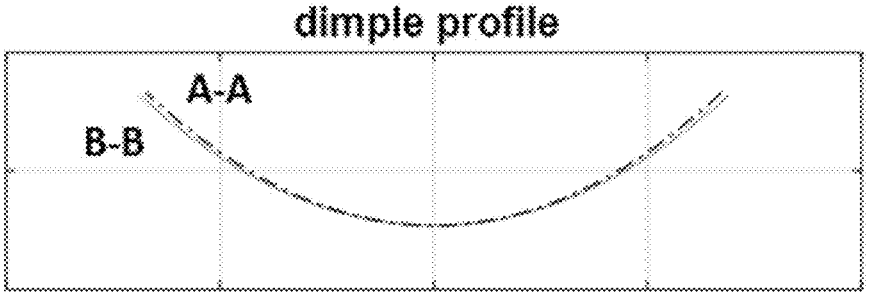
FIG. 41B illustrates two dimple profiles of a dimple having the plan shape shown in FIG. 41A in accordance with an embodiment of the present invention.

FIG. 41A illustrates a golf ball dimple plan shape produced in accordance with the parameters of Table 20 and having a 0.140 inch nominal dimple diameter. FIG. 41B illustrates profiles A-A (black dashed line) and B-B (solid grey line), which are cross-sectional profiles of the dimple at the locations indicated in FIG. 41A. Profiles A-A and B-B are defined by the polynomial function $y=x^2$. Because period p is an even number, the edge angle ($\Phi_{EDGE1}$) at one end of profile A-A and the edge angle ($\Phi_{EDGE2}$) at the other end of profile A-A are equivalent, and the edge angle ($\Phi_{EDGE3}$) at one end of profile B-B and the edge angle ($\Phi_{EDGE4}$) at the other end of profile B-B are equivalent, but $\Phi_{EDGE1}$ and $\Phi_{EDGE2}$ are not equivalent to $\Phi_{EDGE3}$ and $\Phi_{EDGE4}$. In this example, $\Phi_{EDGE1}$ and $\Phi_{EDGE2}$ are about 12.10°, which is the maximum value of the edge angles of all of the profiles of the dimple; $\Phi_{EDGE3}$ and $\Phi_{EDGE4}$ are about 11.60°, which is the minimum value of the edge angles of all of the profiles of the dimple; and the mean value of the edge angles of all of the profiles of the dimple is about 11.85°.

Example 20

The following example illustrates golf ball dimple plan shapes defined by a low frequency periodic sawtooth function mapped to a circular path. The sawtooth function is approximated by a four-term Fourier series. Table 21 below describes the mathematical parameters used to project the periodic square wave function onto the simple closed path.

TABLE 21

| PLAN SHAPE PARAMETERS OF EXAMPLE 20 | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 10 |
| Amplitude, a | 1.0 |
| Period, p | 5 |

Figure 42A:
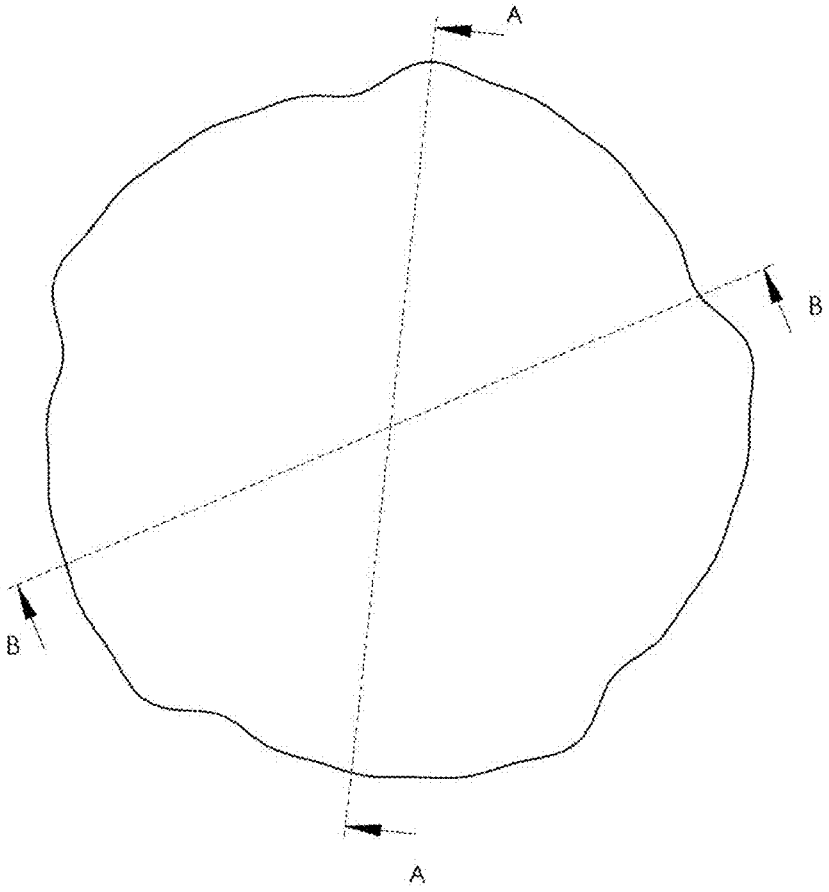
FIG. 42A illustrates a golf ball dimple plan shape defined by a periodic sawtooth function mapped along a circular path in accordance with an embodiment of the present invention.
Figure 42B:
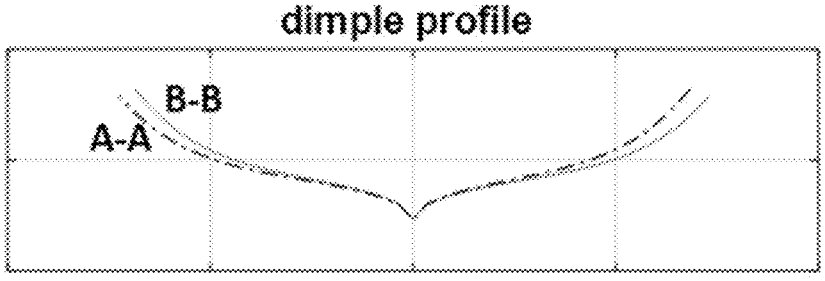
FIG. 42B illustrates two dimple profiles of a dimple having the plan shape shown in FIG. 42A in accordance with an embodiment of the present invention.

FIG. 42A illustrates a golf ball dimple plan shape produced in accordance with the parameters of Table 21 and having a 0.140 inch nominal dimple diameter. FIG. 42B illustrates profiles A-A (black dashed line) and B-B (solid grey line), which are cross-sectional profiles of the dimple at the locations indicated in FIG. 42A. Profiles A-A and B-B are defined by the function $y=e^{x^2}\sqrt{x}$. Because period p is an odd number, the edge angle ($\Phi_{EDGE1}$) at one end of profile A-A and the edge angle ($\Phi_{EDGE2}$) at the other end of profile A-A are not equivalent. Likewise, the edge angle ($\Phi_{EDGE3}$) at one end of profile B-B and the edge angle ($\Phi_{EDGE4}$) at the other end of profile B-B are not equivalent. In this example, $\Phi_{EDGE1}$ is about 11.20°; $\Phi_{EDGE2}$ is about 11.80°; $\Phi_{EDGE3}$ is about 12.30°; $\Phi_{EDGE4}$ is about 11.75°; the maximum value of the edge angles of all of the profiles of the dimple is about 12.30°; the minimum value of the edge angles of all of the profiles of the dimple is about 11.20°; and the mean value of the edge angles of all of the profiles of the dimple is about 11.75°.

Example 21

The following example illustrates golf ball dimple plan shapes defined by a low frequency periodic sawtooth function mapped to a circular path. The sawtooth function is approximated by a four-term Fourier series. Table 22 below describes the mathematical parameters used to project the periodic square wave function onto the simple closed path.

TABLE 22

PLAN SHAPE PARAMETERS OF EXAMPLE 21

| | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 11 |
| Amplitude, a | 1.0 |
| Period, p | 3 |

Figure 43A:
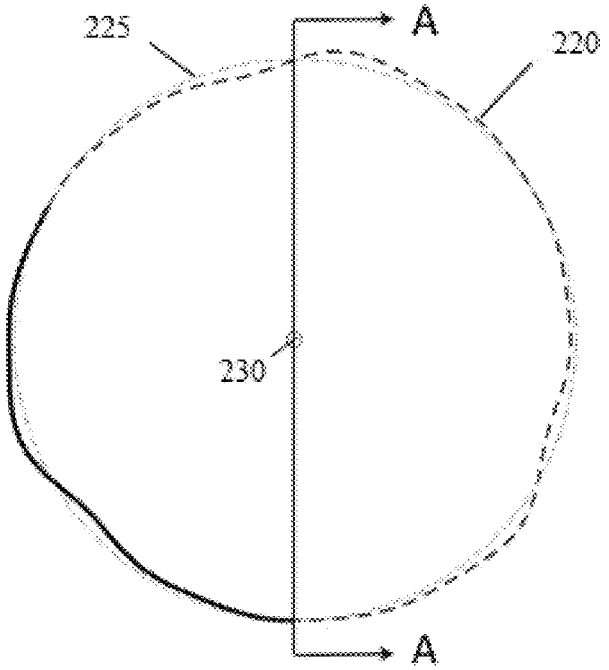
FIG. 43A illustrates a golf ball dimple plan shape defined by a periodic sawtooth function mapped along a circular path in accordance with an embodiment of the present invention.

FIG. 43A illustrates a golf ball dimple plan shape 220 defined by a low frequency periodic sawtooth function mapped to a circular path 225 produced in accordance with the parameters of Table 22 and having a 0.160 inch path diameter. A portion of plan shape 220 corresponding to a single period of the periodic sawtooth function is designated with a solid line. The absolute distance, d, of any point on the plan shape 220 from the circular path 225 is defined by the following equation:

$$d=\sqrt{(x_{circle}-x_{plan})^2+(y_{circle}-y_{plan})^2}$$

where d is a directed distance calculated along a line from the plan shape centroid 230 through corresponding points on the plan shape and circular path. In the embodiment illustrated in FIG. 43A, the amplitude of the plan shape, A, expressed as the maximum value, $d_{max}$, for all calculated distances, d, is about 0.0035 inches. There are a total of six points on plan shape 220 wherein the distance, d, of the point on the plan shape 220 from the circular path 225 equals $d_{max}$.

Figure 43B:
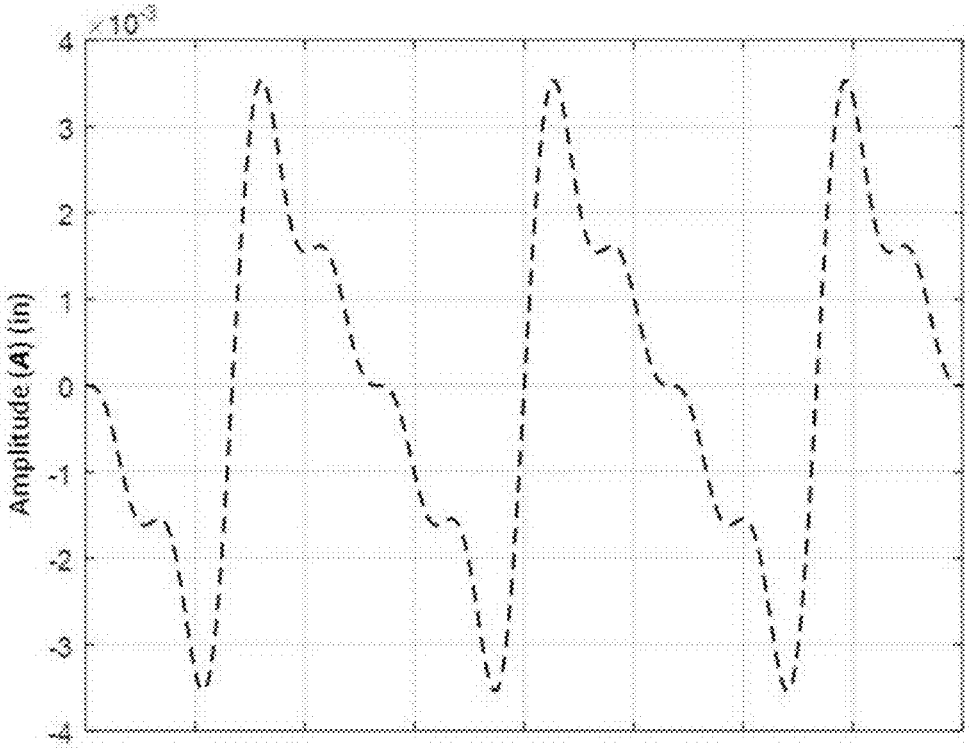
FIG. 43B illustrates the waveform of the periodic sawtooth function used in the dimple plan shape shown in FIG. 43A.

FIG. 43B illustrates the waveform of a sawtooth periodic function approximated by a four-term Fourier series expansion for use in forming the dimple plan shape 220.

Figure 43C:
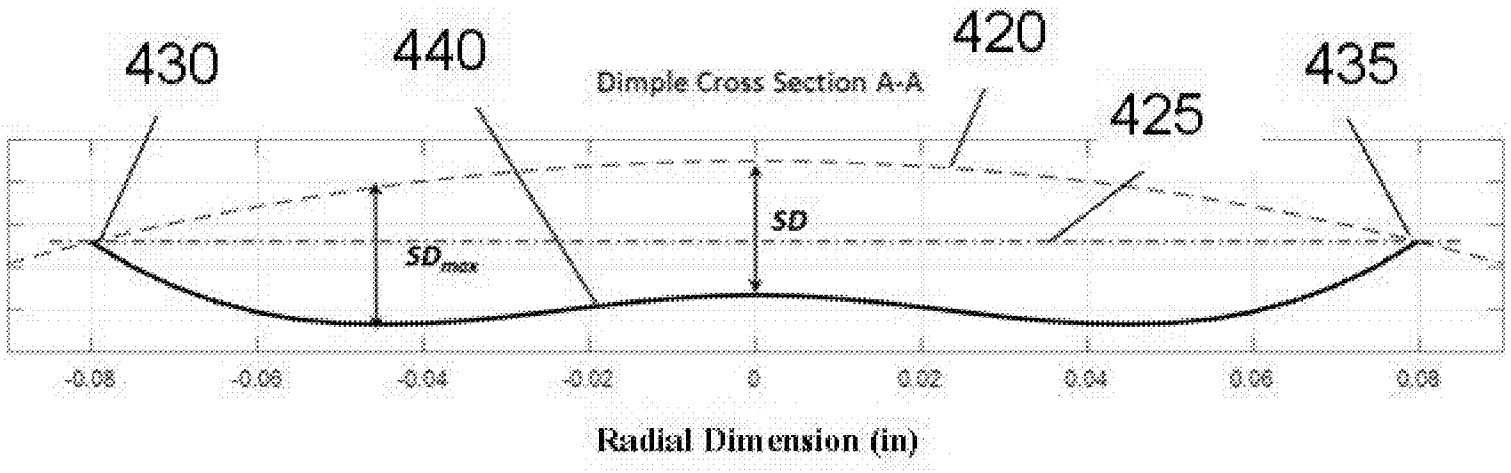
FIG. 43C illustrates a dimple profile of a dimple having the plan shape shown in FIG. 43A in accordance with an embodiment of the present invention.

FIG. 43C illustrates a dimple profile A-A of a dimple having the plan shape shown in FIG. 43A, at location A-A indicated in FIG. 43A. Profile A-A of FIG. 43C is defined by the function $y=x^3-\frac{3}{5}x^2$. Because period p is an odd number, the edge angle ($\Phi_{EDGE1}$) at one end 430 of profile A-A and the edge angle ($\Phi_{EDGE2}$) at the other end 435 of profile A-A are not equivalent. In this example, $\Phi_{EDGE1}$ is about 14.12° and $\Phi_{EDGE2}$ is about 14.60°. At profile A-A, the dimple has a dimple surface depth, SD, of about 0.0063 inches and a maximum depth, $SD_{max}$, of about 0.0067 inches. As shown in FIG. 43C, the surface of the dimple includes a protruding center portion 440, the highest point of which lies below the ball phantom surface 420 and also below the nominal chord plane 425 of the dimple.

A dimple defined by the plan shape and profile of FIGS. 43A-43C has a plan shape area of about 0.0201 $in^2$ resulting in a dimple surface volume of about $9.876\times10^{-5}$ $in^3$.

Example 22

Figure 44:
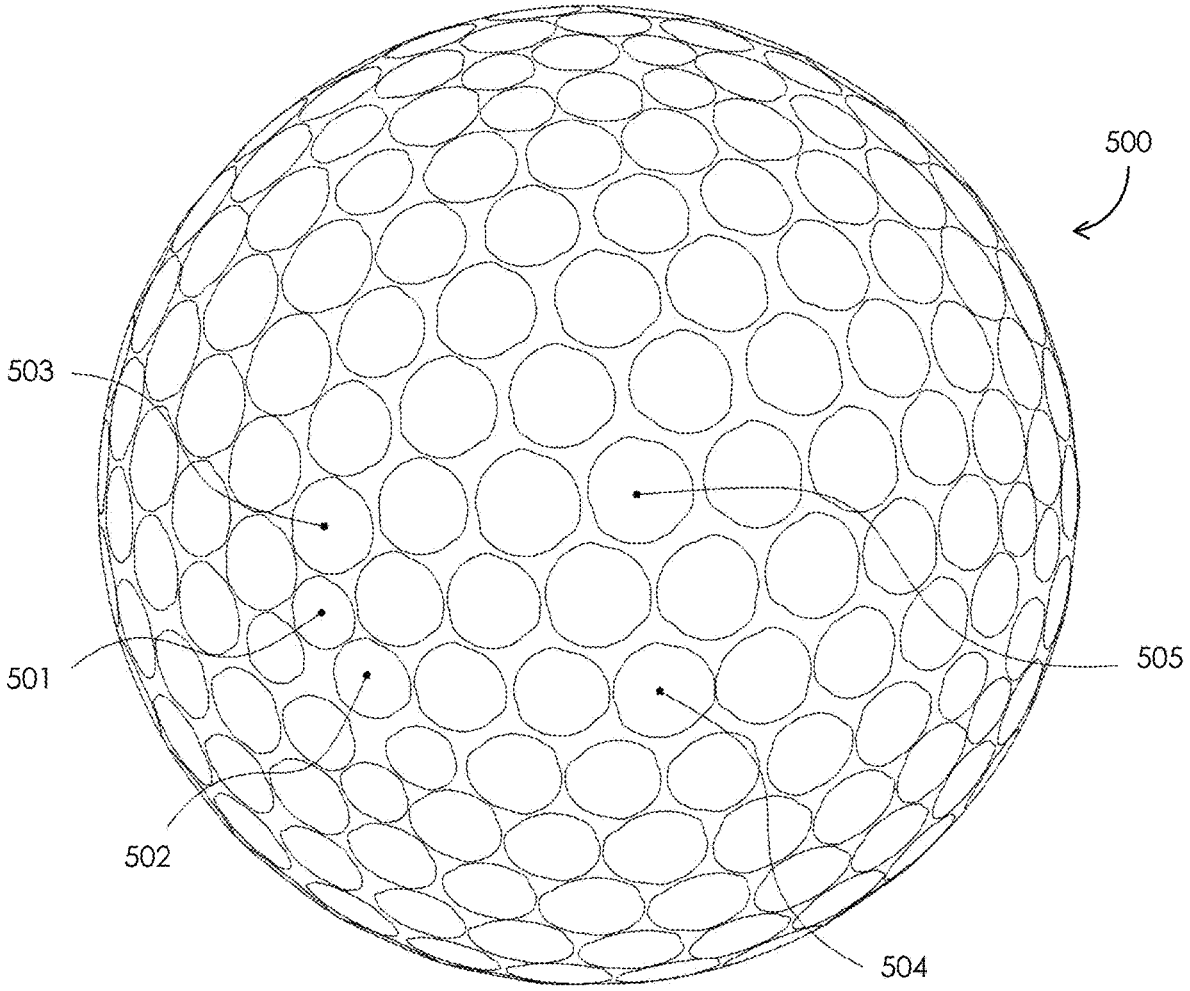
FIG. 44 illustrates a golf ball pattern having a plurality of dimple plan shapes produced in accordance with an embodiment of the present invention.

FIG. 44 illustrates a golf ball 500 having a dimple pattern consisting of 312 non-circular plan shape dimples, each of the dimples having a plan shape defined by a low frequency sawtooth function mapped to a circular simple closed path. The sawtooth function is approximated by a four-term Fourier series. Table 23 below describes the mathematical parameters used to project the periodic sawtooth function onto the simple closed path.

TABLE 23

PLAN SHAPE PARAMETERS OF EXAMPLE 22

| | |
|---|---|
| Path | Circular |
| Periodic Function | Sawtooth (4-term Fourier expansion) |
| Function (f(x)) | $f(x) = s - \frac{a}{\pi}\left(\sin(\pi px) + \frac{1}{2}\sin(2\pi px) + \frac{1}{3}\sin(3\pi px) + \frac{1}{4}\sin(4\pi px)\right)$ |
| Sharpness Factor, s | 11 |
| Amplitude, a | 1.0 |
| Period | 3 |

The dimple pattern of golf ball 500 includes non-circular plan shape dimples having five different plan shape areas. Each of the labels 501-505 identifies a different type of dimple in the pattern. Each of the 312 dimples in the pattern is one of these five types. The plan shape area, dimple surface volume, and surface depth for each of the five dimple types are given in Table 24 below. Also given in Table 24 for each of the five dimple types are the maximum edge angle, minimum edge angle, and average of all of the edge angles of all of the dimple profiles of that dimple type.

TABLE 24

DIMPLE PROPERTIES

| | Dimple Label | | | | |
|---|---|---|---|---|---|
| | 1 | 2 | 3 | 4 | 5 |
| Plan Shape Area ($in^2$) | 0.0131 | 0.0174 | 0.0216 | 0.0249 | 0.0263 |
| Dimple Surface Volume ($in^3$) | $5.73 \times 10^{-5}$ | $8.81 \times 10^{-5}$ | $1.22 \times 10^{-4}$ | $1.50 \times 10^{-4}$ | $1.63 \times 10^{-4}$ |
| Surface Depth (in) | 0.0057 | 0.0066 | 0.0073 | 0.0078 | 0.0080 |
| Maximum Edge Angle | 16.4° | 16.4° | 16.4° | 16.4° | 16.4° |
| Minimum Edge Angle | 15.2° | 15.2° | 15.2° | 15.2° | 15.2° |
| Average Edge Angle | 15.8° | 15.8° | 15.8° | 15.8° | 15.8° |

In a particular embodiment of the example shown in FIG. 44, the surface of the non-circular plan shape dimples includes a protruding center portion, the highest point of which lies below the ball phantom surface and also below the nominal chord plane of the dimple. In a particular aspect of this embodiment, the profile shape of each of the non-circular plan shape dimples is defined by the function $y=x^3-\frac{3}{5}x^2$, as illustrated in FIG. 43C.

Example 23

The following example illustrates golf ball dimple plan shapes defined by a low frequency periodic cosine function mapped to a circular path. Table 25 below describes the mathematical parameters used to project the periodic cosine function onto the simple closed path.

TABLE 25

PLAN SHAPE PARAMETERS OF EXAMPLE 23

| | |
|---|---|
| Path | Circular |
| Periodic Function | Cosine |
| Function (f(x)) | $f(x) = s + a * \cos(\pi p x)$ |
| Sharpness Factor, s | 15 |
| Amplitude, a | 1.0 |
| Period, p | 4 |

Figure 45A:
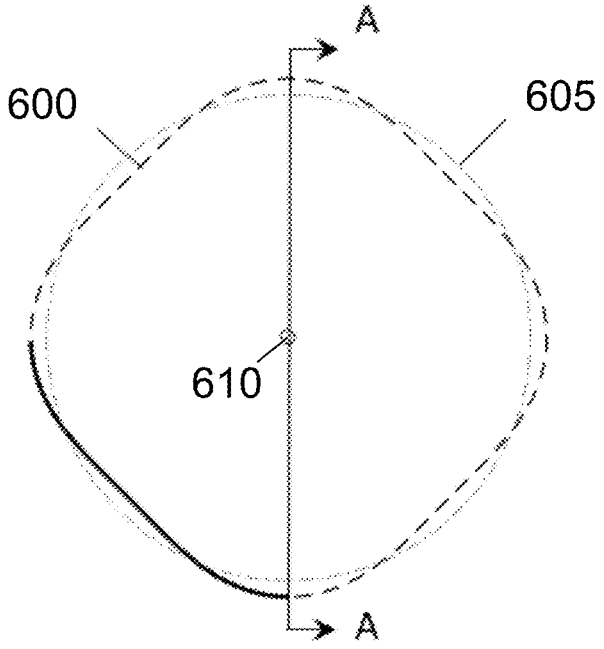
FIG. 45A illustrates a golf ball dimple plan shape defined by a periodic cosine function mapped along a circular path in accordance with an embodiment of the present invention.

FIG. 45A illustrates a golf ball dimple plan shape 600 defined by a low frequency periodic cosine function mapped to a circular path 605 produced in accordance with the parameters of Table 25 and having a 0.150 inch path diameter. A portion of plan shape 600 corresponding to a single period of the periodic cosine function is designated with a solid line. The absolute distance, d, of any point on the plan shape 600 from the circular path 605 is defined by the following equation:

$$d=\sqrt{(x_{circle}-x_{plan})^2+(y_{circle}-y_{plan})^2}$$

where d is a directed distance calculated along a line from the plan shape centroid 610 through corresponding points on the plan shape and circular path. In the embodiment illustrated in FIG. 45A, the amplitude of the plan shape, A, expressed as the maximum value, $d_{max}$, for all calculated distances, d, is about 0.0053 inches. There is a total of eight points on plan shape 600 wherein the distance, d, of the point on the plan shape 600 from the circular path 605 equals $d_{max}$.

Figure 45B:
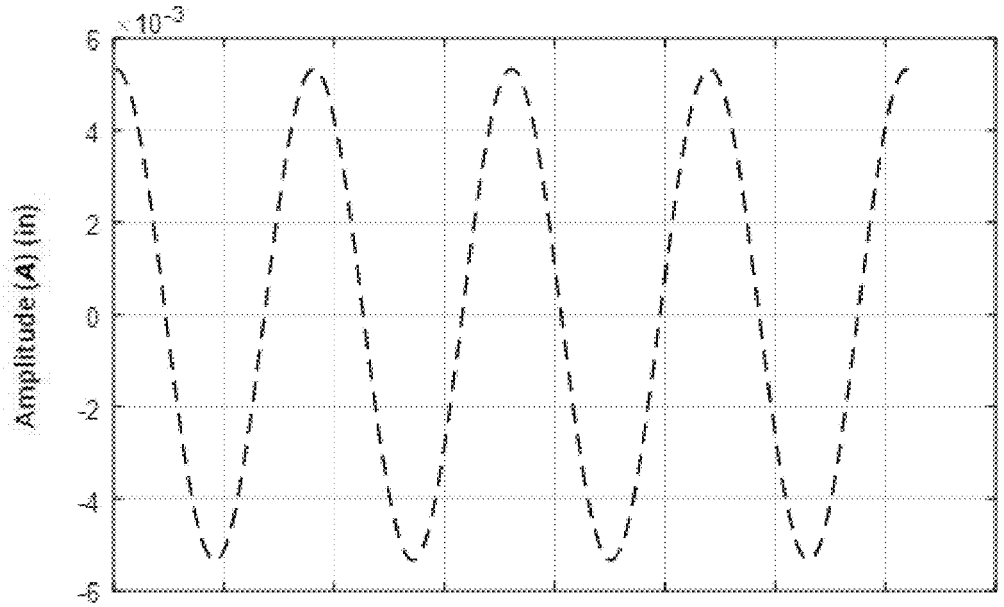
FIG. 45B illustrates the waveform of the periodic cosine function used in the dimple plan shape shown in FIG. 45A.

FIG. 45B illustrates the waveform of a periodic cosine function for use in forming the dimple plan shape 600.

Figure 45C:
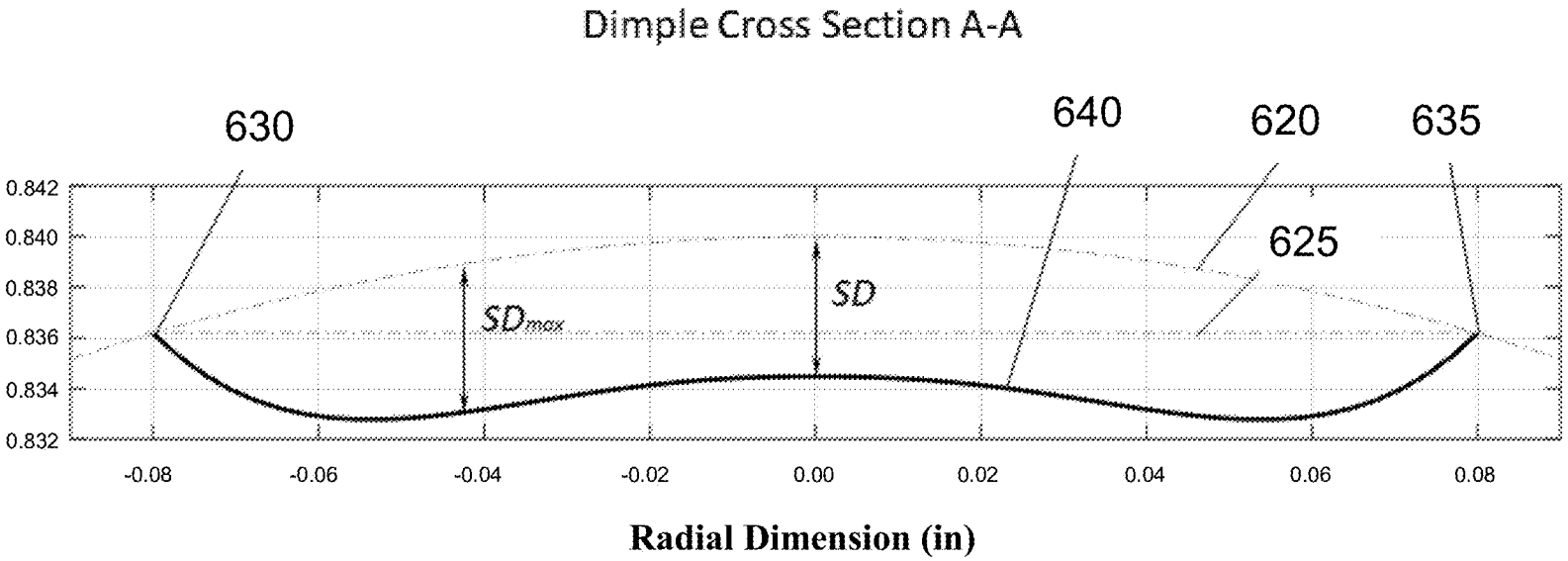
FIG. 45C illustrates a dimple profile of a dimple having the plan shape shown in FIG. 45A in accordance with an embodiment of the present invention.

FIG. 45C illustrates a dimple profile A-A of a dimple having the plan shape shown in FIG. 45A, at location A-A indicated in FIG. 45A. Profile A-A of FIG. 45C is defined by the function $y=x^4-\frac{2}{3}x^3$. Because period p is an even number, the edge angle ($\Phi_{EDGE1}$) at one end 630 of profile A-A and the edge angle ($\Phi_{EDGE2}$) at the other end 635 of profile A-A are equivalent. In this example, $\Phi_{EDGE1}$ is about 16.09° and $\Phi_{EDGE2}$ is about 16.09°. At profile A-A, the dimple has a dimple surface depth, SD, of about 0.0055 inches and a maximum depth, $SD_{max}$, of about 0.0058 inches. As shown in FIG. 45C, the surface of the dimple includes a protruding center portion 640, the highest point of which lies below the ball phantom surface 620 and also below the nominal chord plane 625 of the dimple.

A dimple defined by the plan shape and profile of FIGS. 45A-45C has a plan shape area of about 0.0177 $in^2$ resulting in a dimple surface volume of about $8.438\times10^{-5}$ $in^3$.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A golf ball having a generally spherical surface and comprising a plurality of dimples on the spherical surface, wherein at least a portion of the dimples are non-circular plan shape dimples having a plan shape defined by a periodic function mapped along a simple closed path, wherein the periodic function is selected from sine, cosine, sawtooth wave, triangle wave, and square wave functions, the simple closed path is selected from a circle, an ellipse, and a square; and the periodic function has a period of less than 6.

2. The golf ball of claim 1, wherein 50 percent or more of the dimples on the spherical surface are the non-circular plan shape dimples.

3. The golf ball of claim 1, wherein 80 percent or more of the dimples on the spherical surface are the non-circular plan shape dimples.

4. The golf ball of claim 1, wherein the periodic function has a period of less than 5.

5. The golf ball of claim 1, wherein each of the non-circular plan shape dimples has an effective dimple diameter of from 0.020 inches to 0.250 inches.

6. The golf ball of claim 1, wherein each of the non-circular plan shape dimples has an effective dimple diameter of from 0.100 inches to 0.225 inches.

7. The golf ball of claim 1, wherein, for each of the non-circular plan shape dimples, the maximum distance at any point on the plan shape from the simple closed path is from 0.001 inches to 0.020 inches.

8. The golf ball of claim 1, wherein, for each of the non-circular plan shape dimples, the maximum distance at any point on the plan shape from the simple closed path is from 0.002 inches to 0.010 inches.

9. The golf ball of claim 1, wherein, for each of the non-circular plan shape dimples, the maximum distance at any point on the plan shape from the simple closed path is from 0.003 inches to 0.008 inches.

* * * * *